US010235835B2

(12) United States Patent
Arnone et al.

(10) Patent No.: US 10,235,835 B2
(45) Date of Patent: Mar. 19, 2019

(54) GAME WORLD EXCHANGE FOR HYBRID GAMING

(71) Applicant: Gamblit Gaming, LLC, Glendale, CA (US)

(72) Inventors: Miles Arnone, Sherborn, MA (US); Frank Cire, Pasadena, CA (US); Eric Meyerhofer, Pasadena, CA (US); Caitlyn Ross, Watertown, MA (US)

(73) Assignee: Gamblit Gaming, LLC, Glendale, CA (US)

( * ) Notice: Subject to any disclaimer, the term of this patent is extended or adjusted under 35 U.S.C. 154(b) by 175 days.

(21) Appl. No.: 15/456,079

(22) Filed: Mar. 10, 2017

(65) Prior Publication Data

US 2017/0193745 A1 Jul. 6, 2017

Related U.S. Application Data

(63) Continuation of application No. 13/961,849, filed on Aug. 7, 2013, now abandoned, which is a continuation-in-part of application No. PCT/US2012/032652, filed on Apr. 7, 2012.

(60) Provisional application No. 61/574,515, filed on Aug. 4, 2011, provisional application No. 61/630,180, filed on Dec. 6, 2011, provisional application No. 61/680,376, filed on Aug. 7, 2012, provisional application No. 61/680,382, filed on Aug. 7, 2012.

(51) Int. Cl.
*G07F 17/32* (2006.01)

(52) U.S. Cl.
CPC ..... *G07F 17/3244* (2013.01); *G07F 17/3227* (2013.01); *G07F 17/3262* (2013.01)

(58) Field of Classification Search
CPC ..... G07F 17/3244; G07F 17/3227; G07F 17/3262
See application file for complete search history.

(56) References Cited

U.S. PATENT DOCUMENTS

| | | | |
|---|---|---|---|
| 5,413,357 | A | 5/1995 | Schulze et al. |
| 5,718,429 | A | 2/1998 | Keller |
| 5,785,592 | A | 7/1998 | Jacobsen |
| 5,853,324 | A | 12/1998 | Kami et al. |
| 5,963,745 | A | 10/1999 | Collins et al. |

(Continued)

FOREIGN PATENT DOCUMENTS

| | | | |
|---|---|---|---|
| JP | 2001300098 | A | 10/2001 |
| JP | 2003111980 | A | 4/2003 |

(Continued)

OTHER PUBLICATIONS

U.S. Appl. No. 14/586,645 Arnone, et al. filed Dec. 30, 2014.

(Continued)

*Primary Examiner* — Corbett B Coburn
(74) *Attorney, Agent, or Firm* — Caity Ross; Frank Cire

(57) ABSTRACT

A distributed gaming system for providing a game world exchange for a hybrid game. The system includes collecting game play metrics about amounts of real world credits paid out, and amounts of entertainment game world elements accrued, while players play a plurality of a first type and a plurality of a second type of entertainment game and using the game play metrics to determine game world exchange rates for entertainment game world elements between the first type and second type of entertainment game.

7 Claims, 25 Drawing Sheets

(56) References Cited

U.S. PATENT DOCUMENTS 6,050,895 A 4/2000 Luciano
6,165,071 A 12/2000 Weiss
6,227,974 B1 5/2001 Eilat
6,267,669 B1 7/2001 Luciano
6,685,563 B1 2/2004 Meekins et al.
6,712,693 B1 3/2004 Hettinger
6,761,632 B2 7/2004 Bansemer et al.
6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,766,742 B2 8/2010 Bennett et al.
7,775,885 B2 8/2010 Van Luchene
7,798,896 B2 9/2010 Katz
7,828,657 B2 11/2010 Booth
7,917,371 B2 3/2011 Jung et al.
7,931,531 B2 4/2011 Oberberger
7,938,727 B1 5/2011 Konkle
7,950,993 B2 5/2011 Oberberger
7,967,674 B2 6/2011 Baerlocher
7,980,948 B2 7/2011 Rowe
7,996,264 B2 8/2011 Kusumoto et al.
8,007,358 B2 8/2011 Linard et al.
8,012,023 B2 9/2011 Gates
8,047,908 B2 11/2011 Walker
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,142,272 B2 3/2012 Walker
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,308,544 B2 11/2012 Friedman
8,430,735 B2 4/2013 Oberberger
8,475,266 B2 7/2013 Amone
8,480,470 B2 7/2013 Napolitano et al.
8,622,809 B1 1/2014 Arora et al.
8,864,564 B2 10/2014 Oberberger
9,070,257 B1 6/2015 Scalise
2001/0004609 A1 6/2001 Walker et al.
2001/0019965 A1 9/2001 Ochi
2002/0022509 A1 2/2002 Nicastro
2002/0090990 A1 7/2002 Joshi et al.
2002/0175471 A1 11/2002 Faith
2003/0060286 A1 3/2003 Walker et al.
2003/0119576 A1 6/2003 McClintic et al.
2003/0139214 A1 7/2003 Wolf et al.
2003/0171149 A1 9/2003 Rothschild
2003/0204565 A1 10/2003 Guo et al.
2003/0211879 A1 11/2003 Englman
2004/0092313 A1 5/2004 Saito et al.
2004/0097610 A1 5/2004 Saito
2004/0102238 A1 5/2004 Taylor
2004/0121839 A1 6/2004 Webb
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0233806 A1 10/2005 Kane et al.
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0035696 A1 2/2006 Walker
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0223611 A1 10/2006 Baerlocher
2006/0234791 A1 10/2006 Nguyen et al.
2006/0240890 A1 10/2006 Walker
2006/0246403 A1 11/2006 Monpouet et al.
2006/0258433 A1 11/2006 Finocchio et al.
2007/0026924 A1 2/2007 Taylor
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 4/2007 Bergeron
2007/0099696 A1 5/2007 Nguyen et al.
2007/0117641 A1 5/2007 Walker et al.
2007/0129149 A1 6/2007 Walker
2007/0142108 A1 6/2007 Linard
2007/0156509 A1 7/2007 Jung et al.
2007/0167212 A1 7/2007 Nguyen
2007/0167239 A1 7/2007 O'Rourke
2007/0173311 A1 7/2007 Morrow et al.
2007/0191104 A1 8/2007 Van Luchene
2007/0202941 A1 8/2007 Miltenberger
2007/0203828 A1 8/2007 Jung et al.
2007/0207847 A1 9/2007 Thomas
2007/0259717 A1 11/2007 Mattice
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0064488 A1 3/2008 Oh
2008/0070659 A1 3/2008 Naicker
2008/0070690 A1 3/2008 Van Luchene
2008/0070702 A1 3/2008 Kaminkow
2008/0096665 A1 4/2008 Cohen
2008/0108406 A1 5/2008 Oberberger
2008/0108425 A1 5/2008 Oberberger
2008/0113704 A1 5/2008 Jackson
2008/0119283 A1 5/2008 Baerlocher
2008/0146308 A1 6/2008 Okada
2008/0161081 A1 7/2008 Berman
2008/0176619 A1 7/2008 Kelly
2008/0191418 A1 8/2008 Lutnick et al.
2008/0195481 A1 8/2008 Lutnick
2008/0248850 A1 10/2008 Schugar
2008/0254893 A1 10/2008 Patel
2008/0274796 A1 11/2008 Lube
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Erfanian
2009/0061974 A1 3/2009 Lutnick et al.
2009/0061975 A1 3/2009 Ditchev
2009/0061991 A1 3/2009 Popovich
2009/0061997 A1 3/2009 Popovich
2009/0061998 A1 3/2009 Popovich
2009/0061999 A1 3/2009 Popovich
2009/0082093 A1 3/2009 Okada
2009/0088239 A1 4/2009 Iddings
2009/0098934 A1 4/2009 Amour

(56) References Cited

U.S. PATENT DOCUMENTS

2009/0099925 A1* 4/2009 Mehta ..... G06F 17/30864 705/14.23
2009/0104960 A1 4/2009 Kelly et al.
2009/0118006 A1 5/2009 Kelly et al.
2009/0124344 A1 5/2009 Mitchell et al.
2009/0131158 A1 5/2009 Brunet De Courssou et al.
2009/0131175 A1 5/2009 Kelly et al.
2009/0143141 A1 6/2009 Wells
2009/0149233 A1 6/2009 Strause et al.
2009/0156297 A1 6/2009 Andersson et al.
2009/0176560 A1 7/2009 Herrmann et al.
2009/0176566 A1 7/2009 Kelly
2009/0181777 A1 7/2009 Christiani et al.
2009/0247272 A1 8/2009 Abe
2009/0221355 A1 9/2009 Dunaevsky et al.
2009/0239610 A1 9/2009 Olive
2009/0253494 A1* 10/2009 Fitch ..... A63F 13/12 463/25
2009/0270164 A1 10/2009 Seelig
2009/0275393 A1 11/2009 Kisenwether et al.
2009/0291755 A1 11/2009 Walker et al.
2009/0309305 A1 12/2009 May
2009/0312093 A1 12/2009 Walker et al.
2009/0325686 A1 12/2009 Davis
2010/0004058 A1 1/2010 Acres
2010/0016056 A1 1/2010 Thomas et al.
2010/0029373 A1 2/2010 Graham et al.
2010/0035674 A1 2/2010 Slomiany
2010/0056247 A1 3/2010 Nicely
2010/0056260 A1 3/2010 Fujimoto
2010/0062836 A1 3/2010 Young
2010/0093420 A1 4/2010 Wright
2010/0093444 A1 4/2010 Biggar et al.
2010/0105454 A1 4/2010 Weber
2010/0120525 A1 5/2010 Baerlocher et al.
2010/0124983 A1 5/2010 Gowin et al.
2010/0137047 A1 6/2010 Englman et al.
2010/0174593 A1 7/2010 Cao
2010/0184509 A1 7/2010 Sylla et al.
2010/0203940 A1 8/2010 Alderucci et al.
2010/0210344 A1 8/2010 Edidin et al.
2010/0227672 A1 9/2010 Amour
2010/0227688 A1 9/2010 Lee
2010/0234094 A1* 9/2010 Gagner ..... G07F 17/32 463/20
2010/0240436 A1 9/2010 Wilson et al.
2010/0285869 A1 11/2010 Walker
2010/0304825 A1 12/2010 Davis
2010/0304839 A1 12/2010 Johnson
2010/0304842 A1 12/2010 Friedman et al.
2011/0009177 A1 1/2011 Katz
2011/0009178 A1 1/2011 Gerson
2011/0045896 A1 2/2011 Sak et al.
2011/0070945 A1 3/2011 Walker
2011/0077087 A1 3/2011 Walker et al.
2011/0082571 A1 4/2011 Murdock et al.
2011/0105206 A1 5/2011 Rowe et al.
2011/0107239 A1 5/2011 Adoni et al.
2011/0111820 A1 5/2011 Filipour
2011/0111837 A1 5/2011 Gagner
2011/0111841 A1 5/2011 Tessmer
2011/0118011 A1 5/2011 Filipour et al.
2011/0109454 A1 6/2011 McSheffrey
2011/0201413 A1 8/2011 Oberberger
2011/0207523 A1 8/2011 Filipour et al.
2011/0218028 A1 8/2011 Acres
2011/0212766 A1 9/2011 Bowers et al.
2011/0212767 A1 9/2011 Barclay
2011/0213716 A1 9/2011 Ocko
2011/0218035 A1 9/2011 Thomas
2011/0230258 A1 9/2011 Van Luchene
2011/0230260 A1 9/2011 Morrow et al.
2011/0230267 A1 9/2011 Van Luchene
2011/0244944 A1 10/2011 Baerlocher
2011/0263312 A1 10/2011 De Waal
2011/0269522 A1 11/2011 Nicely et al.
2011/0275440 A1 11/2011 Faktor
2011/0287828 A1 11/2011 Anderson et al.
2011/0287841 A1 11/2011 Watanabe
2011/0312408 A1 12/2011 Okuaki
2011/0319169 A1 12/2011 Lam et al.
2012/0004747 A1 1/2012 Kelly et al.
2012/0028718 A1 2/2012 Barclay et al.
2012/0058814 A1 3/2012 Lutnick
2012/0077569 A1 3/2012 Watkins
2012/0108323 A1 5/2012 Kelly
2012/0135793 A1 5/2012 Antonopoulos
2012/0142429 A1* 6/2012 Muller ..... A63F 13/45 463/42
2012/0202587 A1* 8/2012 Allen ..... G07F 17/3223 463/25
2012/0302311 A1 11/2012 Luciano
2012/0322545 A1 12/2012 Arnone et al.
2013/0029760 A1 1/2013 Wickett et al.
2013/0036373 A1* 2/2013 Alderfer ..... G06Q 10/103 715/757
2013/0059308 A1 4/2013 Arnone et al.
2013/0131848 A1 5/2013 Amone et al.
2013/0190074 A1 7/2013 Amone et al.
2013/0260869 A1 10/2013 Leandro et al.
2013/0339228 A1* 12/2013 Shuster ..... G06F 9/541 705/40
2014/0087801 A1 3/2014 Nicely et al.
2014/0087808 A1 3/2014 Leandro et al.
2014/0087809 A1 3/2014 Leupp et al.
2014/0206437 A1* 7/2014 Arnone ..... G07F 17/3244 463/25
2014/0357350 A1 12/2014 Weingardt et al.

FOREIGN PATENT DOCUMENTS

JP 2004097610 A 4/2004
JP 2004166746 A 6/2004
WO 9851384 A1 11/1998
WO 2010087090 A1 8/2010
WO 2012139083 A1 10/2012

OTHER PUBLICATIONS

U.S. Appl. No. 14/598,151 Arnone, et al. filed Jan. 15, 2015.
U.S. Appl. No. 14/601,063 Arnone, et al. filed Jan. 20, 2015.
U.S. Appl. No. 14/601,108 Arnone, et al. filed Jan. 20, 2015.
U.S. Appl. No. 14/608,000 Arnone, et al. filed Jan. 28, 2015.
U.S. Appl. No. 14/608,087 Arnone, et al. filed Jan. 28, 2015.
U.S. Appl. No. 14/608,093 Arnone, et al. filed Jan. 28, 2015.
U.S. Appl. No. 14/610,897 Arnone, et al. filed Jan. 30, 2015.
U.S. Appl. No. 14/611,077 Arnone, et al. filed Jan. 30, 2015.
U.S. Appl. No. 14/604,629 Arnone, et al. filed Jan. 23, 2015.
U.S. Appl. No. 14/625,475 Arnone, et al. filed Feb. 18, 2015.
U.S. Appl. No. 14/617,852 Arnone, et al. filed Feb. 9, 2015.
U.S. Appl. No. 14/627,428 Arnone, et al. filed Feb. 20, 2015.
U.S. Appl. No. 14/642,427 Arnone, et al. filed Mar. 9, 2015.
U.S. Appl. No. 14/665,991 Arnone, et al. filed Mar. 23, 2015.
U.S. Appl. No. 14/666,010 Arnone, et al. filed Mar. 23, 2015.
U.S. Appl. No. 14/666,022 Arnone, et al. filed Mar. 23, 2015.
U.S. Appl. No. 14/642,623 Arnone, et al. filed Mar. 9, 2015.
U.S. Appl. No. 14/663,337 Arnone, et al. filed Mar. 19, 2015.
U.S. Appl. No. 14/666,284 Arnone, et al. filed Mar. 23, 2015.
U.S. Appl. No. 14/679,885 Arnone, et al. filed Apr. 6, 2015.
U.S. Appl. No. 14/685,378 Arnone, et al. filed Apr. 13, 2015.
U.S. Appl. No. 14/686,675 Arnone, et al. filed Apr. 14, 2015.
U.S. Appl. No. 14/686,678 Arnone, et al. filed Apr. 14, 2015.
U.S. Appl. No. 14/701,430 Arnone, et al. filed Apr. 30, 2015.
U.S. Appl. No. 14/703,721 Arnone, et al. filed May 4, 2015.
U.S. Appl. No. 14/708,138 Arnone, et al. filed May 8, 2015.
U.S. Appl. No. 14/708,141 Arnone, et al. filed May 8, 2015.
U.S. Appl. No. 14/708,160 Arnone, et al. filed May 8, 2015.
U.S. Appl. No. 14/708,161 Arnone, et al. filed May 8, 2015.
U.S. Appl. No. 14/708,162 Arnone, et al. filed May 8, 2015.
U.S. Appl. No. 14/710,483 Arnone, et al. filed May 12, 2015.

(56) References Cited

OTHER PUBLICATIONS

U.S. Appl. No. 14/714,084 Arnone, et al. filed May 15, 2015.
U.S. Appl. No. 14/715,463 Arnone, et al. filed May 18, 2015.
U.S. Appl. No. 14/720,620 Arnone, et al. filed May 22, 2015.
U.S. Appl. No. 14/720,624 Arnone, et al. filed May 22, 2015.
U.S. Appl. No. 14/720,626 Arnone, et al. filed May 22, 2015.
U.S. Appl. No. 14/727,726 Arnone, et al. filed Jun. 1, 2015.
U.S. Appl. No. 14/730,183 Arnone, et al. filed Jun. 3, 2015.
U.S. Appl. No. 14/731,321 Arnone, et al. filed Jun. 4, 2015.
U.S. Appl. No. 14/740,078 Arnone, et al. filed Jun. 15, 2015.
U.S. Appl. No. 14/742,517 Arnone, et al. filed Jun. 17, 2015.
U.S. Appl. No. 14/743,708 Arnone, et al. filed Jun. 18, 2015.
U.S. Appl. No. 14/746,731 Arnone, et al. filed Jun. 22, 2015.
U.S. Appl. No. 14/748,122 Arnone, et al. filed Jun. 23, 2015.
U.S. Appl. No. 14/788,581 Arnone, et al. filed Jun. 30, 2015.
U.S. Appl. No. 14/793,685 Arnone, et al. filed Jul. 7, 2015.
U.S. Appl. No. 14/793,704 Arnone, et al. filed Jul. 7, 2015.
U.S. Appl. No. 14/797,016 Arnone, et al. filed Jul. 10, 2015.
U.S. Appl. No. 14/799,481 Arnone, et al. filed Jul. 14, 2015.
U.S. Appl. No. 14/815,764 Arnone, et al. filed Jul. 31, 2015.
U.S. Appl. No. 14/815,774 Arnone, et al. filed Jul. 31, 2015.
U.S. Appl. No. 14/817,032 Arnone, et al. filed Aug. 3, 2015.
U.S. Appl. No. 14/822,890 Arnone, et al. filed Aug. 10, 2015.
U.S. Appl. No. 14/823,951 Arnone, et al. filed Aug. 11, 2015.
U.S. Appl. No. 14/823,987 Arnone, et al. filed Aug. 11, 2015.
U.S. Appl. No. 14/825,056 Arnone, et al. filed Aug. 12, 2015.
U.S. Appl. No. 14/835,590 Arnone, et al. filed Aug. 25, 2015.
U.S. Appl. No. 14/836,902 Arnone, et al. filed Aug. 26, 2015.
U.S. Appl. No. 14/839,647 Arnone, et al. filed Aug. 28, 2015.
U.S. Appl. No. 14/842,684 Arnone, et al. filed Sep. 1, 2015.
U.S. Appl. No. 14/842,785 Arnone, et al. filed Sep. 1, 2015.
U.S. Appl. No. 14/854,021 Arnone, et al. filed Sep. 14, 2015.
U.S. Appl. No. 14/855,322 Arnone, et al. filed Sep. 15, 2015.
U.S. Appl. No. 14/859,065 Arnone, et al. filed Sep. 18, 2015.
U.S. Appl. No. 14/865,422 Arnone, et al. filed Sep. 25, 2015.
U.S. Appl. No. 14/867,809 Arnone, et al. filed Sep. 28, 2015.
U.S. Appl. No. 14/868,287 Arnone, et al. filed Sep. 28, 2015
U.S. Appl. No. 14/868,364 Arnone, et al. filed Sep. 28, 2015
U.S. Appl. No. 14/869,809 Arnone, et al. filed Sep. 29, 2015.
U.S. Appl. No. 14/869,819 Arnone, et al. filed Sep. 29, 2015.
U.S. Appl. No. 14/885,894 Arnone, et al. filed Oct. 16, 2015.
U.S. Appl. No. 14/919,665 Arnone, et al. filed Oct. 21, 2015.
U.S. Appl. No. 14/942,844 Arnone, et al. filed Nov. 16, 2015.
U.S. Appl. No. 14/942,883 Arnone, et al. filed Nov. 16, 2015.
U.S. Appl. No. 14/949,759 Arnone, et al. filed Nov. 23, 2015.
U.S. Appl. No. 14/952,758 Arnone, et al. filed Nov. 25, 2015.
U.S. Appl. No. 14/952,769 Arnone, et al. filed Nov. 25, 2015.
U.S. Appl. No. 14/954,922 Arnone, et al. filed Nov. 30, 2015.
U.S. Appl. No. 14/954,931 Arnone, et al. filed Nov. 30, 2015.
U.S. Appl. No. 14/955,000 Arnone, et al. filed Nov. 30, 2015.
U.S. Appl. No. 14/956,301 Arnone, et al. filed Dec. 1, 2015.
U.S. Appl. No. 14/965,231 Arnone, et al. filed Dec. 10, 2015.
U.S. Appl. No. 14/965,846 Arnone, et al. filed Dec. 10, 2015.
U.S. Appl. No. 14/981,640 Arnone, et al. filed Dec. 28, 2015.
U.S. Appl. No. 14/981,775 Arnone, et al. filed Dec. 28, 2015.
U.S. Appl. No. 14/984,943 Arnone, et al. filed Dec. 30, 2015.
U.S. Appl. No. 14/984,965 Arnone, et al. filed Dec. 30, 2015.
U.S. Appl. No. 14/984,978 Arnone, et al. filed Dec. 30, 2015.
U.S. Appl. No. 14/985,107 Arnone, et al. filed Dec. 30, 2015.
U.S. Appl. No. 14/995,151 Arnone, et al. filed Jan. 13, 2016.
U.S. Appl. No. 14/974,432 Arnone, et al. filed Dec. 18, 2015.
U.S. Appl. No. 14/997,413 Arnone, et al. filed Jan. 15, 2016.
U.S. Appl. No. 15/002,233 Arnone, et al. filed Jan. 20, 2016.
U.S. Appl. No. 15/005,944 Arnone, et al. filed Jan. 25, 2016.
U.S. Appl. No. 15/011,322 Arnone, et al. filed Jan. 29, 2016.
U.S. Appl. No. 15/051,535 Arnone, et al. filed Feb. 23, 2016.
U.S. Appl. No. 15/053,236 Arnone, et al. filed Feb. 25, 2016.
U.S. Appl. No. 15/057,095 Arnone, et al. filed Feb. 29, 2016.
U.S. Appl. No. 15/060,502 Arnone, et al. filed Mar. 3, 2016.
WIPO/ISA—International Search Report and Written Opinion, PCT/US2013/54029, dated Aug. 7, 2013.
U.S. Appl. No. 14/205,303 Arnone, et al., filed Mar. 11, 2014.
U.S. Appl. No. 14/205,306 Arnone, et al., filed Mar. 11, 2014.
U.S. Appl. No. 14/209,485 Arnone, et al., filed Mar. 13, 2014.
U.S. Appl. No. 14/214,310 Arnone, et al., filed Mar. 14, 2014.
U.S. Appl. No. 14/222,520 Arnone, et al., filed Mar. 21, 2014.
U.S. Appl. No. 14/253,813 Arnone, et al., filed Apr. 15, 2014.
U.S. Appl. No. 14/255,253 Arnone, et al., filed Apr. 2014.
U.S. Appl. No. 14/255,919 Arnone, et al. filed Apr. 17, 2014.
U.S. Appl. No. 14/263,988 Arnone, et al. filed Apr. 28, 2014.
U.S. Appl. No. 14/270,335 Arnone, et al. filed May 5, 2014.
U.S. Appl. No. 14/271,360 Arnone, et al. filed May 6, 2014.
U.S. Appl. No. 13/961,849 Arnone, et al. filed Aug. 7, 2013.
U.S. Appl. No. 13/746,850 Arnone, et al. filed Jan. 22, 2013.
U.S. Appl. No. 14/288,169 Arnone, et al. filed May 27, 2014.
U.S. Appl. No. 14/304,027 Arnone, et al. filed Jun. 13, 2014.
U.S. Appl. No. 14/306,187 Arnone, et al. filed Jun. 16, 2014.
U.S. Appl. No. 14/312,623 Arnone, et al. filed Jun. 23, 2014.
U.S. Appl. No. 14/330,249 Arnone, et al. filed Jul. 14, 2014.
U.S. Appl. No. 14/339,142 Arnone, et al. filed Jul. 23, 2014.
U.S. Appl. No. 14/458,206 Arnone, et al. filed Aug. 12, 2014.
U.S. Appl. No. 14/461,344 Arnone, et al. filed Aug. 15, 2014.
U.S. Appl. No. 14/462,516 Arnone, et al. filed Aug. 18, 2014.
U.S. Appl. No. 14/467,646 Meyerhofer, et al. filed Aug. 25, 2014.
U.S. Appl. No. 14/474,023 Arnone, et al. filed Aug. 29, 2014.
U.S. Appl. No. 14/486,895 Arnone, et al. filed Sep. 15, 2014.
U.S. Appl. No. 14/507,206 Arnone, et al. filed Oct. 6, 2014.
U.S. Appl. No. 14/521,338 Arnone, et al. filed Oct. 22, 2014.
U.S. Appl. No. 14/535,808 Arnone, et al. filed Nov. 7, 2014.
U.S. Appl. No. 14/535,816 Arnone, et al. filed Nov. 7, 2014.
U.S. Appl. No. 14/536,231 Arnone, et al. filed Nov. 7, 2014.
U.S. Appl. No. 14/536,280 Arnone, et al. filed Nov. 7, 2014.
U.S. Appl. No. 14/549,137 Arnone, et al. filed Nov. 20, 2014.
U.S. Appl. No. 14/550,802 Arnone, et al. filed Nov. 21, 2014.
U.S. Appl. No. 14/555,401 Arnone, et al. filed Nov. 26, 2014.
U.S. Appl. No. 14/559,840 Arnone, et al. filed Dec. 3, 2014.
U.S. Appl. No. 14/564,834 Arnone, et al. filed Dec. 9, 2014.
U.S. Appl. No. 14/570,746 Arnone, et al. filed Dec. 15, 2014.
U.S. Appl. No. 14/570,857 Arnone, et al. filed Dec. 15, 2014.
U.S. Appl. No. 14/586,626 Arnone, et al. filed Dec. 30, 2014.
U.S. Appl. No. 14/586,639 Arnone, et al. filed Dec. 30, 2014.
U.S. Appl. No. 14/205,272 Arnone, et al., filed Mar. 11, 2014.
U.S. Appl. No. 15/063,365 Arnone, et al. filed Mar. 7, 2016.
U.S. Appl. No. 15/063,496 Arnone, et al. filed Mar. 7, 2016.
U.S. Appl. No. 15/073,602 Arnone, et al. filed Mar. 17, 2016.
U.S. Appl. No. 15/074,999 Arnone, et al. filed Mar. 18, 2016.
U.S. Appl. No. 15/077,574 Arnone, et al. filed Mar. 22, 2016.
U.S. Appl. No. 15/083,284 Arnone, et al. filed Mar. 28, 2016.
U.S. Appl. No. 15/091,395 Arnone, et al. filed Apr. 5, 2016.
U.S. Appl. No. 15/093,685 Arnone, et al. filed Apr. 7, 2016.
U.S. Appl. No. 15/098,287 Arnone, et al. filed Apr. 13, 2016.
U.S. Appl. No. 15/098,313 Arnone, et al. filed Apr. 13, 2016.
U.S. Appl. No. 15/130,101 Arnone, et al. filed Apr. 15, 2016.
U.S. Appl. No. 15/133,624 Arnone, et al. filed Apr. 20, 2016.
U.S. Appl. No. 15/134,852 Arnone, et al. filed Apr. 21, 2016.
U.S. Appl. No. 15/139,148 Arnone, et al. filed Apr. 26, 2016.
U.S. Appl. No. 15/141,784 Arnone, et al. filed Apr. 29, 2016.
U.S. Appl. No. 15/155,107 Arnone, et al. filed May 16, 2016.
U.S. Appl. No. 15/156,222 Arnone, et al. filed May 16, 2016.
U.S. Appl. No. 15/158,530 Arnone, et al. filed May 18, 2016.
U.S. Appl. No. 15/161,174 Arnone, et al. filed May 20, 2016.
U.S. Appl. No. 15/170,773 Arnone, et al. filed Jun. 1, 2016.
U.S. Appl. No. 15/174,995 Arnone, et al. filed Jun. 6, 2016.
U.S. Appl. No. 15/179,940 Arnone, et al. filed Jun. 10, 2016.
U.S. Appl. No. 15/189,797 Arnone, et al. filed Jun. 22, 2016.
U.S. Appl. No. 15/190,745 Arnone, et al. filed Jun. 23, 2016.
U.S. Appl. No. 15/191,050 Arnone, et al. filed Jun. 23, 2016.
U.S. Appl. No. 15/219,257 Arnone, et al. filed Jul. 25, 2016.
U.S. Appl. No. 15/227,881 Arnone, et al. filed Aug. 3, 2016.
U.S. Appl. No. 15/241,683 Arnone, et al. filed Aug. 19, 2016.
U.S. Appl. No. 15/245,040 Arnone, et al. filed Aug. 23, 2016.
U.S. Appl. No. 15/233,294 Arnone, et al. filed Aug. 24, 2016.

(56) References Cited

OTHER PUBLICATIONS

U.S. Appl. No. 15/252,190 Arnone, et al. filed Aug. 30, 2016.
U.S. Appl. No. 15/255,789 Arnone, et al. filed Sep. 2, 2016.
U.S. Appl. No. 15/261,858 Arnone, et al. filed Sep. 9, 2016.
U.S. Appl. No. 15/264,521 Arnone, et al. filed Sep. 13, 2016.
U.S. Appl. No. 15/264,557 Arnone, et al. filed Sep. 13, 2016.
U.S. Appl. No. 15/271,214 Arnone, et al. filed Sep. 20, 2016.
U.S. Appl. No. 15/272,318 Arnone, et al. filed Sep. 21, 2016.
U.S. Appl. No. 15/273,260 Arnone, et al. filed Sep. 22, 2016.
U.S. Appl. No. 15/276,469 Arnone, et al. filed Sep. 26, 2016.
U.S. Appl. No. 15/280,255 Arnone, et al. filed Sep. 29, 2016.
U.S. Appl. No. 15/286,922 Arnone, et al. filed Oct. 6, 2016.
U.S. Appl. No. 15/287,129 Arnone, et al. filed Oct. 6, 2016.
U.S. Appl. No. 15/289,648 Arnone, et al. filed Oct. 10, 2016.
U.S. Appl. No. 15/297,019 Arnone, et al. filed Oct. 18, 2016.
U.S. Appl. No. 15/298,533 Arnone, et al. filed Oct. 20, 2016.
U.S. Appl. No. 15/336,696 Arnone, et al. filed Oct. 27, 2016.
U.S. Appl. No. 15/339,898 Arnone, et al. filed Oct. 31, 2016.
U.S. Appl. No. 15/345,451 Arnone, et al. filed Nov. 7, 2016.
U.S. Appl. No. 15/362,214 Arnone, et al. filed Nov. 28, 2016.
U.S. Appl. No. 15/362,660 Arnone, et al. filed Nov. 28, 2016.
U.S. Appl. No. 15/365,628 Arnone, et al. filed Nov. 30, 2016.
U.S. Appl. No. 15/367,541 Arnone, et al. filed Dec. 2, 2016.
U.S. Appl. No. 15/369,394 Arnone, et al. filed Dec. 5, 2016.
U.S. Appl. No. 15/370,425 Arnone, et al. filed Dec. 6, 2016.
U.S. Appl. No. 15/375,711 Arnone, et al. filed Dec. 12, 2016.
U.S. Appl. No. 15/387,117 Arnone, et al. filed Dec. 21, 2016.
U.S. Appl. No. 15/392,887 Arnone, et al. filed Dec. 28, 2016.
U.S. Appl. No. 15/393,212 Arnone, et al. filed Dec. 28, 2016.
U.S. Appl. No. 15/394,257 Arnone, et al. filed Dec. 29, 2016.
U.S. Appl. No. 15/396,352 Arnone, et al. filed Dec. 30, 2016.
U.S. Appl. No. 15/396,354 Arnone, et al. filed Dec. 30, 2016.
U.S. Appl. No. 15/396,365 Arnone, et al. filed Dec. 30, 2016.
U.S. Appl. No. 15/406,474 Arnone, et al. filed Jan. 13, 2017.
U.S. Appl. No. 15/413,322 Arnone, et al. filed Jan. 23, 2017.
U.S. Appl. No. 15/415,833 Arnone, et al. filed Jan. 25, 2017.
U.S. Appl. No. 15/417,030 Arnone, et al. filed Jan. 26, 2017.
U.S. Appl. No. 15/422,453 Arnone, et al. filed Feb. 1, 2017.
U.S. Appl. No. 15/431,631 Arnone, et al. filed Feb. 13, 2017.
U.S. Appl. No. 15/434,843 Arnone, et al. filed Feb. 16, 2017.
U.S. Appl. No. 15/439,499 Arnone, et al. filed Feb. 22, 2017.
itl.nist.gov, Extreme Studentized Deviate Test, [online], Sep. 2010, Internet<URL:http://www.itl.nist.gov/div898/software/dataplot/refman1/auxillar/esd.htm>, entire document, National Institute of Standards and Technology (NIST), U.S. Department of Commerce.
Changing the Virtual Self: Avatar Transformations in Popular Games; Barr et al., Victoria Univ., NZ, 2006.
Real-Time Multimodal Human-Avatar Interaction; Li et al., IEEE (Video Technology) vol. 18, No. 4, 2008.
U.S. Appl. No. 13/854,658, Arnone, et al., filed Apr. 1, 2013.
U.S. Appl. No. 13/855,676, Arnone, et al., filed Apr. 2, 2013.
U.S. Appl. No. 13/872,946, Arnone, et al., filed Apr. 29, 2013.
U.S. Appl. No. 13/886,245, Arnone, et al., filed May 2, 2013.
U.S. Appl. No. 13/888,326, Arnone, et al., filed May 6, 2013.
U.S. Appl. No. 13/890,207, Arnone, et al., filed May 8, 2013.
U.S. Appl. No. 13/896,783, Arnone, et al., filed May 17, 2013.
U.S. Appl. No. 13/898,222, Arnone, et al., filed May 20, 2013.
U.S. Appl. No. 13/900,363, Arnone, et al., filed May 22, 2013.
U.S. Appl. No. 13/903,895, Arnone, et al., filed May 28, 2013.
U.S. Appl. No. 13/917,513, Arnone, et al., filed Jun. 13, 2013.
U.S. Appl. No. 13/917,529, Arnone, et al., filed Jun. 13, 2013.
U.S. Appl. No. 13/920,031, Arnone, et al., filed Jun. 17, 2013.
U.S. Appl. No. 13/928,166, Arnone, et al., filed Jun. 26, 2013.
U.S. Appl. No. 13/935,410, Arnone, et al., filed Jul. 3, 2013.
U.S. Appl. No. 13/935,468, Arnone, et al., filed Jul. 3, 2013.
International Search Report and Written Opinion, PCT/US2012/32652, dated Aug. 3, 2012.
U.S. Appl. No. 13/686,876, Arnone, et al., filed Nov. 27, 2012.
U.S. Appl. No. 13/944,662, Arnone, et al., filed Jul. 17, 2013.
U.S. Appl. No. 13/962,815, Arnone, et al., filed Aug. 8, 2013.
U.S. Appl. No. 13/962,839, Meyerhofer, et al., filed Aug. 8, 2013.
U.S. Appl. No. 14/018,315, Arnone, et al., filed Sep. 4, 2013.
U.S. Appl. No. 14/019,384, Arnone, et al., filed Sep. 5, 2013.
U.S. Appl. No. 14/023,432, Arnone, et al., filed Sep. 10, 2013.
U.S. Appl. No. 13/600,671, Arnone, et al., filed Aug. 31, 2012.
U.S. Appl. No. 13/582,408, Arnone, et al., filed Sep. 26, 2012.
U.S. Appl. No. 13/849,458, Arnone, et al., filed Mar. 22, 2013.
U.S. Appl. No. 14/135,562, Arnone, et al., filed Dec. 19, 2013.
U.S. Appl. No. 14/080,767, Arnone, et al., filed Nov. 14, 2013.
U.S. Appl. No. 14/043,838, Arnone, et al., filed Oct. 1, 2013.
U.S. Appl. No. 14/162,735, Arnone, et al., filed Jan. 23, 2014.
U.S. Appl. No. 14/161,230, Arnone, et al., filed Jan. 22, 2014.
U.S. Appl. No. 14/083,331, Arnone, et al., filed Nov. 18, 2013.
U.S. Appl. No. 14/014,310, Arnone, et al., filed Aug. 29, 2013.
U.S. Appl. No. 14/152,953, Arnone, et al., filed Jan. 10, 2014.
U.S. Appl. No. 14/162,724, Arnone, et al., filed Jan. 23, 2014.
U.S. Appl. No. 14/104,897, Arnone, et al., filed Dec. 12, 2013.
U.S. Appl. No. 14/174,813 Arnone, et al., filed Feb. 6, 2014.
U.S. Appl. No. 14/175,986 Arnone, et al., filed Feb. 7, 2014.
U.S. Appl. No. 14/176,014 Arnone, et al., filed Feb. 7, 2014.
U.S. Appl. No. 14/179,487 Arnone, et al., filed Feb. 12, 2014.
U.S. Appl. No. 14/179,492 Arnone, et al., filed Feb. 12, 2014.
U.S. Appl. No. 14/181,190 Arnone, et al., filed Feb. 14, 2014.
U.S. Appl. No. 14/186,393 Arnone, et al., filed Feb. 21, 2014.
U.S. Appl. No. 14/188,587 Arnone, et al., filed Feb. 24, 2014.
U.S. Appl. No. 14/185,847 Arnone, et al., filed Feb. 20, 2014.
U.S. Appl. No. 14/203,459 Arnone, et al., filed Mar. 10, 2014.

* cited by examiner

GAME WORLD EXCHANGE FOR HYBRID GAMING

CROSS-REFERENCE TO RELATED APPLICATIONS

This application is a continuation of U.S. patent application Ser. No. 13/961,849, file Aug. 7, 2013, which is a continuation in part of Patent Cooperation Treaty (PCT) Application No. PCT/US12/32652, filed Apr. 7, 2012, which claims priority of U.S. Provisional Applications Nos. 61/574,515 filed Aug. 4, 2011 and 61/630,180 filed Dec. 6, 2011, furthermore, this application claims priority to U.S. Provisional Applications Nos. 61/680,382, filed Aug. 7, 2012 and 61/680,376 filed Aug. 7, 2012, the disclosures of which are incorporated herein by reference as if set forth herein.

FIELD OF THE INVENTION

Embodiments of the present invention are generally related to gaming and more specifically to systems and processes that provide a game world object or credit exchange for games having both a skill component and a gambling component.

BACKGROUND OF THE INVENTION

The gaming machine manufacturing industry provides a variety of gaming machines to enable wagering for interested parties whilst providing an entertainment experience. An exemplary gaming machine is a slot machine. As the demographic of eligible players has shifted with time to newer generations who have grown accustomed to highly sophisticated graphics and interactive video games, a need has arisen to increase the entertainment content present on a gaming machine to keep it relevant, at least to a growing portion of a casino's patronage. The subject design is a form of gaming machine, designed for use in a physical or virtual casino environment, which provides players an environment in which to play for cash, prizes and points, either against the casino or in head to head modes in a controlled and regulated manner while being allowed to use their skills and adeptness at a particular type of game. An example of such a game would be a challenging word spelling game, or an interactive action game such as is found on video game consoles popular today, such as a PlayStation®, an Xbox®, a Wii® or a PC based.

SUMMARY OF THE INVENTION

Systems and methods in accordance with some embodiments of the invention provide a game world exchange for exchanging game world credits for a plurality of hybrid games. In one embodiment, the systems and methods include: an electromechanical gaming machine constructed to receive real credits from a user connected to a real world server by a communication link; the real world server connected to a game world exchange server by a communication link, wherein the real world server is constructed to: receive from the game world exchange server via the communication link, a trigger of a first wager; execute the first wager to determine a first payout of real credits using a random number generator; and distribute to the game world exchange server via the communication link, the first payout of real credits; receive from the game world exchange server via the communication link, a trigger of a second wager;

execute the second wager to determine a second payout of real credits using a random number generator; and distribute to the game world exchange server via the communication link, the second payout of real credits a first entertainment software server connected to the game world exchange server by a network, wherein the first entertainment software server is constructed to: execute a first entertainment game; receive from the game world exchange server via the network a first entertainment game element amount; make available to the player the first entertainment game element amount during the player's skillful play of the first entertainment game; and generate a visual display of the first entertainment game; and a second entertainment software server connected to the game world exchange server by a network, wherein the second entertainment software server is constructed to: execute a second entertainment game; receive from the game world exchange server via the network a f a second entertainment game element amount; make available to the player the second entertainment game element amount during the player's skillful play of the second entertainment game; and generate a visual display of the second entertainment game; and the game world exchange server connected by the communication link to the real world server and connected to first and second entertainment software servers by the network, wherein the game world exchange server is constructed to: interface the first entertainment software server to the real world server over the network by: distributing to the real world server via the communication link, the trigger of the first wager; receiving from the real world server via the communication link, the first payout; interface the second entertainment software server to the real world server over the network by: distributing to the real world server via the communication link, the trigger of the second wager; receiving from the real world server via the communication link, the second payout; and controlling the first entertainment software server by: determining, based on the first payout, the first entertainment game element amount available to the player while playing the first entertainment game; distributing to the first entertainment software server via the network, the first entertainment game element amount; and controlling the second entertainment software server by: determining an exchange rate for the first entertainment game element and the second entertainment game element using the first wager and the player's use of the first entertainment game element amount; determining, based on the second payout and the exchange rate, the second entertainment game element amount available to the player while playing the second entertainment game; and distributing to the second entertainment software server via the network, the second entertainment game element amount.

Additional embodiments may include wherein triggering the first wager in the further includes determining the amount of real credit committed to the first wager.

In another embodiment the game world exchange server and the real world server are implemented on a same processing apparatus.

In some embodiments, the communication link connecting the game world exchange server and the real world server utilizes the network.

In some embodiments, the game world exchange server is further constructed to: receive from the real world server via the network, a player identifier identifying the player; and store the first entertainment game element amount in an account determined by the player identifier.

In other embodiments, the game world exchange server is further constructed to: convert the first entertainment game element amount into a universal game world currency; and convert the universal game world currency into the second entertainment game element amount.

In another embodiment, the game world exchange server is further constructed to: receive from the real world server via the network, a player identifier identifying the player; and store the universal game world currency in an account determined by the player identifier.

DETAILED DESCRIPTION

Turning now to the drawings, systems and method for providing game world exchanges for hybrid games in accordance with some embodiments of the invention are illustrated. In accordance with some embodiments of the invention, system and methods collect game play metrics from a variety of types of hybrid games and determines effective exchange rates for game world credits, objects, experience points and the like for entertainment game portions of the various types of hybrid games.

Hybrid Games

Figure 1:
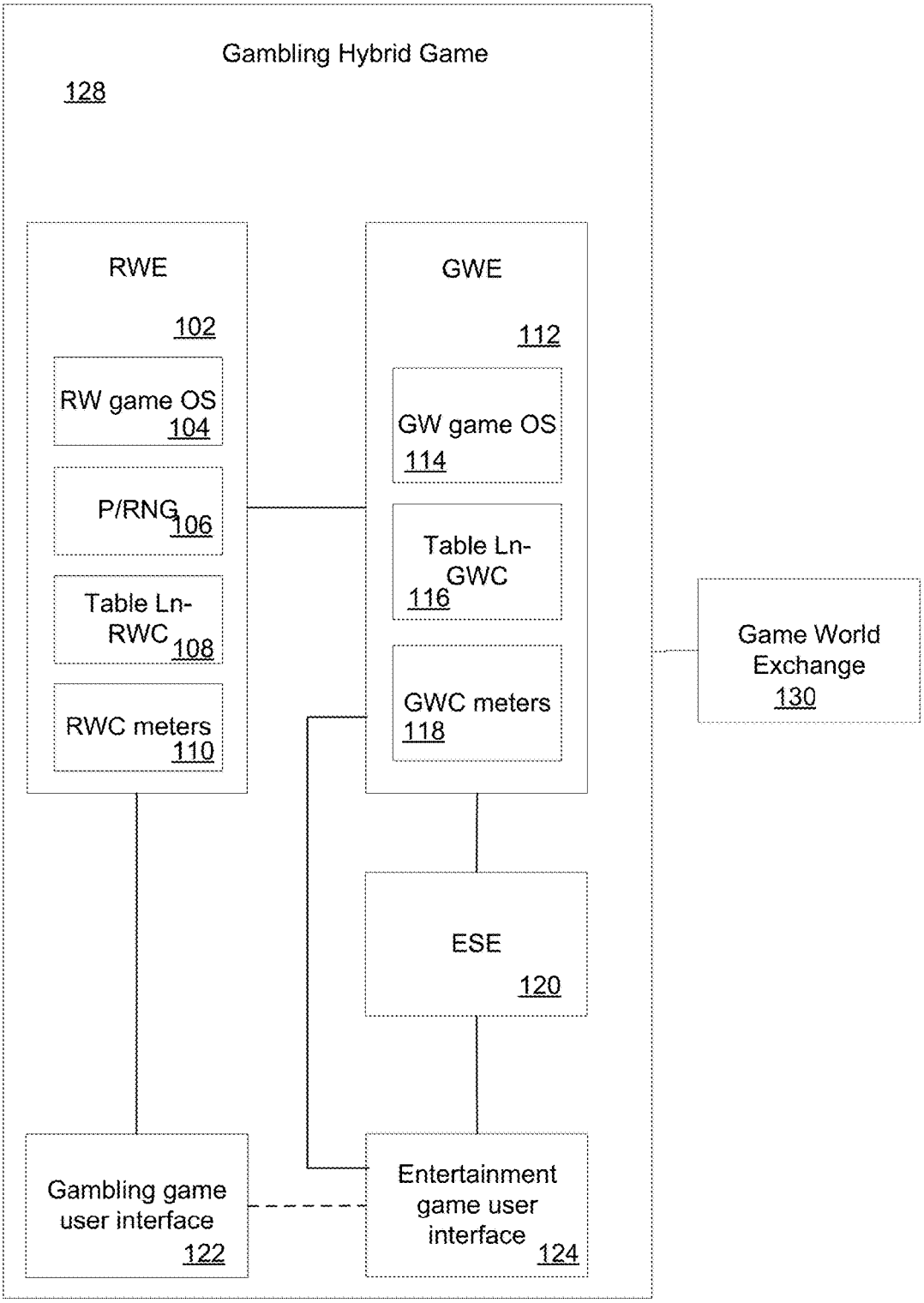
FIG. 1 illustrates a conceptual diagram of components of a hybrid game in accordance with an embodiment of the invention.

In accordance with many embodiments of the invention, a hybrid game integrates high-levels of entertainment content with a game of skill (entertainment game) and a gambling experience with a game of chance (gambling game). A hybrid game provides for random outcomes independent of player skill while providing that the user's gaming experience (as measured by obstacles/challenges encountered, time of play and other factors) is shaped by the player's skill. The outcome of a gambling proposition that is determined by a Pseudo/Random Number Generator (P/P/RNG) or other such device that provides a pseudo random or random outcome in response to a gambling request. In accordance with some embodiments, the wager game may be initiated in response to a game object related player action. A hybrid game in accordance with an embodiment of the invention is illustrated in FIG. 1. The hybrid game 128 includes a Real World Engine (RWE) 102, a Game World Engine (GWE) 112, an Entertainment System Engine (ESE) 120, a gambling game user interface 122 and an entertainment game user interface 124. The two user interfaces can be part of the same user interface but are separate in the illustrated embodiment. The RWE 102 is connected with the GWE 112 and the gambling game user interface 122. The ESE 120 is connected with the GWE 112 and the entertainment game user interface 124. The GWE 112 is connected also with the entertainment game user interface 124.

In accordance with several embodiments, the RWE 102 is the operating system for the gambling game of the hybrid game 128 and controls and operates the gambling game. The operation of a gambling game is enabled by Real World Currency (RC), such as money or other real world funds. A gambling game can increase or decrease an amount of RC based on random gambling outcomes, where the gambling proposition of a gambling game is typically regulated by gaming control bodies. In many embodiments, the RWE includes a Real World (RW) operating system (OS) 104, P/RNG 106, level n real-world credit pay tables (table Ln-RC) 108, RC meters 110 and other software constructs that enable a game of chance to offer a fair and transparent gambling proposition, and to contain the auditable systems and functions that can enable the game to obtain gaming regulatory body approval.

A random number generator (P/RNG) 106 includes software and/or hardware algorithms and/or processes, which are used to generate random outcomes. A level n real-world credit pay table (table Ln-RC) 108 is a table that can be used in conjunction with a random number generator (P/RNG) 106 to dictate the RC earned as a function of sponsored gameplay and is analogous to the pay tables used in a conventional slot machine. Table Ln-RC payouts are independent of player skill. There can be one table or multiple tables included in Ln-RC pay tables 108 contained in a gambling game, the selection of which can be determined by factors including (but not limited to) game progress that a player has earned, and/or bonus rounds for which a player can be eligible. RCs are credits analogous to slot machine game credits, which are entered into a gambling game by the user, either in the form of money such as hard currency or electronic funds. RCs can be decremented or augmented based on the outcome of a random number generator according to the table Ln-RC real world credits pay table 108, independent of player skill. In certain embodiments, an amount of RC can be used as criteria in order to enter higher ESE game levels. RC can be carried forward to higher game levels or paid out if a cash out is opted for by a player. The amount of RC used to enter a specific level of the game level n need not be the same for each level.

In accordance with some embodiments of the invention, the GWE 112 manages the overall hybrid game operation, with the RWE 102 and the ESE 120 effectively being support units to the GWE 112. In accordance with some of these embodiments, the GWE 112 contains mechanical, electronic, and software systems for an entertainment game. The GWE 112 includes an operating system (OS) 114 that provides control of the entertainment game. The GWE additionally contains a level n game world credit pay table (table Ln-GWC) 116 from where to take input from this table to affect the play of the entertainment game. The GWE 112 can further couple to the RWE 102 to determine the amount of RC available on the game and other metrics of wagering on the gambling game (and potentially affect the amount of RC in play on the RWE). The GWE additionally contains various audit logs and activity meters (such as the GWC meter) 118. The GWE 112 can also couple to a centralized server for exchanging various data related to the player and their activities on the game. The GWE 112 furthermore couples to the ESE 120.

In accordance with some embodiments, a level n game world credit pay table (Table Ln-GWC) 116 dictates the Game World Credit (GWC) earned as a function of player skill in the nth level of the game. The payouts governed by this table are dependent upon player skill and sponsored gameplay at large and can or cannot be coupled to a P/RNG. In accordance with some embodiments, GWCs are player points earned or depleted as a function of player skill, specifically as a function of player performance in the context of the game. GWC is analogous to the score in a typical video game. Each entertainment game has one or more scoring criterion, embedded within the table Ln-GWC 116 that reflects player performance against the goal(s) of the game. GWCs can be carried forward from one level of sponsored gameplay to another, and ultimately paid out in various manners such as directly in cash, or indirectly such as by earning entrance into a sweepstakes drawing, or earning participation in, or victory in, a tournament with prizes. GWCs can be stored on a player tracking card or in a network-based player tracking system, where the GWCs are attributed to a specific player.

In accordance with certain embodiments, the operation of the GWE does not affect the RWE's gambling operation except for player choice parameters that are allowable in slot machines, including but not limited to, wager terms such as, but not limited to, a wager amount, how fast the player wants to play (by pressing a button or pulling the handle of a slot machine), and/or agreement to wager into a bonus round. In this sense, the RWE 102 provides a fair and transparent, non-skill based gambling proposition co-processor to the GWE 112. In the illustrated embodiment, the communication link shown between the GWE 112 and the RWE 102 allows the GWE 112 to obtain information from the RWE 102 as to the amount of RC available in the gambling game. The communication link can also convey a status operation of the RWE (such as on-line or tilt). The communication link can further communicate the various gambling control factors which the RWE 102 uses as input, such as the number of RC consumed per game or the player's election to enter a jackpot round. In FIG. 1, the GWE 112 is also shown as connecting to the player's user interface directly, as this can be utilized to communicate certain entertainment game club points, player status, control the selection of choices and messages which a player can find useful in order to adjust the entertainment game experience or understand their gambling status in the RWE 102.

In accordance with various embodiments of the invention, the ESE 120 manages and controls the visual, audio, and player control for the entertainment game. In accordance with certain embodiments, the ESE 120 accepts input from a player through a set of hand controls, and/or head, gesture, and/or eye tracking systems and outputs video, audio and/or other sensory output to a user interface. In accordance with many embodiments, the ESE 120 can exchange data with and accept control information from the GWE 112. In accordance with some of these embodiments, an ESE 120 can be implemented using a personal computer (PC), a Sony PlayStation® (a video game console developed by Sony Computer Entertainment of Tokyo Japan), or Microsoft Xbox® (a video game console developed by Microsoft Corporation of Redmond, Wash.) running a specific entertainment game software program. In accordance with some of these embodiments, ESE 120 can be an electromechanical game system of a draw certificate based hybrid game that is an electromechanical hybrid game. An electromechanical hybrid game executes an electromechanical game for player entertainment. The electromechanical game can be any game that utilizes both mechanical and electrical components, where the game operates as a combination of mechanical motions performed by at least one player or the electromechanical game itself. Various electromechanical hybrid games are discussed in Patent Cooperation Treaty Application No. PCT/US12/58156, filed Sep. 29, 2012, the contents of which are hereby incorporated by reference in their entirety.

The ESE 120 operates mostly independently from the GWE 112, except that via the interface, the GWE 112 can send certain entertainment game control parameters and elements to the ESE 120 to affect its play, such as (but not limited to) what level of character to be using, changing the difficulty level of the game, changing the type of gun or car in use, and/or requesting potions to become available or to be found by the character. These game control parameters and elements can be based on a gambling outcome of a gambling game that was triggered by an element in the entertainment game being acted upon by the player. The ESE 120 can accept this input from the GWE 112, make adjustments, and continue entertainment game gameplay all the while running seamlessly from the player's perspective. The ESE's operation is mostly skill based, except for where the ESE's processes can inject complexities into the game by chance in its normal operation to create unpredictability in the entertainment game. Utilizing this interface, the ESE 120 can also communicate player choices made in the game to the GWE 112, such as but not limited to selection of a different gun, and/or the player picking up a special potion in the GW environment. The GWE's function in this architecture, being interfaced with the ESE 120, is to allow the transparent coupling of entertainment software to a fair and transparent random chance gambling game, providing a seamless perspective to the player that they are playing a typical popular entertainment game (which is skill based). In accordance with certain embodiments, the ESE 120 can be used to enable a wide range of entertainment games including but not limited to popular titles from arcade and home video games, such as but not limited to Gears of War (a third person shooter game developed by Epic Games of Cary, N.C.), Time Crisis (a shooter arcade game developed by Namco Ltd of Tokyo, Japan), or Madden Football (an American football video game developed by EA Tiburon of Maitland, Fla.). Providers of such software can provide the previously described interface by which the GWE 120 can request amendments to the operation of the ESE software in order to provide seamless and sensible operation as both a gambling game and an entertainment game.

In accordance with some embodiments, the RWE 102 can accept a trigger to run a gambling game in response to actions taken by the player in the entertainment game as conveyed by the ESE 120 to the GWE 112, or as triggered by the GWE 112 based on its algorithms, background to the overall game from the player's perspective, but can provide information to the GWE 112 to expose the player to certain embodiments of the gambling game, such as (but not limited to) odds, amount of RC in play, and amount of RC available. The RWE 102 can accept modifications in the amount of RC wagered on each individual gambling try, or the number of gambling games per minute the RWE 102 can execute, entrance into a bonus round, and other factors, all the while these factors can take a different form than that of a typical slot machine. An example of a varying wager amount that the player can choose can include, but is not limited to, gameplay with a more powerful character, a more powerful gun, or a better car. These choices can increase or decrease the amount wagered per individual gambling game, in the same manner that a standard slot machine player can decide to wager more or less credits for each pull of the handle. In accordance with some of these embodiments, the RWE 102 can communicate a number of factors back and forth to the GWE 112, via an interface, such increase/decrease in wager being a function of the player's decision making as to their operational profile in the entertainment game (such as but not limited to the power of the character, gun selection or car choice). In this manner, the player is always in control of the per game wager amount, with the choice mapping to some parameter or component that is applicable to the entertainment game experience of the hybrid game. In accordance with a particular embodiment, the RWE 102 operation can be a game of chance as a gambling game running every 10 seconds where the amount wagered is communicated from the GWE 112 as a function of choices the player makes in the operation profile in the entertainment game.

In many embodiments, a hybrid game integrates a video game style gambling machine, where the gambling game (including an RWE 102 and RC) is not player skill based, while at the same time allows players to use their skills to earn club points which a casino operator can translate to rewards, tournament opportunities and prizes for the players. The actual exchange of monetary funds earned or lost directly from gambling against a game of chance in a gambling game, such as a slot machine, is preserved. At the same time, a rich environment of rewards to stimulate gamers can be established with the entertainment game. In accordance with some of these embodiments, the hybrid game can leverage very popular titles with gamers and provides a sea change environment for casinos to attract players with games that are more akin to the type of entertainment that a younger generation desires. In accordance with various embodiments, players can use their skill towards building and banking GWC that in turn can be used to win tournaments and various prizes as a function of their gamer prowess. Numerous embodiments minimize the underlying changes needed to the aforementioned entertainment software for the hybrid game to operate within an entertainment game construct, thus making a plethora of complex game titles and environments, rapid and inexpensive to deploy in a gambling environment.

In accordance with some embodiments, hybrid games also allow players to gain entry into subsequent competitions through the accumulation of game world credits (GWC) as a function of the user's demonstrated skill at the game. These competitions can pit individual players or groups of players against one another and/or against the casino to win prizes based upon a combination of chance and skill. These competitions can be either asynchronous events, whereby players participate at a time and/or place of their choosing, or they can be synchronized events, whereby players participate at a specific time and/or venue.

In accordance with some embodiments, one or more players engage in playing an entertainment game, resident in the ESE, the outcomes of which are dependent at least in part on skill. The hybrid game can include an entertainment game that includes head to head play between a single player and the computer, between two or more players against one another, or multiple players playing against the computer and/or each other, as well as the process by which players bet on the outcome of the entertainment game. The entertainment game can also be a game where the player is not playing against the computer or any other player, such as in games where the player is effectively playing against himself or herself (such as but not limited to Solitaire and Babette).

In some embodiments, one or more hybrid games 128 may be operatively connected to one or more game world exchanges (GWEx) 130. A GWEx collects game play metrics about a user's play of a hybrid game, including information about a user's RC commitment to the hybrid game and the user's accumulation of GWC, game world objects, experience points or the like based on the users skillful play of the entertainment game. The GWEx uses the game metrics to generate game world exchange rates as described herein. The game world exchange rates are for exchanging various types of entertainment game credits, game objects, experience points and the like for the various types of hybrid games being played by users.

Figure 2:
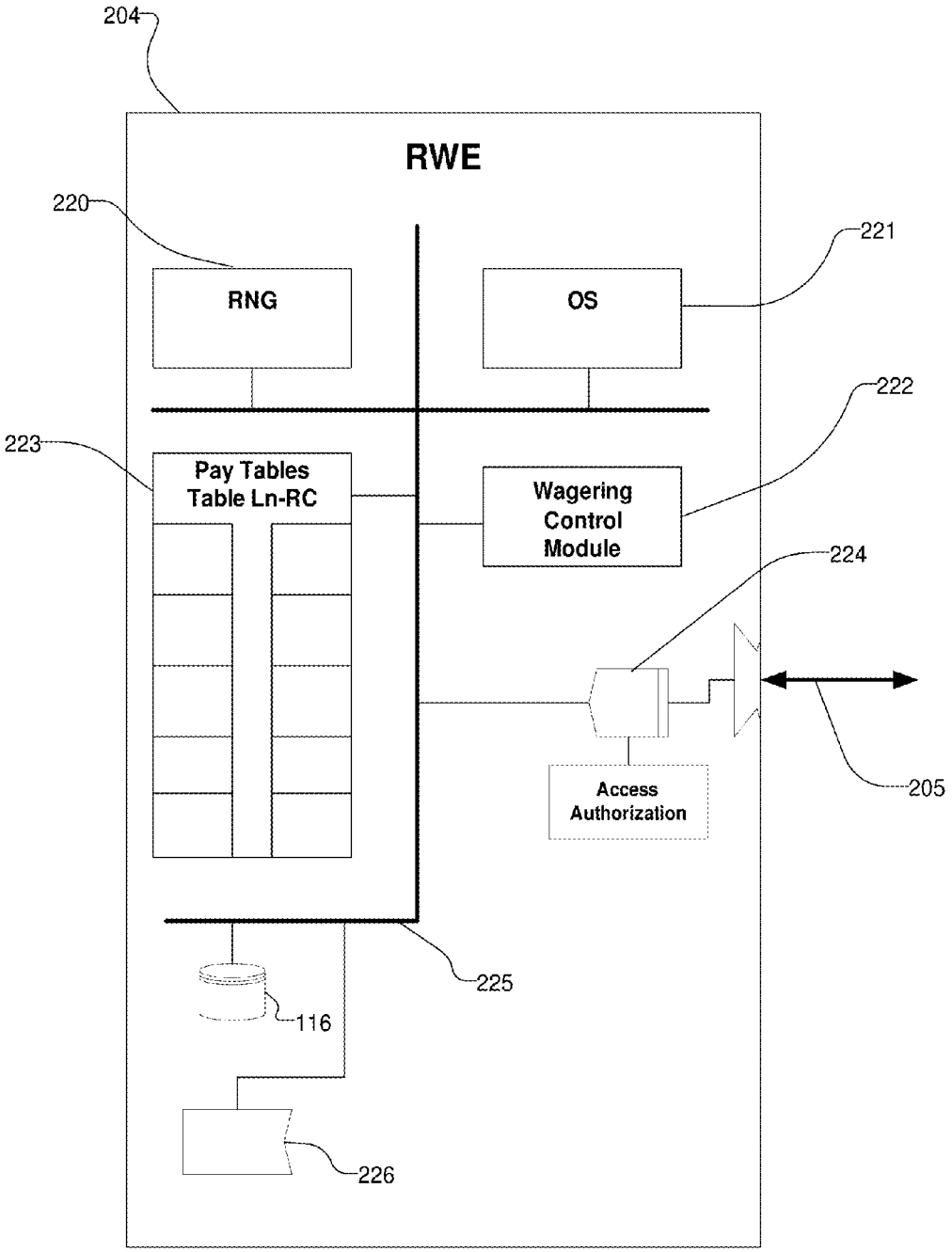
FIG. 2 illustrates a conceptual diagram of embodiments of a Real World Engine (RWE) of a hybrid game in accordance with some embodiments of the invention.

The components provided by the RWE for a hybrid game in accordance with some embodiments of the invention are shown in FIG. 2. In accordance with some embodiments of the invention, the RWE includes an internal bus 225 that connects an operating system OS 221, a Random Number Generator ("P/RNG") 220, one or more pay tables (Table Ln-RC) 223 which would control the functions of the RWE, a Random Number Generator ("P/RNG") 220 to produce random numbers, one or more pay tables (Table Ln-RC) 223, a wagering control module 222, an authorization access module 224, and a RC credit meter 226 that are included in the RWE 204. The RW OS 221 controls the functions of the RWE. The P/RNG 220 includes one or more P/RNGs that are used to produce random numbers for use in resolving gambling events and other process requiring a random number to determine an outcome. The one or more pay tables (Table Ln-RC) 223 contain a plurality of factors indexed by the random number to be multiplied with the RC wagered to determine the payout on a successful wager. A wagering control module 222 performs the processes to resolve a wager on a proposition of a gambling event. The resolution process includes, but is not limited to, pulling random numbers, looking up factors in Pay Tables, multiplying the factors by the amount of RC wagered, and administering a RC credit meter 226. A repository (a credit meter) 926 maintains a record of the amount of RC which player has deposited in the game and has been accumulated by the player.

An external connection allows the RWE 204 to interface to another system or device, which is shown in FIG. 2 as the internet 205 but may be any other network and/or device. The authorization access module 224 of RWE 204 is connected to the external connection and provides a method to permit access and command exchange between an external system and the RWE 904. The RWE 904 also contains storage for statuses, wagers, wager outcomes, meters and other historical events in a storage device 116.

Figure 3:
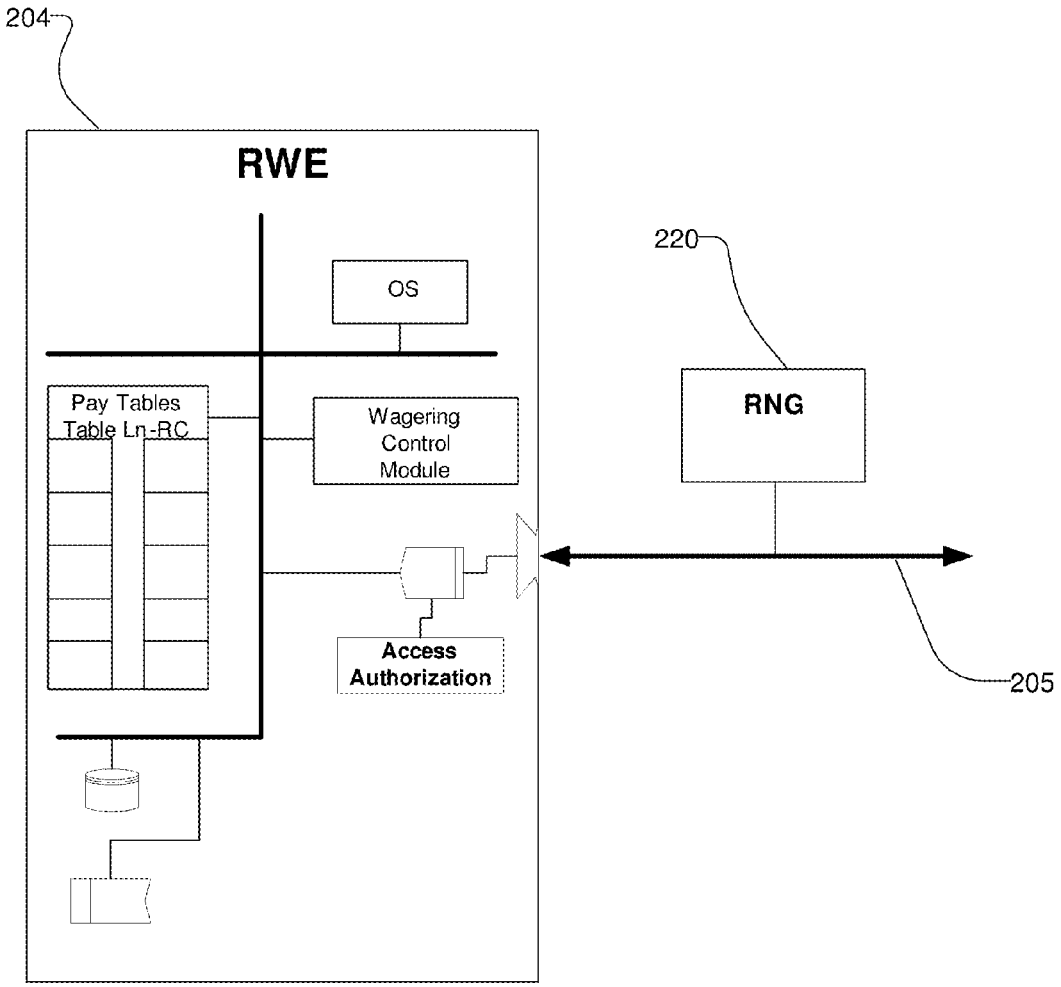
FIG. 3 illustrates a conceptual diagram of embodiments of a Real World Engine of a hybrid game in accordance with some other embodiments of the invention.

In some embodiments, the RWE communicates with external systems to provide various functions of a hybrid game in accordance with some embodiments of the invention. The components of an RWE that communicate with an external system to provide a component of the RWE in accordance with some embodiments of the invention are shown in FIG. 3. The RWE 204 shown in FIG. 3 is similar to the RWE shown in FIG. 2. However, the P/RNG 220 which is an external system connected to the RWE 204 by the internet 905 in accordance with some embodiments of the invention. The P/RNG 220 could be a central deterministic system, such as a regulated and controlled random numbered ball selection device, or some other system which provides random or pseudo random numbers to one or a plurality of connected RWEs 204. One skilled in the art will recognize that only P/RNG 220 is an external system in the shown embodiments. However, any of the components could be external systems without departing from the spirit of this invention and P/RNG 220 is shown as an example only.

In FIGS. 2 and 3, the RWE 204 interfaces with other systems/devices or to an external P/RNG 220 using the Internet 205. However, one skilled in the art will note that nothing would preclude using a different interface than the internet 205 in other embodiments of the invention. Other examples of interfaces include, but are not limited to, a LAN, a USB interface, or some other method by which two electronic and software constructs could communicate with each other.

Figure 4:
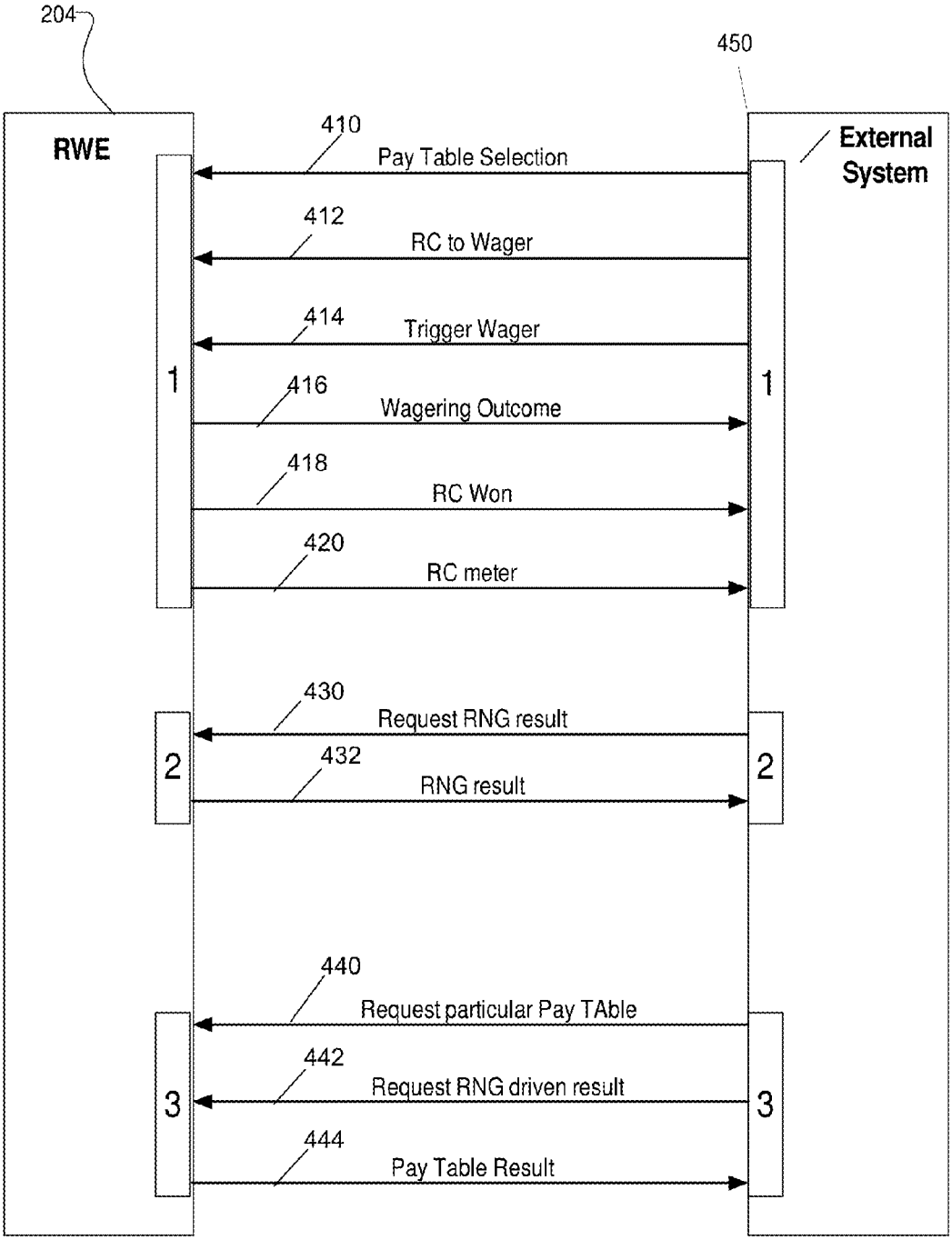
FIG. 4 illustrates a signaling diagram of communications between a Real World Engine (RWE) and an external system to provide various functions in accordance with some embodiments of the invention.

The RWE and an external system typically communicate to provide the resolution of gambling events to resolve wagers on the events. The signals between the RWE and an external system to provide some process related to resolving gambling events in accordance with some embodiments of the invention are shown in FIG. 4. In accordance with some embodiments of the invention, the primary function of the RWE 204 is to manage wagering events and to provide random (or pseudo random) numbers from an P/RNG. At the top of the figure, a 6 component communication exchange grouped by the "1" box is shown for a wager on a proposition in a gambling event during a hybrid game in accordance with some embodiments of the invention. An external system 450 that is requesting wagering support from the RWE 204 instructs the RWE 204 as to the pay table (Table Ln-RC) to use (410), followed by the amount of RC to wager on the proposition of the gambling event (412). Next, the external system 450 signals the RWE to trigger a wager or perform the gambling event (414). The RWE 204 resolves the gambling event. The RWE 204 then informs external system 450 as to the outcome of the wager (416), the amount of RC won (418), and the amount of RC in the player's account (in the credit repository) (420).

A second communication exchange between the RWE 204 and an external system 450 in accordance with some embodiments of the invention that is shown in FIG. 4 is grouped by the "2" box in FIG. 4 and relates to the external system 450 needing an P/RNG result support from the RWE 204. In this exchange, the external system 450 requests an P/RNG result from the RWE 204 (430). The RWE 204 returns an P/RNG result to the external 450 in response to the request (432). The result may be generated as a function of the internal P/RNG in the RWE 204, or from an P/RNG external to the RWE 204 to which the RWE 204 is connected.

A third communication exchange between the RWE 204 and the external system 405 in accordance with some embodiments of the invention that is shown in FIG. 4 is grouped by the "3" box in the figure and relates to the external system 450 wanting support on coupling an P/RNG result to a particular Pay Table contained in the RWE 204. In this exchange, the external system 450 instructs the RWE as to the pay table (Table Ln-RC) to use 450. The external system then requests a result whereby the P/RNG result is coupled to the requested Pay Table (442). The result is returned to the external system 405 by RWE 204 (444). Such an embodiment is different from the first exchange shown by the box"1" sequence in that no actual RC wager is conducted. However, such a process t might be useful in coupling certain non-RC wagering entertainment game behaviors and propositions to the same final resultant wagering return which is understood for the hybrid game to conduct wagering.

In regards to FIG. 4, one skilled in the art will note that the thrust of the FIG. 4 is to convey overall functional exchanges between an RWE 204 and an external system 450. As such, various protocol layers used for error free and secure communication, and other status, setup, and configuration commands which one might expect in any protocol between two connected systems have been omitted for clarity. Furthermore, some or all of the various commands and responses illustrated could be combined into one or more communication packets without departing from the spirit of this invention.

Figure 5:
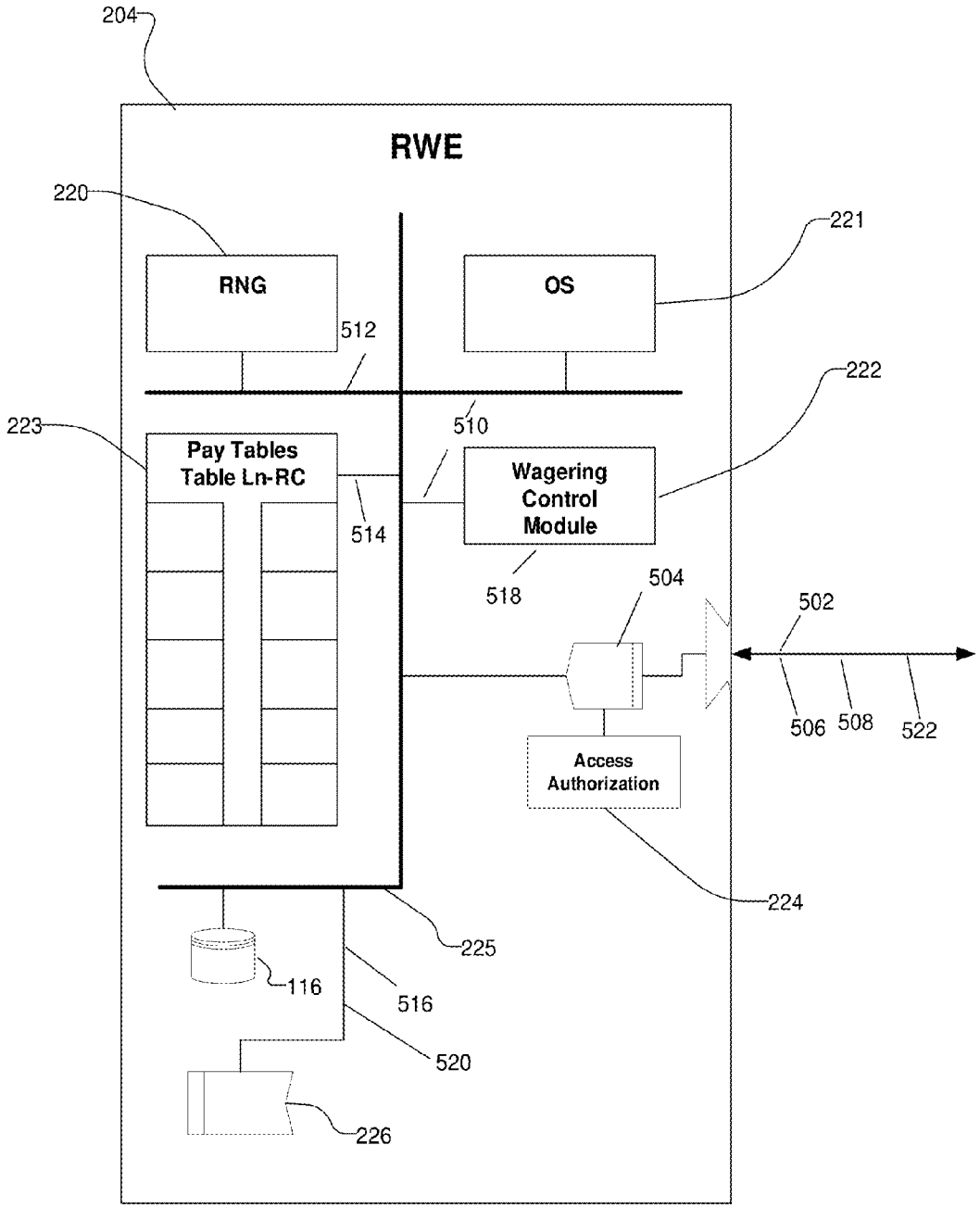
FIG. 5 illustrates a conceptual diagram of a process flow and signaling in an RWE to provide various functions in accordance with some embodiments of the invention.

The process flow for functional communication exchanges, such as communication exchanges described above with reference to FIG. 4, between a RWE and an external system in accordance with some embodiments of the invention are shown in FIG. 5. The process begins by a RWE 204 receiving signals from an external system requesting a connection to RWE 204. The Access Authorization Module determines that the external system authorized to connect to RWE 204 (504) and transmits an authorization response to the external system. The external systems that provide requests a request for a gambling event is to be performed to RWE 294 (506). The request may include an indication of a wager amount on a proposition in the gambling event, and a proper pay table to use to resolve the wager. The external system then sends a signal to trigger the gambling event (508).

The OS 221 instructs the Wager Control Module 222 as to the RC wager and the Pay Table to select as well as to resolve the wager execute (510). In response to the request to execute the gambling event, the wager control module 222 requests an P/RNG result from the P/RNG 220 (512); retrieves a proper pay table or tables from the pay tables 223 (514); adjusts the RC of the player in the RC repository 926 as instructed (516; applies the P/RNG result to the particular pay table or tables (518); and multiplies the resultant factor from the Pay Table by the amount of RC to determine the result of the wager (518). Wager Control Module 222 then adds the amount of RC won by the wager to the RC repository 426 (520); and provides he outcome of the wager, and the amount of RC in the RWE and the RC won (522). One skilled in the art will recognize that there may be many embodiments of an RWE 204 which could be possible, including forms where many modules and components of the RWE are located in various servers and locations, so the foregoing is not meant to be exhaustive or all inclusive, but rather provide information about an RWE 204 in accordance with some embodiments of the invention.

Figure 6:
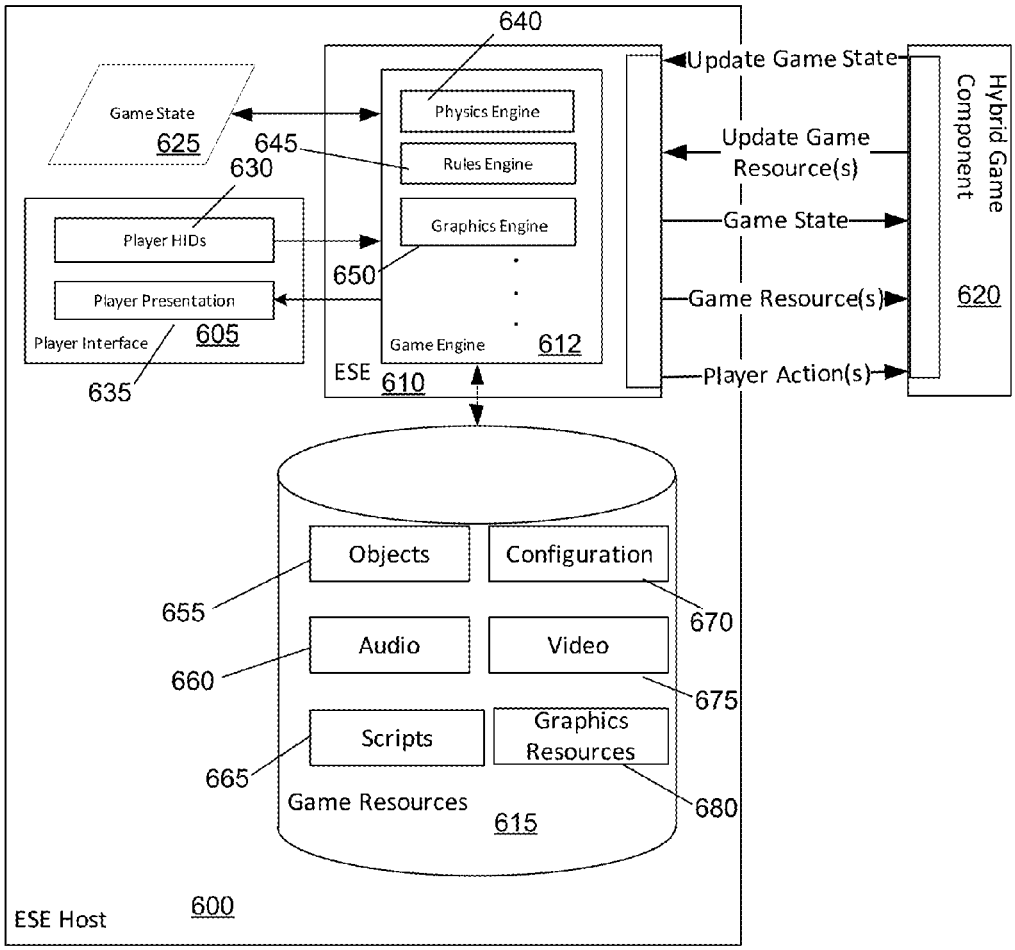
FIG. 6 illustrates a conceptual diagram of embodiments of an Entertainment System Engine (ESE) in accordance with some embodiments of the invention.

A block diagram of components an ESE being provided by an ESE host for a hybrid game in accordance with some embodiments of the invention are shown in FIG. 6. An ESE 610 may be part of the entertainment game itself, may be a software module that is executed by the entertainment game, or may provide an execution environment for the entertainment game for a particular host. The ESE 610 and associated entertainment game are hosted by an ESE host 600. The ESE host 600 is a computing device that is capable of hosting the ESE 610 and the entertainment game. Exemplary hosts include video game consoles, smart phones, personal computers, tablet computers, or the like. The entertainment game includes a game engine 612 that generates a player interface 605 for interaction with by a player. The player interface includes a player presentation 635 that is presented to a player through the player interface. The player presentation 635 may be audio, visual or tactile, or any combination of such. The player interface 635 further includes one or more Human Input Devices (HIDs) 630 that the player uses to interact with the entertainment game. Various components or sub-engines of the game engine read data from a game state in order to implement the features of the game. Components of the game engine include a physics engine 640 used to simulate physical interactions between virtual objects in the game state, a rules engine 645 for implementing the rules of the game, an P/RNG that may be used for influencing or determining certain variables and/or outcomes to provide a randomizing influence on game play, a graphics engine 650 used to generate a visual representation of the game state to the player, an audio engine to generate audio outputs for the player interface, and any other engine needed to provide the entertainment game. The game engine 612 reads and writes game resources 615 stored on a data store of the ESE host. The game resources 615 include game objects 655 having graphics and/or control logic used to implement game world objects of the game engine. The game resources 615 also include video files 675 that are used to generate cut-scenes for the entertainment game. The game resources 615 may also include audio files 660 used to generate music, sound effects, etc. within the entertainment game. The game resources 615 may also include configuration files 670 used to configure the features of the entertainment game. The game resources 615 may also include scripts 665 or other types of control code used to implement various game play features of the entertainment game. The game resources 615 may also include graphics resources 680 including, but not limited to, textures, and objects that are used by the game engine to render objects displayed in the entertainment game.

In operation, components of the game engine 612read portions of the game state 625 and generate the player presentation for the player which is presented to the player using the player interface 605. The player perceives the presentation 635 and provides player inputs using the HIDs 630. The corresponding player inputs are received as player actions or inputs by various components of the game engine 612. The game engine translates the player actions into interactions with the virtual objects of the game world stored in the game state 625. Components of the game engine 612 use the player interactions with the virtual objects of the game and the game state 625 to update the game state 625 and update the presentation 635 presented to the user. The process loops in a game loop continuously while the player plays the game.

The ESE 610 provides one or more interfaces between an entertainment game and other components 620 of a hybrid game, such as a GWE. The ESE 610 and the other hybrid game component 620 communicate with each other using the interfaces, such as by passing various types of data and sending and receiving messages, status information, commands and the like. Examples of communications include, but are not limited to, requesting by the hybrid game component 620 that the ESE 610 update the game state using information provided by the other component; requesting, by the hybrid game component 620, that the ESE 610 update one or more game resources using information provided by the hybrid game component 620; the ESE 610 providing all or a portion of the game state; the ESE 610 providing one or more of the game resources to the hybrid game component 620; and the ESE 610 communicating player actions to the other hybrid game component 620. The player actions may be low level player interactions with the player interface, such as manipulation of an HID, or may be high level interactions with objects as determined by the entertainment game. The player actions may also include resultant actions such as modifications to the game state or game resources resulting from the player's actions taken in the game. Other examples of player actions include actions taken by entities, such as Non-Player Characters (NPC) of the entertainment game, that act on behalf of, or under the control of, the player.

Figure 7:
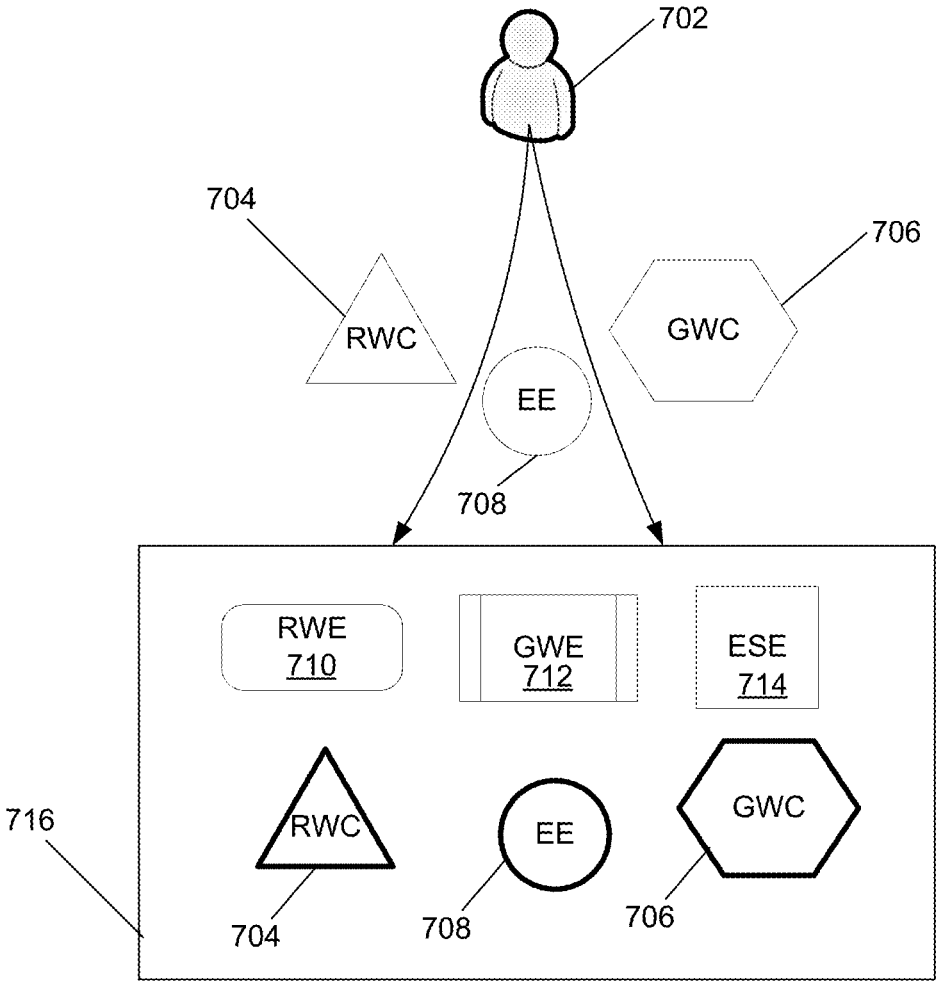
FIG. 7 illustrates a conceptual diagram of interactions between a user and a hybrid game in accordance with some embodiments of the invention.

In accordance with some embodiments, a player can interact with a hybrid game by using RC in interactions with a gambling game along with GWC and elements in interactions with an entertainment game. The gambling game can be executed by a RWE while an entertainment game can be executed with an ESE and managed with a GWE. A conceptual diagram that illustrates how resources such as GWC, RC and elements, such as but not limited to Entertainment Elements (EE), are utilized in a hybrid game in accordance with an embodiment of the invention is illustrated in FIG. 7. The conceptual diagram illustrates that RC 704, EE 708 and GWC 706 can be utilized by a player 702 in interactions with the RWE 710, GWE 712 and ESE 714 of a based hybrid game 716. The contribution of elements, such as EE 708, can be linked to a player's access to credits, such as RC 704 or GWC 706. Electronic receipt of these credits can come via a smart card, voucher or other portable media, or as received over a network from a server. In accordance with certain embodiments, these credits can be drawn on demand from a player profile located in a database locally on a hybrid game or in a remote server.

Figure 8:
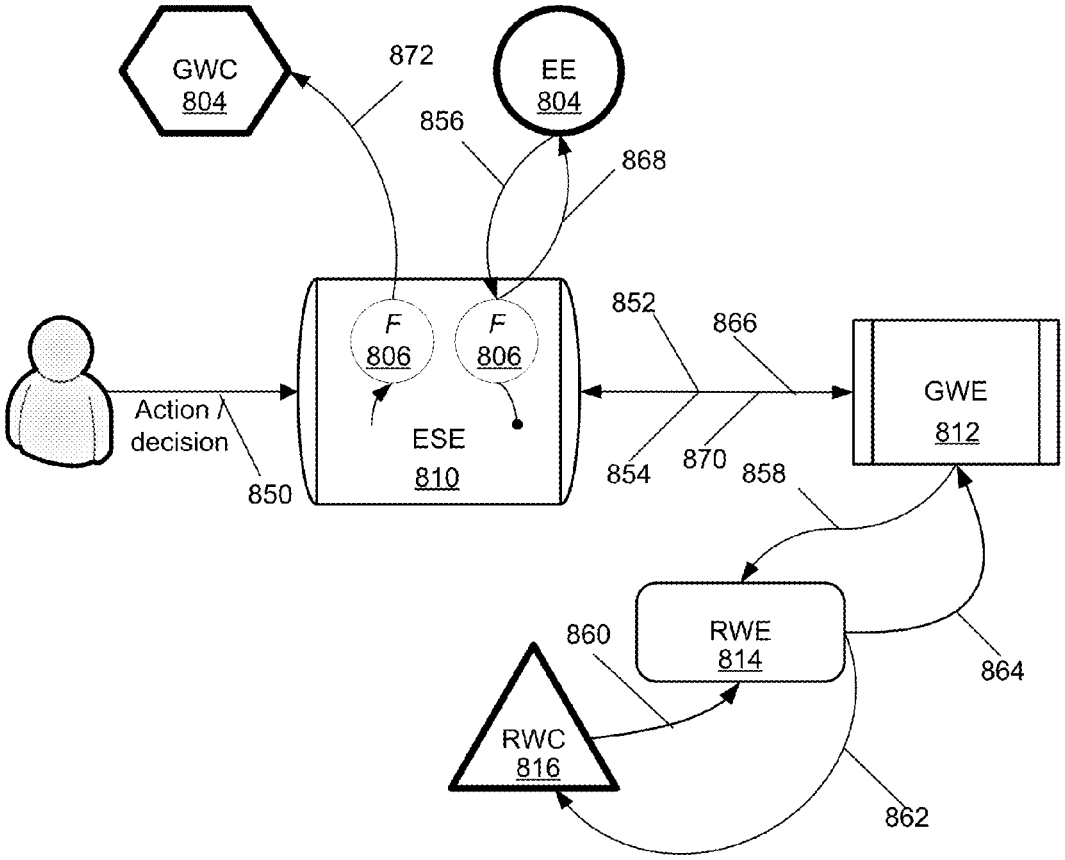
FIG. 8 illustrates conceptual diagram that illustrates the interplay between embodiments of a hybrid game in accordance with some embodiments of the invention using Real World Currency (RC or RC).

A conceptual diagram that illustrates the interplay between embodiments of a hybrid game in accordance with an embodiment of the invention using Real World Currency (RC) is illustrated in FIG. 8. Similar to FIG. 7, a player's actions and/or decisions can affect functions 806 that consume and/or accumulate GWC 802 and/or EE 804 in an entertainment game executed by an ESE 810. A GWE 812 can monitor the activities taking place within an entertainment game executed by an ESE 810 for gameplay gambling event occurrences. The GWE 812 can also communicate the gameplay gambling event occurrences to an RWE 814 that triggers a wager of RC 816 in a gambling game executed by the RWE 814.

In accordance with some embodiments of the invention, the following may occur during use of the hybrid game. The user enters an input that represents an action or decision (850). The ESE 810 signals the GWE 812 with the input decision or action (852). The GWE 812 responds by signaling to ESE 810 with the amount of EE that is consumed by the player action or decision (854). The signaling from the GWE 812 configures a function 806 to control the EE consumption, decay, and/or accumulation.

The ESE 810 then adjusts the EE 804 accordingly (856). The GWE 812 signals the RWE 814 as to the profile of the wager proposition associated with the action or decision and triggers the wager (858). The RWE 814 consumes the appropriate amount of RC 816 and executes the wager (860). The RWE 814 then adjusts the RC 816 based upon the outcome of the wager (862) and informs the GWE 812 as to the outcome of the wager (864).

The GWE 812 signals the ESE 810 to adjust EE to one or more of the EEs of the ESE entertainment game (866). Function 806 of the ESE 810 performs the adjustment of EE 804 (868). The ESE 810 signals the GWE 812 as to the updated status (870). In response, the GWE 812 signals the ESE 810 to update GWC of the entertainment game. The ESE updates the GWC 802 using a function 806 (872).

The following is an example of the above flow in a first person shooter game, such a Call of Duty®, using a hybrid game sequence in accordance with some embodiments of the invention.

The process begins by a player selecting a machine gun to use in the game and then fires a burst of bullets at an opponent (850). The ESE 810 signals the GWE 812 of the player's choice of weapon, that a burst of bullets was fired, and the outcome of the burst (852). GWE 812 processes the information received and signals ESE 810 to consume 3 bullets (EE) with each pull of the trigger (854). The ESE 810 consumes 3 bullets for the burst using function 806 (856).

The GWE 812 signals the RWE 814 that 3 credits (RC) are to be wagered to match the three bullets consumed. The RWE 814 then determines the result of the wager and may determine the winnings from a pay table. On a particular pay table (Table Ln-RC), a determination is made by RWE 814 as to the amount of damage that the opponent has sustained. The RWE 814 consumes 3 credits of RC 816 for the wager and executes the specified wager (860). The RWE 814 determines that the player hit a jackpot of 6 credits and returns the 6 credits to the RC 816 (862) and signals the GWE 812 that 3 net credits were won by the player (864).

The GWE 812 signals ESE 810 to add 3 bullets to an ammunition clip (866). ESE 810 adds 3 bullets back to the ammo clip (EE 804) using a function 806 (868). The ammunition may be added by directly adding the ammunition to the clip or by allowing the user to find extra ammunition during game play. The GWE 812 logs the new player score (GWC 802) in the game (as a function of the successful hit on the opponent) based on the ESE 810 signaling, and the signals the ESE 810 to add 2 extra points to the player score since a jackpot has been won (870). The ESE 810 then adds 10 points to the player score (GWC 802) given the success of the hit which in this example is worth 8 points, plus the 2 extra points requested by GWE 812 (872). Note that the foregoing example is only intended to provide an illustration of how credits flow in a hybrid game, but is not intended to be exhaustive and only lists only one of numerous possibilities of how a hybrid game may be configured to manage its fundamental credits.

Figure 9:
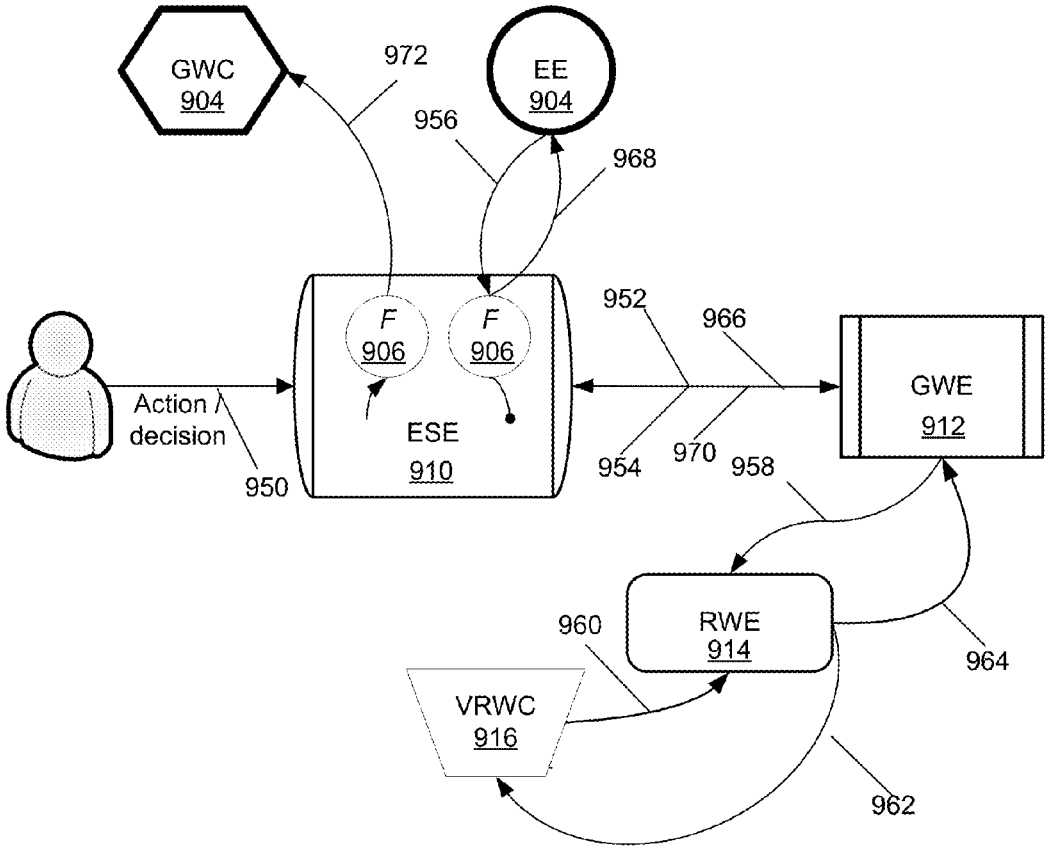
FIG. 9 illustrates conceptual diagram that illustrates the interplay between embodiments of a hybrid game in accordance with other embodiments of the invention using Virtual Real World Currency (VRC or VRC).

A conceptual diagram that illustrates the interplay between embodiments of a hybrid game in accordance with an embodiment of the invention using Virtual Real World Currency (VRC) is illustrated in FIG. 9. As seen in the FIG. 9, substituting VRC in place of RC is effected without impact to the architecture or operation of the hybrid game. The implementation of FIG. 9 is not the only embodiment using virtual currency within a hybrid game, but shows only one permutation of which many could exist.

Similar to FIG. 8, a player's actions and/or decisions can affect functions 906 that consume and/or accumulate GWC 902 and/or EE 904 in an entertainment game executed by an ESE 910 in the process shown in FIG. 9. A GWE 912 can monitor the activities taking place within an entertainment game executed by an ESE 910 for gameplay gambling event occurrences. The GWE 912 can also communicate the gameplay gambling event occurrences to an RWE 914. Unlike the process shown in FIG. 8, RWE 914 triggers a wager of Virtual Real World Currency (VRC) 916 in a gambling game executed by the RWE 914.

For purposes of this discussion, VRC can be thought of as a form of alternate currency, which can be acquired, purchased or transferred, in unit or in bulk, by/to a player, but does not necessarily directly correlate to RC or real currency. As an example, there is a virtual currency called "Triax Jacks", 1000 units of which are given to a player by an operator of a hybrid game, with additional blocks of 1000 units being available for purchase for $5 USD each block. Triax Jacks could be redeemed for various prizes, or could never be redeemed but simply used and traded purely for entertainment value by players. It would be completely consistent with the architecture of the hybrid game that Triax Jacks would be wagered in place of RC, such that the hybrid game could be played for free, or with played with operator sponsored Triax Jacks.

Returning to the process in FIG. 9, the following may occur during use of the hybrid game in accordance with some embodiments of the invention. The user enters an input that represents an action or decision (950). The ESE 910 signals the GWE 912 with the input decision or action (952). The GWE 912 responds by signaling to ESE 910 with the amount of EE that is consumed by the player action or decision (954). The signaling from the GWE 912 configures a function 906 to control the EE consumption, decay, and/or accumulation.

The ESE 910 then adjusts the EE 904 accordingly (956). The GWE 912 signals the RWE 914 as to the profile of the wager proposition associated with the action or decision and triggers the wager (958). The RWE 914 consumes the appropriate amount of RC 916 and executes the wager (960). The RWE 914 then adjusts the RC 916 based upon the outcome of the wager (962) and informs the GWE 912 as to the outcome of the wager (964).

The GWE 912 signals the ESE 910 to adjust EE to one or more of the EEs of the ESE entertainment game (966). Function 906 of the ESE 910 performs the adjustment of EE 904 (968). The ESE 910 signals the GWE 912 as to the updated status (970). In response, the GWE 912 signals the ESE 910 to update GWC 902 of the entertainment game. The ESE updates the GWC 902 using a function 906 (972).

Network Based Hybrid Game

Figure 10:
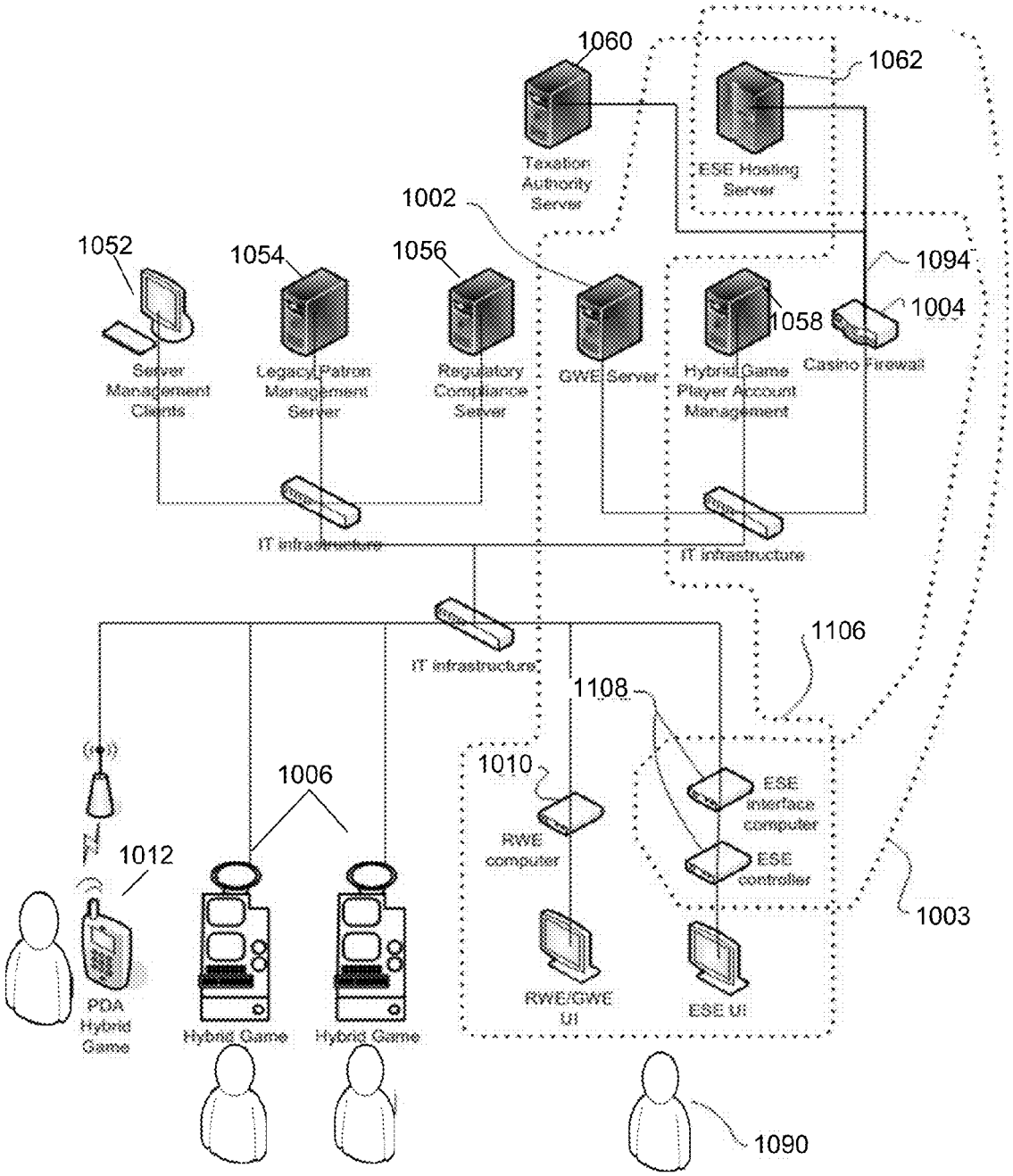
FIG. 10 illustrates a system diagram of an implementation of a network based hybrid game in accordance with another embodiment of the invention.

A system diagram that illustrates an implementation of a network distributed hybrid game with a GWE local server in accordance with some embodiments of the invention is illustrated in FIG. 10. The system includes several hybrid games 806 sharing services from the same GWE local server 1002 over a network. The system includes several hybrid games 1006 sharing services from the same GWE local server 1002 over a network. Hybrid game 1012 is a particular implementation where the hybrid game is implemented on a mobile device connected to the network via a wireless connection. The remaining hybrid games 1006 are shown as stand-alone gaming consoles as may be used in a casino. However, a gambling hybrid 1006 can be implemented on any device, including laptops, desktop computers, mobile phones, tablets or the like over a network connection. A single hybrid game 1006 with a RWE 1010, ESE 1008 and GWE 1002 that is provided for user 1090 is enclosed within a dotted line. In accordance with some embodiments the ESE controller and interface in the system may interact with an ESE hosting server 1062, as denoted by dotted line 1003, to provide the ESE 1008. A number of other peripheral systems, such as, but not limited to, legacy patron management server 1052, client management server 1054, regulatory compliance server 1056, and hybrid game player account management server 1058 can also interface with the game object hybrid games over a network within an operator's firewall 1004. Other servers can reside outside the bounds of a network within an operator's firewall 1004 to provide additional services for network connected game object hybrid games. Examples of such servers, include, but are not limited to taxation authority server 1060 and ESE hosting server 1062. One skilled in the art will recognize that although these systems are represented as one server that one or more connected servers or other processing systems may provide the same function without departing from this invention.

A system diagram that illustrates an implementation of a hybrid game having a local and group GWE server in accordance with some embodiments of the invention is illustrated in FIG. 10. The system includes several hybrid games 906 sharing services from the same GWE local server 1191 over a network, such as internet 1105. Hybrid game 1112 is a particular implementation where the hybrid game is implemented on a mobile device connected to the network via a wireless connection. The remaining hybrid games 1106 are shown as stand-alone gaming consoles as may be used in a casino. However, a gambling hybrid 1106 can be implemented on any device, including laptops, desktop computers, mobile phones, tablets or the like over a network connection. A single hybrid game 1106 with a RWE 1104, ESE 1112, and GWE 1102 is enclosed within a dotted line. This system includes a hybrid game 1106 that includes a RWE 1104, an ESE 1112 and a GWE 1102. GWE 1102 shown enclosed within a dotted line but where a single hybrid game can call upon services from servers within an operator's firewall 1106 (such as, but not limited to, a GWE local server 1191) as well as beyond an operator's firewall 1106 (such as, but not limited to, a GWE group server 1192). The GWE 1102 can coordinate multiple hybrid games from across a network that spans beyond an operator's firewall 1106. A GWE server system 1102 can include multiple GWE servers, such as, but not limited to, a GWE local server 1191 and a GWE group server 1192. Multiple network connected hybrid games 1106 can be connected to various servers to call upon services that enable the execution of the hybrid game. These servers include but are not limited to client management server 1152 and legacy patron management server 1154 within the casino firewall 1106; and regulatory compliance server 1156, hybrid game account management server 1158, taxation authority server 1160 and ESE hosting server 1162 outside the casino firewall 1106. One skilled in the art will recognize that servers may be single servers or a group of servers and processing systems providing the services without departing from this invention; and that the servers described may be within or outside of casino firewall 906 without departing from this invention.

Figure 12:
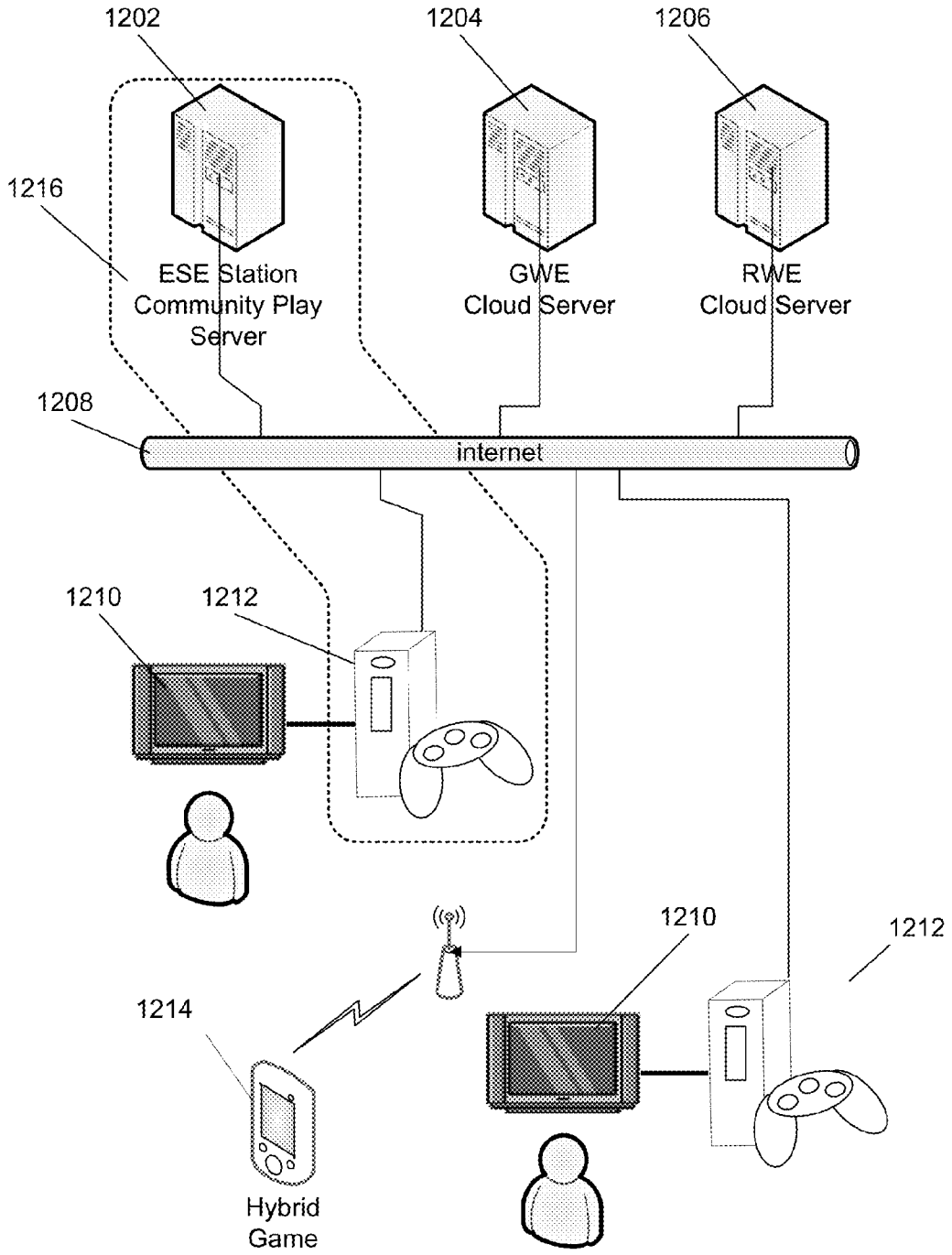
FIG. 12 illustrates a system diagram of an implementation of a cloud based hybrid game in accordance with some embodiments of the invention.

A system diagram that illustrates an implementation of network a cloud based hybrid game over the Internet in accordance with an embodiment of the invention is illustrated in FIG. 12. The system includes an ESE server 1202, GWE server 1204 and RWE server 1206 that each connect to a user interface 1210 (such as, but not limited to, a television screen, computer terminal, tablet, touchscreen or PDA) of game object hybrid games over the Internet 1208. Each hybrid game includes a local ESE 1212 (such as, but not limited to, a video game console or a gaming computer system) that interfaces with a remote ESE server 1002. Processes performed by an ESE 1212 services can be performed in multiple locations, such as, but not limited to, remotely on an ESE server 1202 and locally on a local ESE 1212. In addition, a hybrid game may include a Personal Digital Assistant (PDA) 1214 or other type of mobile computing device game coupled to the ESE hosting server 1202, thus providing the opportunity for a player to play a hybrid game on the PDA through a mobile phone or data network.

Figure 11:
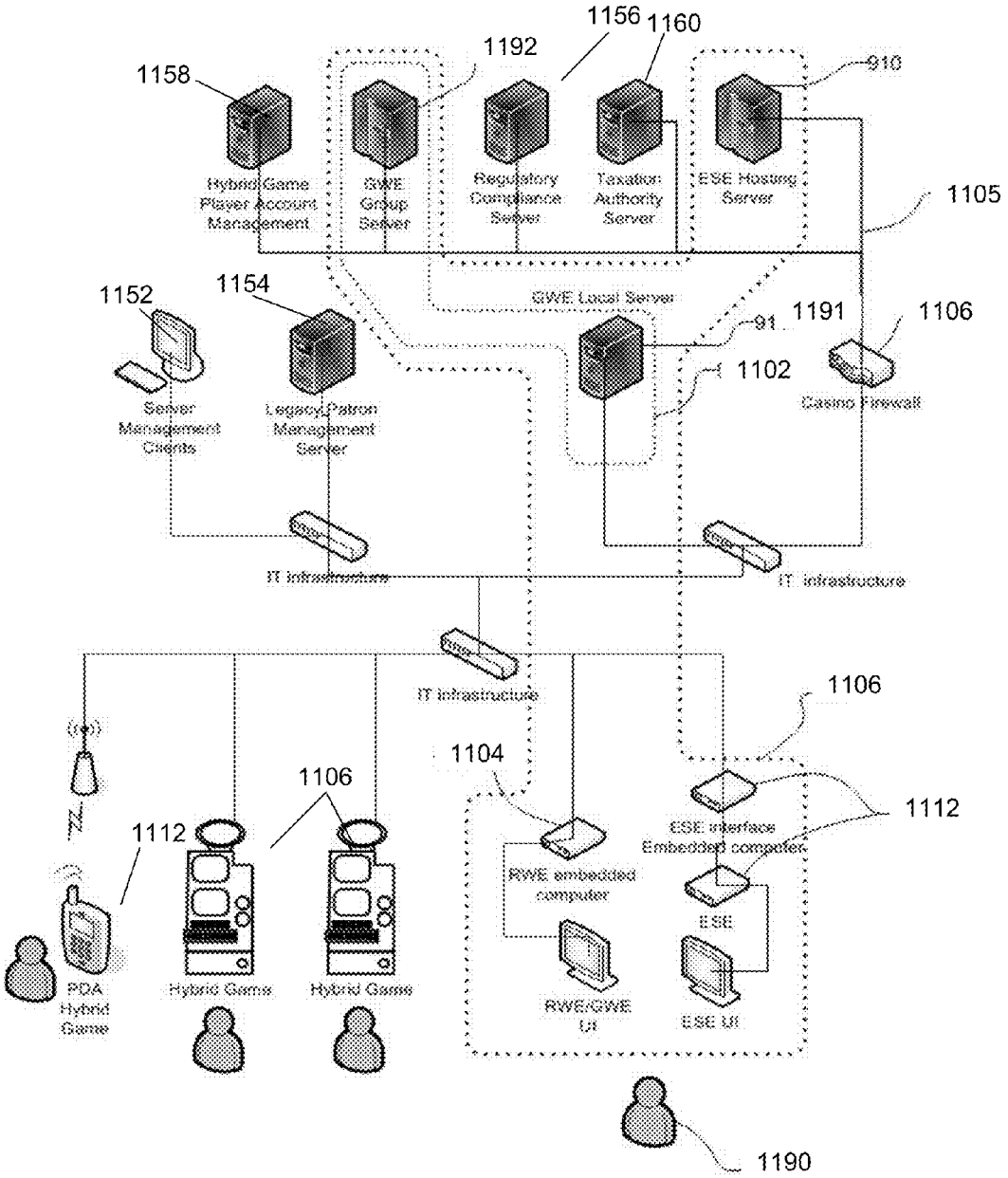
FIG. 11 illustrates a system diagram of an implementation of an Internet based hybrid game in accordance with an embodiment of the invention.

There are many possible permutations of the architecture of systems for providing a hybrid game in accordance with some embodiments of the invention. FIGS. 10-12 show only three possible permutations and are provided as examples which are not intended to suggest limitations to the forms of the architecture. Other permutations might include a version where the entire hybrid game is in the cloud with only a client running on player terminal within the bounds of the casino, or a permutation where the RWE and GWE are casino bound and the ESE exists in the cloud, accessed by a client running on a terminal in the casino.

Figure 13:
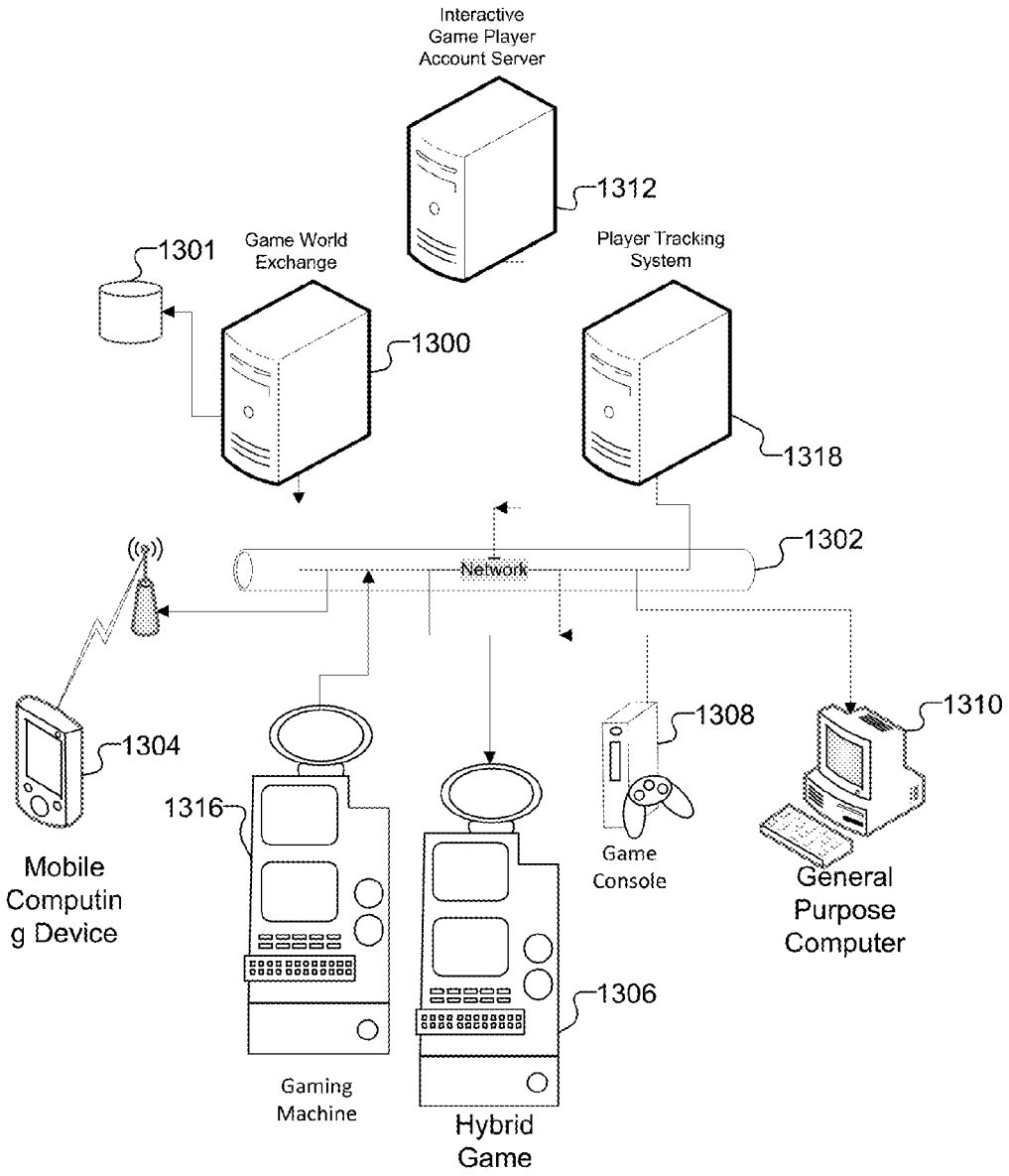
FIG. 13 is a diagram illustrating a game world exchange in accordance with some embodiments of the invention.

FIG. 13 is a diagram illustrating a game world exchange in accordance with some embodiments of the invention. A game world exchange device 1300 is operatively connected to one or more game devices via a network, such as network 1302. Exemplary game devices include a mobile computing device 1304 (such as personal digital assistant, smartphone or the like), hybrid game 1306, game console 1308 and a general purpose computer 1310 (such as a personal computer or the like). Each of the game devices host one or more interactive games that are played by a player to acquire GWCs and GWOs or the like. In addition, a game device hosting a hybrid game hosts a game of chance that is operatively connected to an interactive game. When a player plays the interactive game of the hybrid game, the player also plays the game of chance. Hybrid games are more fully described in PCT Application Nos. PCT/US11/26768 and PCT/US11/63587, the contents of each of which are hereby incorporated by reference as if fully stated herein.

In one embodiment, the game world exchange device operates on Game World Credits (GWCs), in which case the game world exchange device is termed herein a Game World Credit Exchange (GWCE). In other embodiments, the game world exchange device operates on Game World Objects (GWOs), in which case, the game world exchange device is termed herein a Game World Object Exchange (GWOE). In another embodiment, the game world exchange device operates using both GWCs and GWOs. A game world exchange device is generally termed herein a Game World Exchange (GW Ex).

In another embodiment, the game world exchange device 1300 is operatively connected to a database 1301 for the storage and retrieval of GWCs and GWOs as described herein.

The game world exchange device 1300 may be further operatively connected to one or more game player account servers, such as game player account server 1312. The game world exchange device 1300 obtains GWCs and GWOs from the game player account server 1312 that are associated with a player by the game player account server 1312.

The game world exchange device 1300 may be further operatively connected to a player tracking system 1318. The player tracking system stores player points associated with a player for use by a player when playing a game of chance associated with the player tracking system. The game world exchange device may exchange GWCs and GWOs with the player tracking system by converting GWCs and GWOs into player points and vice versa. When the player points are stored on the player tracking system, a conventional gaming machine, such as gaming machine 1316 may access the player points for use by a player playing the gaming machine.

In one embodiment, the network 1302 may be a Local Area Network (LAN) or may be a plurality of LANs operatively connected and operating under one or more domains. In another embodiment, the network 1302 may be a Wide Area Network (WAN) such as the Internet.

Figure 14:
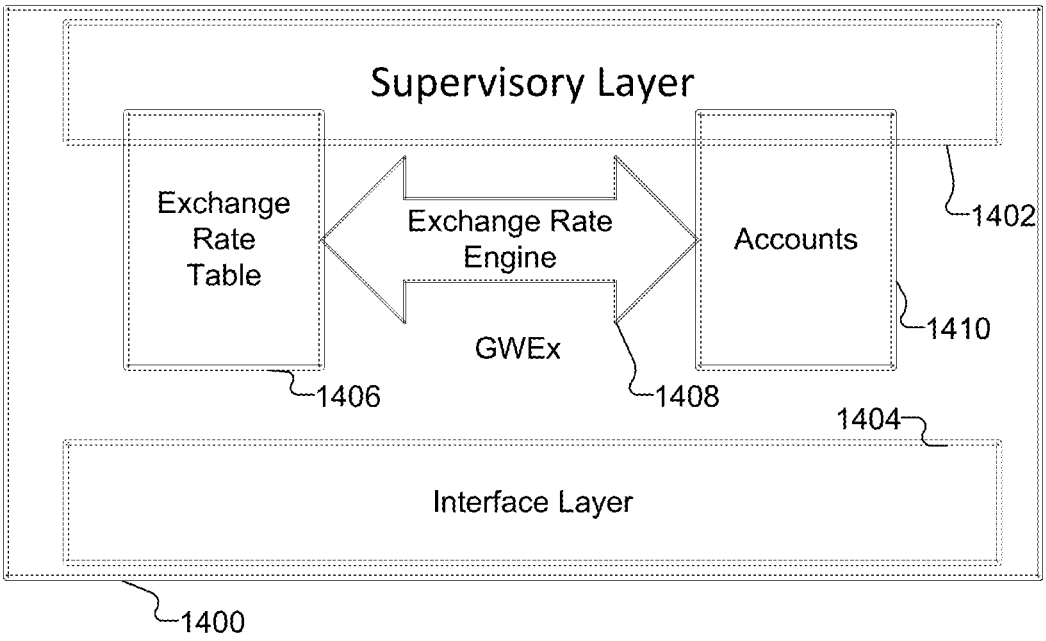
FIG. 14 is an architecture diagram of a game world exchange device in accordance with some embodiments of the invention.

FIG. 14 is an architecture diagram of various logical components of a GWEx in accordance with some embodiments of the invention. A GWEx 1400 includes the logical components of a supervisory layer 1402, an interface layer 1404, an exchange rate table 1406, an exchange rate engine 1408 and one or more player accounts 1410. Study of FIG. 14 in relation to the other figures and related descriptions in this disclosure will make apparent the various functions which reside within the GWEx, and their interrelation, so that the GWEx may operatively connect to other GWExs and game devices, and that enable the GWEx to accomplish exchange functions. Note that as termed herein the term "accounts" also refers collectively to "interchange accounts".

The accounts 1410 reflect player GWC and GWOs of various types, but also balances (positive or negative) of merchants, vendors, casinos, operators and other parties that provide redemption means for one or more types of GWC, UGWC, GWOs and UGWOs. Access to the accounts, and management of the accounts is controlled by the supervisory layer 1402, and under the supervisory layer's direction, the exchange rate engine 1408.

The exchange rate table includes the conversion ratios between various types of GWC, UGWC, GWOs and/or UGWOs as well as other forms of currency (e.g. U.S. Dollars, Japanese Yen, hamburgers at restaurant X, etc.)

In one embodiment, the various GWCs are stored in their native format, in which case an exemplary exchange table for a particular GWC of would take a form as follows in Table 1:

| | Game A | Game B | Game C | . . . |
|---|---|---|---|---|
| Game A | 1 | RateAB | RateAC | |
| Game B | RateBA | 1 | RateBC | |
| Game C | RateCA | RateCB | 1 | |
| . . . | | | | . . . |

For example, each conversion factor for converting a type of GWC used by an interactive game is stored in a manner such that, in order to obtain a conversion factor for converting GWC from Game A into GWC for Game B, the GWEx looks to find a row for Game A and then looks across the row for Game A to find the column for Game B and reads the rate for converting from GWC in Game A to GWC in Game B, namely RateAB.

In another embodiment, the GWCs are converted to UGWCs, in which case an exchange table would take the form of exemplary Table 2:

| | Rate | Rate |
|---|---|---|
| Game A | RateAU | RateUA |
| Game B | RateBU | RateUB |
| Game C | RateCU | RateUC |
| . . . | . . . | . . . |

To use such a table, for example, the GWEx looks up a row for a game, such as Game A, and reads across the row to find a rate for converting GWC of Game A into UGWC, namely Rate AU. Alternatively, to convert from UGWC to GWC of Game A, the GWEx looks along the row for Game A to the rate for exchanging UGWC into GWC of Game A, namely Rate UA.

In another embodiment, similar tables are used to convert GWOs of one game into GWOs of another game, as exemplified by Table 3:

| Game A:Object | |
|---|---|
| Game B | Object |
| Game C | Object |
| . . . | . . . |

For example, to convert an object in Game A to an object in Game B, the GWEx looks in the table for a row for Game B and reads the object stored in that row, thus returning the correct converted object for Game B.

In another embodiment, in order to use UGWOs, a similar table, such as exemplary Table 4 below, associating universal objects with objects in a particular game, is used:

| | Universal:Object1 | Universal:Object2 | . . . |
|---|---|---|---|
| Game A | ObjectA1 | ObjectA2 | . . . |
| Game B | ObjectB1 | ObjectB2 | . . . |
| Game C | ObjectC1 | ObjectC2 | . . . |
| . . . | . . . | . . . | . . . |

For example, to convert an object, Object A2, in Game A to a UGWO, the GWEx looks in the table for a row for Game A and then reads along that row until the GWEx finds the column containing Object A2. The GWEx then looks in that column for the Universal:Object2 that corresponds to Object A2.

The exchange rate engine 1408 ensures accounts remain in balance, includes checks and balances on exchanges (i.e. rate limitations, limits on amounts exchanged). The exchange rate engine also communicates with supervisory layer 1402 as to the state of exchanges.

The interface layer 1404 manages communication between GWExs and also between a GWEx and a specific game device. The interface layer also communicates with players through various hybrid game GWEs, game devices, web interfaces, or other means, to allow for account management, the implementation of exchanges, etc. The interface layer also facilitates communication with player tracking systems, such as player tracking system 1318 of FIG. 13.

The supervisory layer 1402 controls access to the accounts 1410, the exchange rate engine 1408 and the exchange rate tables 1406. Through the supervisory layer, a party with the appropriate level of authority can monitor and affect the operation of these subsystems. The supervisory layer also includes the mechanism for applying charges to the various accounts as a function of activity, balance or other user defined metrics.

Accordingly, within the GWEx 1400, for a given player, each form of GWC or GWO the player accumulates as a function of game play can be stored in the native GWC or GWO form (i.e. GWC1, GWC2, GWO1, GWO2 etc.) or translated into a Universal Game World Credit (UGWC) or Universal Game World Objects (UGWOs). The GWEx keeps track of the player's currency positions in an account and confers this information to relevant player tracking systems through the interface layer. The GWEx, as a matter of policy set by the operator, can force conversion of a player's varied GWC or GWOs into UGWC or UGWOs at a specific time or interval, or can store each type of GWC or GWO as an independent record indefinitely. This is one of many operator specific choices controlled through the supervisory layer 1402.

In addition to providing mechanisms to convert one type of GWC into another (namely the exchange rate engine), and to store records of the level of player GWC, the GWEx provides a forum for converting GWC and/or UGWC into other forms of currency (including real world money such as U.S. Dollars) and/or things of value (i.e. redemption); also as part of the Exchange Rate Engine. For example, a player might be able to convert 50,000 UGWC into a free trip to Las Vegas, or 25,000 UGWC into a home entertainment system, or 75,000 GWCMadden Football into entry into a Madden Football™ tournament in Atlantic City on a specific date in the future, said tournament offering cash prizes or other material incentives.

The GWEx can store additional, player-specific information in an Account along with the player's GWC records relating to the player's standing in one or more game types, or it can store solely GWC records and link these to other player information as stored in a player tracking system. There are also accounts within the GWEx to store information about GWEx balances for other participants in the system that are not players, such as operators and/or businesses who might be offering items or services for redemption.

The GWEx is capable of interacting with the a specific game's GWE, not only to receive the value of GWC earned by the player during game play on that machine, but to provide information to the player through the game-specific GWE, such that the GWE acts as a local terminal for the player, by which s/he can check GWC and UGWC balances, redeem GWC or UGWC for goods or services, exchange one type of GWC for another or convert it into UGWC or vice versa. This functionality is enabled by the Interface Layer of the local GWE and the Interface Layer of the GWEx in question.

The GWEx, and when more than one level of GWEx is in existence, the network of GWExs, act like a banking system. A local GWE can be, in effect, a full service bank terminal in the context of GWCs of various types, as well as a store front where GWC can be redeemed for worldly goods and services, as well as, in one embodiment, cash. The local GWE (and/or the relevant GWEx) can control a printer or other output device to confer redeemed goods or services upon the player in the form of a coupon, or a download (e.g. a piece of software, a coupon, a redemption code, etc.) to a local wireless device (e.g. a smartphone or iPad). The GWEx can also communicate this information to wireless or other devices (e.g. printer), software or email accounts independent of the local GWE, in keeping with pre-established player preferences or player preferences as selected at the time of redemption.

The GWEx may be managed by a casino operator, or a 3rd party. In the case where the GWEx at a higher level (e.g. level n) spans multiple operators it is likely to be managed by a consortium of those operators or by a 3rd party.

Connection of a GWEx to the hybrid game, either directly or indirectly, allows the possibility for the GWEx to function with the game world context of the hybrid game. For example, say a player has 1000 UGWC in the system. The player is also playing a hybrid game which is a wandering traveler adventure game. In the adventure game, there is a merchant shop in a village, and the player wishes to buy some provisions, so the player enters the shop. Once in the shop, the player checks his "purse". The purse in the game is a graphic representation of the player's account on the GWEx. The GWEx, through its interface to the hybrid game, provides information as to what is in the player's account. Let's say in this example, each hybrid game GWC is worth 2 UGWC on the system. A check of the purse by the player in the game shows that there are 500 gold coins in the purse (2:1 exchange rate), which is the game's method for demonstrating the GWC that the player has at their disposal to spend. The player takes 5 gold coins out for payment and gives them to the shop keep. The act of paying the merchant in the game triggers the GWEx to debit the player's accounts 10 UGWC (the 2:1 exchange rate). Let's say there is a transaction fee of 1 UGWC for this transaction. In the game, this could be represented as "tax for the king", effectively a sales tax. The act of paying the 5 coins would result in a total cost of 5 gold coins and a silver coin (½ the value of a gold coin in the game), so the game would show 6 gold coins removed, and a silver coin given back in change. This would be the same as the actual debit of 11 UGWC from the player account. Continuing the example, when the player decides to finish with the game, they could go to a bank in the village and deposit their money for safe keeping. The player would turn over the purse with say 655 gold coins in it (they had a good day), and play it on deposit with this virtual bank. There the money would remain until either the player returned to the same game, or wished to access their bank account in the one world from a portal in another world. Since the player's account actually resides in the GWEx system, whereas it would appear to the player that they were going to convert from gold coins in the one game world to rubies in the other, they would actually be accessing their account within the GWEx and making a withdrawal of UGWC.

In many embodiments, each type of skill-enabled gambling game has its own form of GWC. For example, the GWC for a game featuring a version of EA's Madden Football™ has a different GWC than a game featuring a version of Halo™. It is also possible for GWC to vary by game type and/or casino and/or operator, as opposed to being equivalent for a given game type across multiple game floors and/or operators. Consider also the case where a casino operator may elect to run specials where a more liberal awarding of GWC on a type of game to promote its adoption and popularity. The operator may wish to allow the portability of GWC on this gaming special to other games not involved in the promotion where GWC is more difficult to earn. The GWEx provides a mechanism to glue to together these disparate GWC classes into a cohesive approach. Given the disparity of the various GWC type and classes, a common currency is desirable. In accordance with many embodiments of the invention, it is the UGWC. The GWEx is used by the operator to establish a conversion factor between each type of GWC and UGWC. At Level 0, UGWC0 is the common currency used to affect this translation. For example, each unit of GWC in a game featuring Madden Football might be worth 1 UGWC0 at a particular casino, while each unit of GWC in a game featuring Halo (GWCHalo) might be worth two UGWC0. The effective exchange rate between GWCMadden Football and GWCHalo would be 2:1 therefore. Operators can set the exchange rates explicitly by populating a table within the GWEx that expresses each type of GWC in terms of UGWC, or in another implementation, the UGWC can support a market-based approach, whereby the value of each type of GWC relative to other types of GWC is set through a trading process, by which holders of various types of GWC (e.g. players, operators, merchants, etc.) trade GWC in a market with trading rules set by through the GWEx (trade limits, caps on exchange rates, etc.). Note that in this embodiment, it is possible that exchange rates may not balance across three or more types of GWC. Many embodiments of the invention support the case where all exchanges must be made in terms of UGWC to ensure balance, as well as allowing direct exchanges between various types of GWC where such balance is not assured.

GWC can also be accumulated by parties independent of playing a gambling game. For example, playing a skill-based game at home on an X-box will generate a specific game score that is by definition a form of GWC (FIG. 13). This specific form of GWC (e.g. GWCPlantsVsZombiesX-boxHome) can also be accumulated and ultimately exchanged for other forms of GWC or UGWC. GWC can also be accumulated independent of playing any type of gambling or video game whatsoever. The owner of a GWEx environment, acting in effect like a central banker, can sell GWC of any type to 3rd parties for distribution or subsequent resale. The resulting GWC can then be redeemed or traded at a later time through the GWEx.

Figure 15:
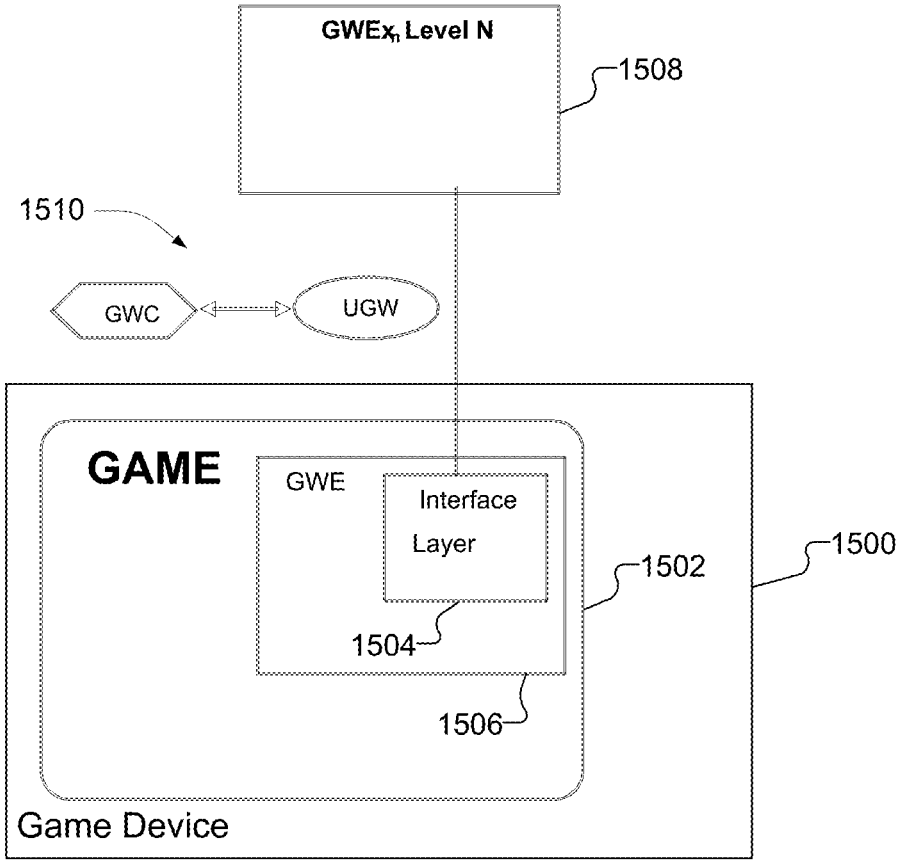
FIG. 15 is an architecture diagram of a game device in accordance with some embodiments of the invention.

FIG. 15 is an architecture diagram of a game device in accordance with some embodiments of the invention. A game device 1500 hosts an interactive game 1502. The interactive game includes an interface layer 1504 to operatively connects a game device to a GWEx 1508. Alternatively, if the game device is hosting a hybrid game, a Game World Engine (GWE) 1506 may include the interface layer 1504. In one embodiment, the GWEx and the game device exchange GWC or GWOs that are appropriate for the interactive game 1502 but the GWEx converts (1510) the GWC into UGWC for internal processing. In addition, the GWEx may also convert the GWOs into UGWOs as needed for internal processing. The game device interfaces with a GWEx via the interface layer thus enabling the game device to connect to one or more GWExs. The connection itself can take place directly or via any suitable network topology, including the Internet.

Figure 16:
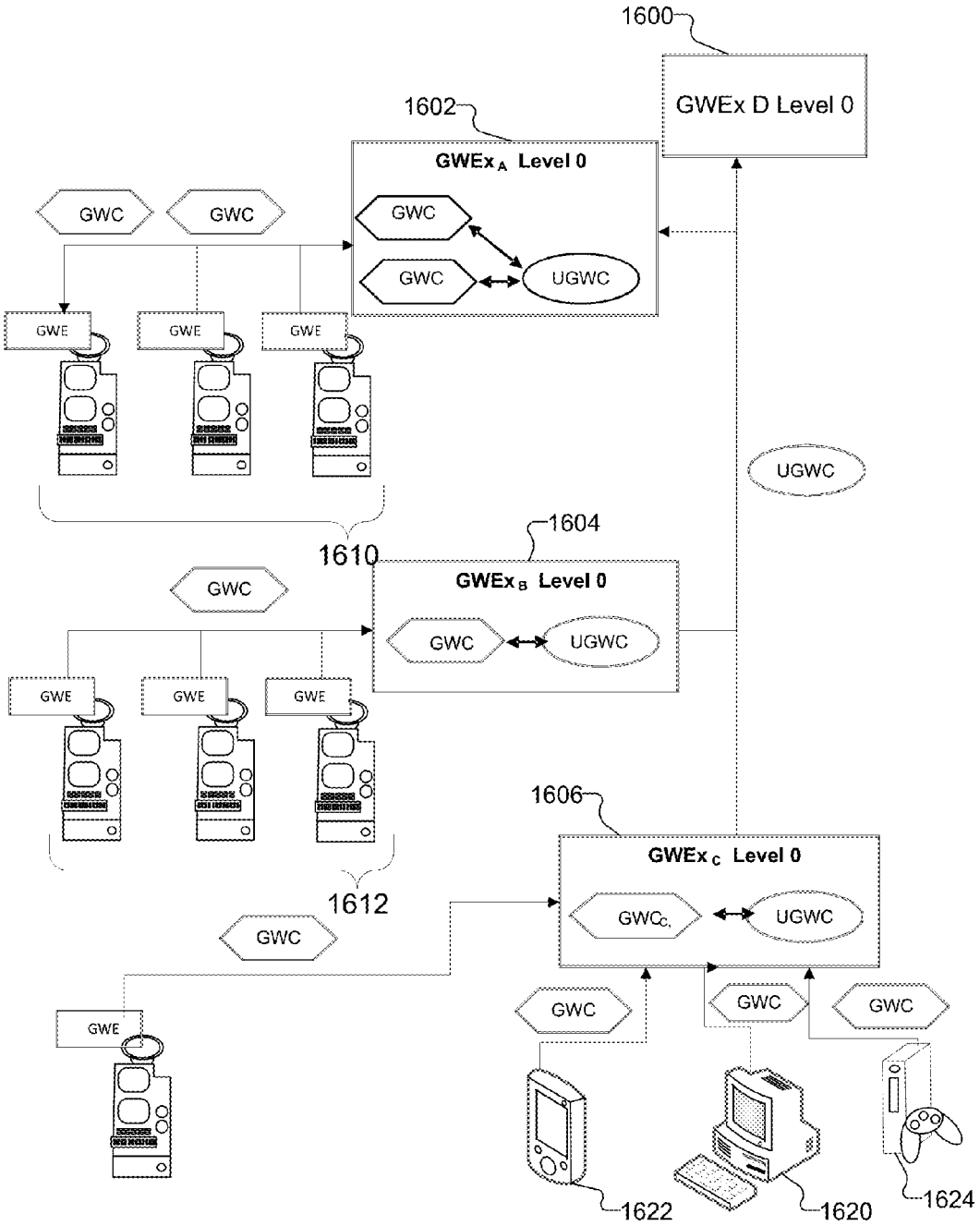
FIG. 16 is a diagram illustrating a network of game exchanges in accordance with some embodiments of the invention.
Figure 17:
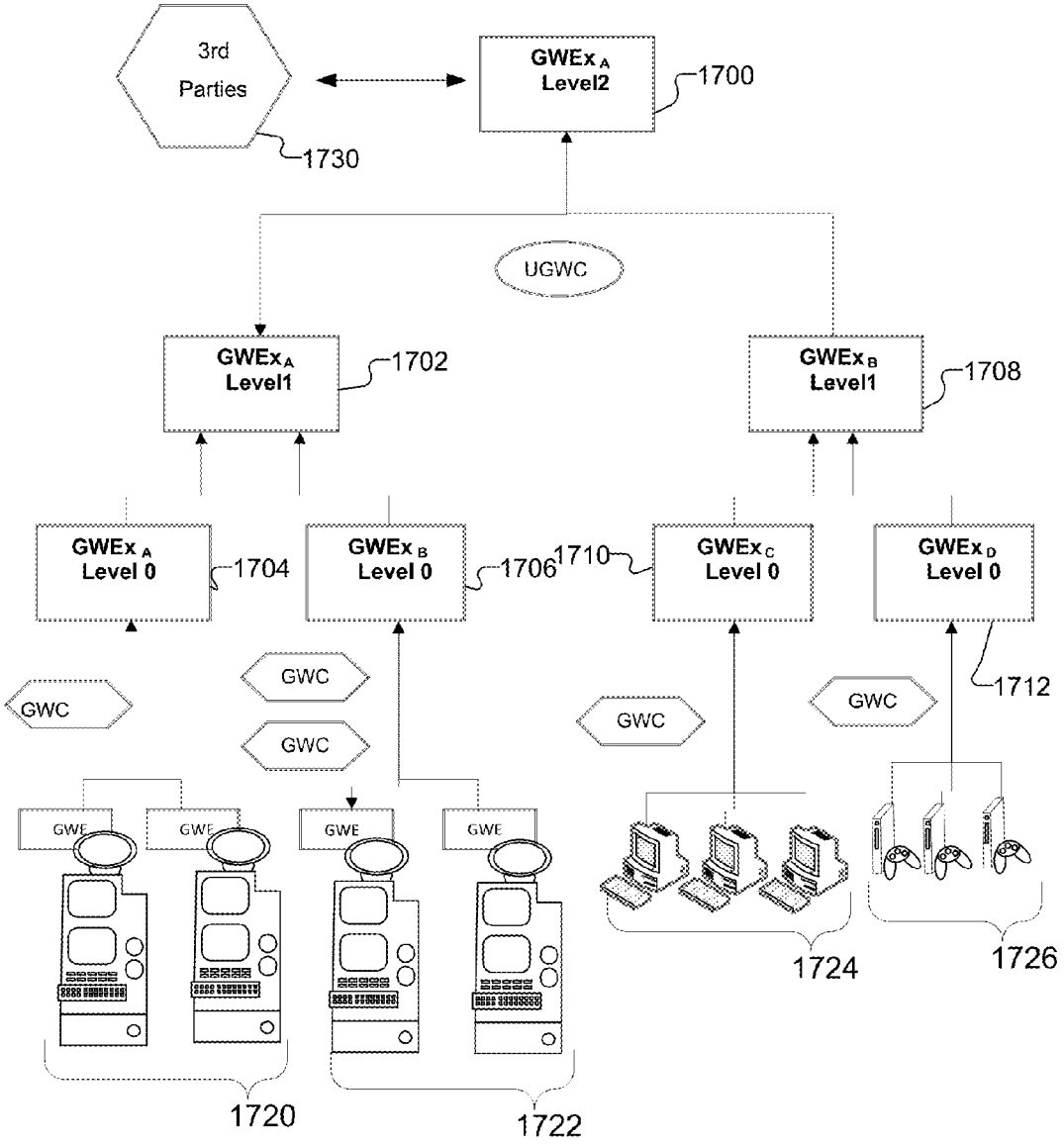
FIG. 17 is a diagram illustrating a hierarchy of networked game exchanges in accordance with some embodiments of the invention.
Figure 18:
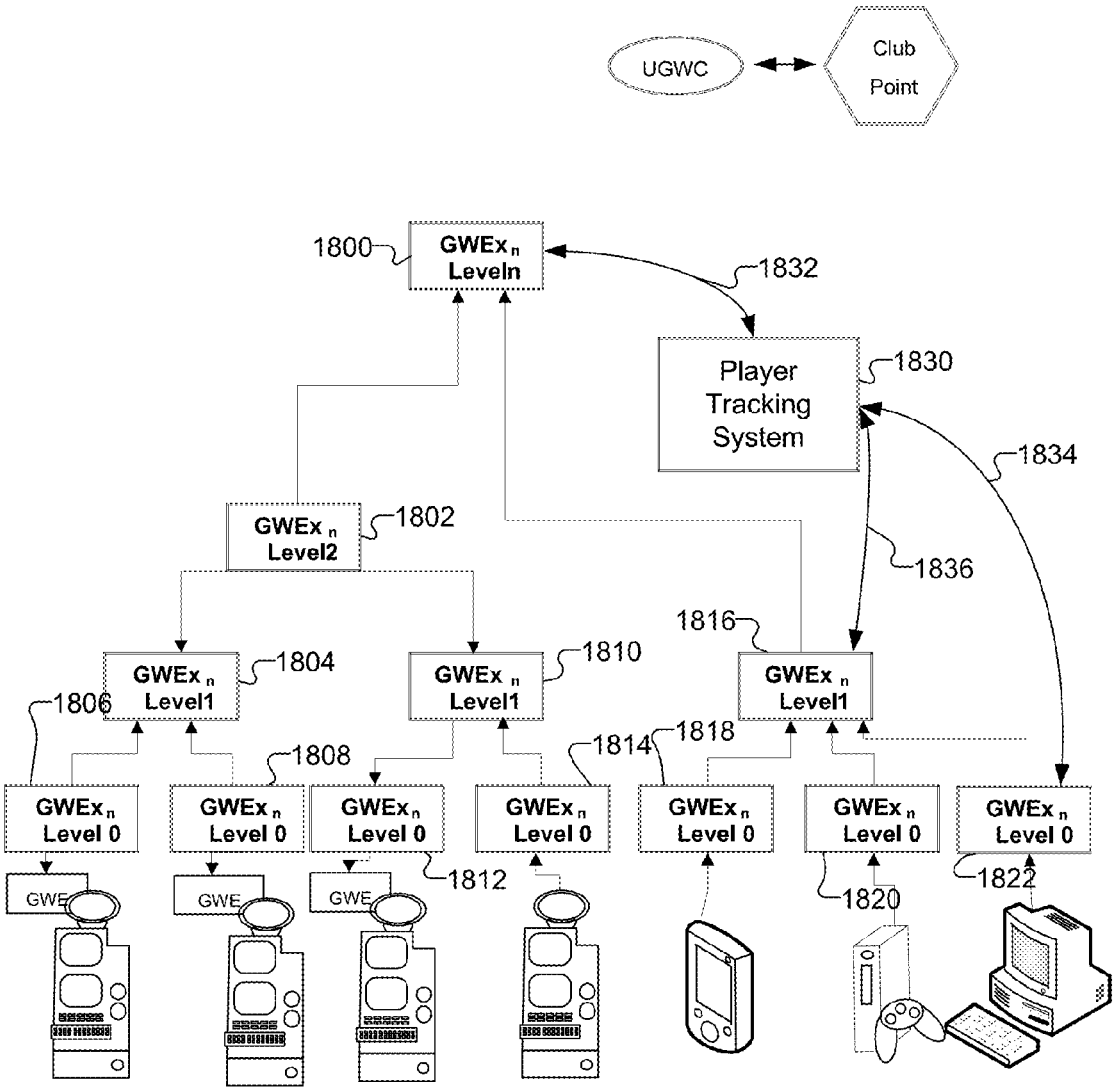
FIG. 18 is a diagram illustrating the use of a player tracking system in accordance with some embodiments of the invention.

FIG. 16 is a diagram illustrating a network of game exchanges in accordance with some embodiments of the invention. FIG. 17 is a diagram illustrating a hierarchy of networked game exchanges in accordance with some embodiments of the invention. FIG. 18 is a diagram illustrating the use of a player tracking system in accordance with some embodiments of the invention.

Speaking now of FIGS. 16, 17 and 18 collectively, processor-executable instructions implementing a GWEx runs on one or game exchange devices, such as servers 1600, 1602, 1604, 1606, 1700, 1702, 17016, 1706, 1708, 1710, 1712, 1800, 1802, 1804, 1806, 1808, 1810, 1812, 1814, 1816, 1818, 1820, 1822, that are connected to one or more game devices. The connection to these game devices can be through the Internet, a wide area network (WAN), local area network (LAN), direct connection via wireline or wireless or any other means by which computers are connected. A GWEx can exist at a local level, and also at increasingly higher levels of abstraction. For example, a GWEx could service all of the appropriate game devices at a single casino location (e.g. "Level 0"). Each of these GWEx's could then interface to another GWEx that operates as an umbrella over all casino locations within a single property group ("Level 1") or that spans several distinct playing areas within a single property. At an even higher level, a GWEx could bridge across multiple property groups ("Level 2") and so on through "Level N". Each instance of the GWEx could reside within a separate computer server, multiple computer servers, or all or some of the GWExs could exist within a single server or in the cloud. The entire logic of the GWEx can also be embodied within a broader player tracking system up to and including the span addressed by the player tracking system itself (e.g. a specific property group), beyond which an interface to the next higher level of GWEx would be required (e.g. across property groups).

Referring now to FIG. 16, there are two levels of GWExs. At the base level 0, two GWExs each connect to their own type of unique hybrid gambling game, namely hybrid games 1610 and 1612, respectively operatively connected to server 1602 and 1604, each such hybrid game containing a GWE, of which one of its functions is to couple to the GWEx. In FIG. 16, it can also be seen that a GWEx can interface with a heterogeneous mix of game types, machine types and/or game-location-type combinations. Note from the figure that there are various distinct types of devices depicted: a hybrid slot machine supporting GWC (such as the hybrid games of banks 1610 and 1612), a home PC 1620 used for playing a cloud based computer game, a mobile computing device 1622, and a Microsoft X-box™ console 1624 used in a home.

FIG. 16 also illustrates that each of the game groups has its own type of GWC, scaled as appropriate to its context. Note also, that some of the games have more than one type of GWC, such that the GWExs must be able to convert multiple types of GWC into a universal currency, UGWC.

It should be noted in FIG. 16, that the mobile computing device 1622, PC 1620 and the X-box™ 1624 home console may not contain a complete GWE as defined in this disclosure, but would still contain a mechanism used to communicate information about the player's GWC levels and game performance to the GWEx to which the game devices are connected.

FIG. 16 also illustrates an architecture whereby games of different types, different classes and in different locations have a method for interconnection to allow their disparate GWC and GWOs to be converted into UGWC and UGWO, respectively. In FIG. 16 for example, GWC from one type of game, via its connection to the GWEx network and levels stack, would be converted to UGWC, and back into GWC applicable to a different type of game. The method, therefore, allows for portability of GWC between these various game, classes and locations.

In FIG. 17, the architecture of FIG. 16 has been expanded to show an additional GWEx level, namely level 2. In this example implementation, the GWExs have the following purposes:

Level 0 GWExs: one set, 1704 and 1706, is connected to two different games groupings, 1720 and 1722 respectively, in two different casinos for instance. Another, 1710, is connected to a regional market of PCs 1724 for game execution, and a fourth, 1712, is connected to say a region set of home consoles 1726.

Level 1 GWExs: one, 1702, is used to connect together a group of casinos all belonging to a group casino operator, and another one, 1708, is used to join a set of region home console and PC players together.

Level 2 GWEx, 1700,1730 is managed by an entity who offers a subscription service allowing casino operators and home console users the ability to perform interchange with 3rd parties, 1730, who would like to offer goods and/or services and/or money for redemption by the use of UGWC based on the subscription terms which in turn results in redemption of GWC into one of the GWEx domains.

FIG. 18 shows an example of a system connected in the casino context whereby GWC can be freely interchanged between different games, casinos and even property groups. FIG. 18 also shows how a traditional player tracking system 1830 of one particular property can interface to the GWEx construct so that a player's club points could be interchanged (1832, 1834 and 1836) in some manner with UGWC and inevitably be available on a connected game as GWC in that game space.

Figure 19:
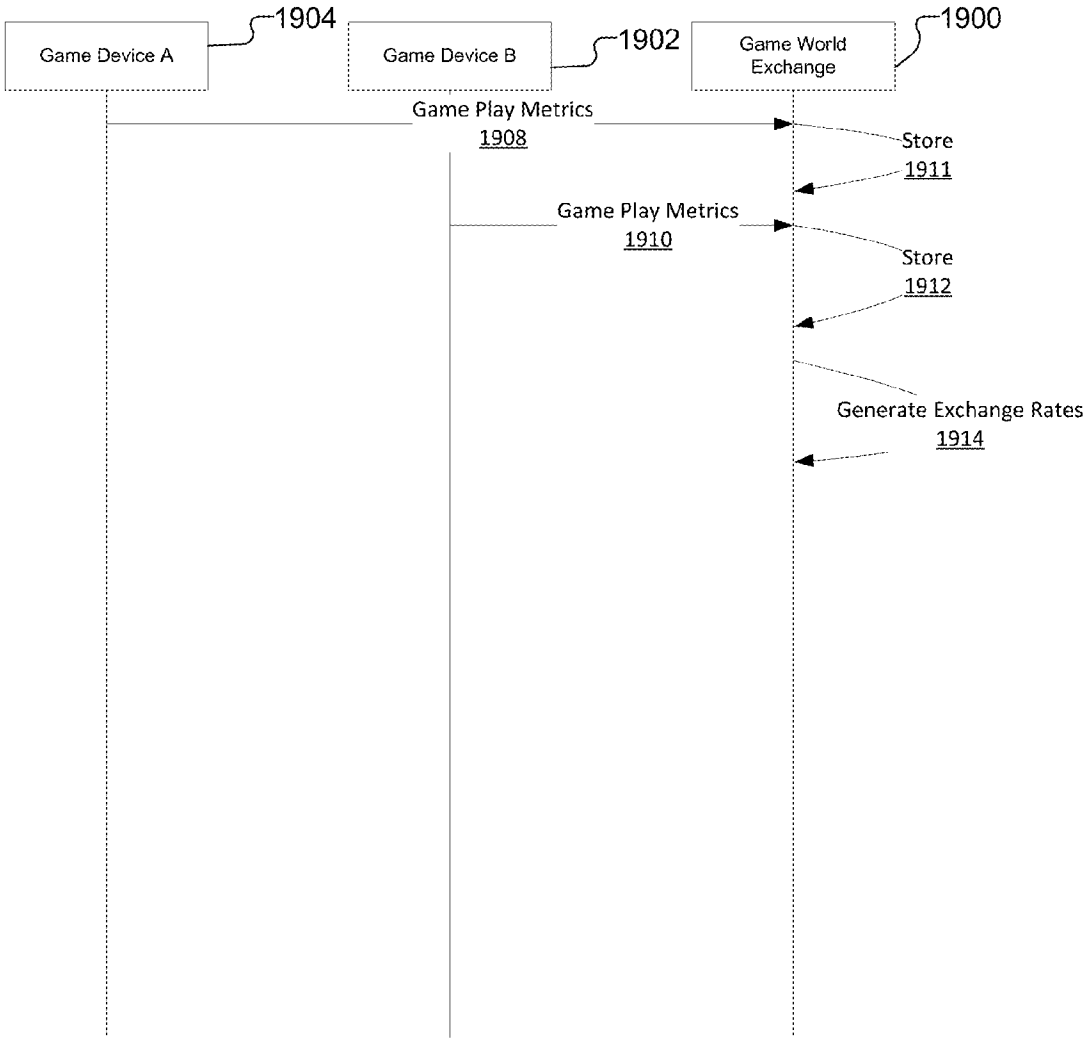
FIG. 19 is a sequence diagram illustrating interactions between game devices and a game exchange in accordance with some embodiments of the invention.

FIG. 19 is a sequence diagram illustrating interactions between game devices and a game exchange in accordance with some embodiments of the invention. In operation, a first hybrid game device A 1904 transmits game metrics 1908 to a game world exchange 1900 during a hybrid gaming session of a player. The game metrics include, but are not limited to, information about how the player is playing the hybrid game, including variables such as an amount and/or rate of RC committed by the player, GWC or GWOs earned by the player, experience points and the like. The GWEx 1900 receives the game metrics and stores (1911) the game metrics for later use. Another hybrid game device, such as game device B 1902, transmits game metrics 1910 to the game world exchange 1900 during a hybrid gaming session of a player. The game metrics include, but are not limited to, information about how the player is playing the hybrid game, including variables such as an amount and/or rate of RC committed by the player, GWC or GWOs earned by the player, experience points and the like. The GWEx 1900 receives the game metrics and stores (1912) the game metrics for later use. The GWEx then uses the stored game metrics from hybrid game device A and hybrid game device B to generate exchange rates as described herein for game world features, such a but not limited to, game world credits, game world objects, experience points and the like, for exchange of these features between players playing hybrid game devices A and B.

In some embodiments, the game metrics are collected from a plurality of hybrid game devices of different types of hybrid game so that exchange rates may be determined for exchanges made between the different types of hybrid games.

In some embodiments, the game metrics are collected for a plurality of players having a particular player profile so that exchanges can be made using exchange rates for players of the same profile.

In some embodiments, the game metrics are collected for a plurality of players playing hybrid games at a specified location or playing hybrid games operated by a specified operator.

Figure 20:
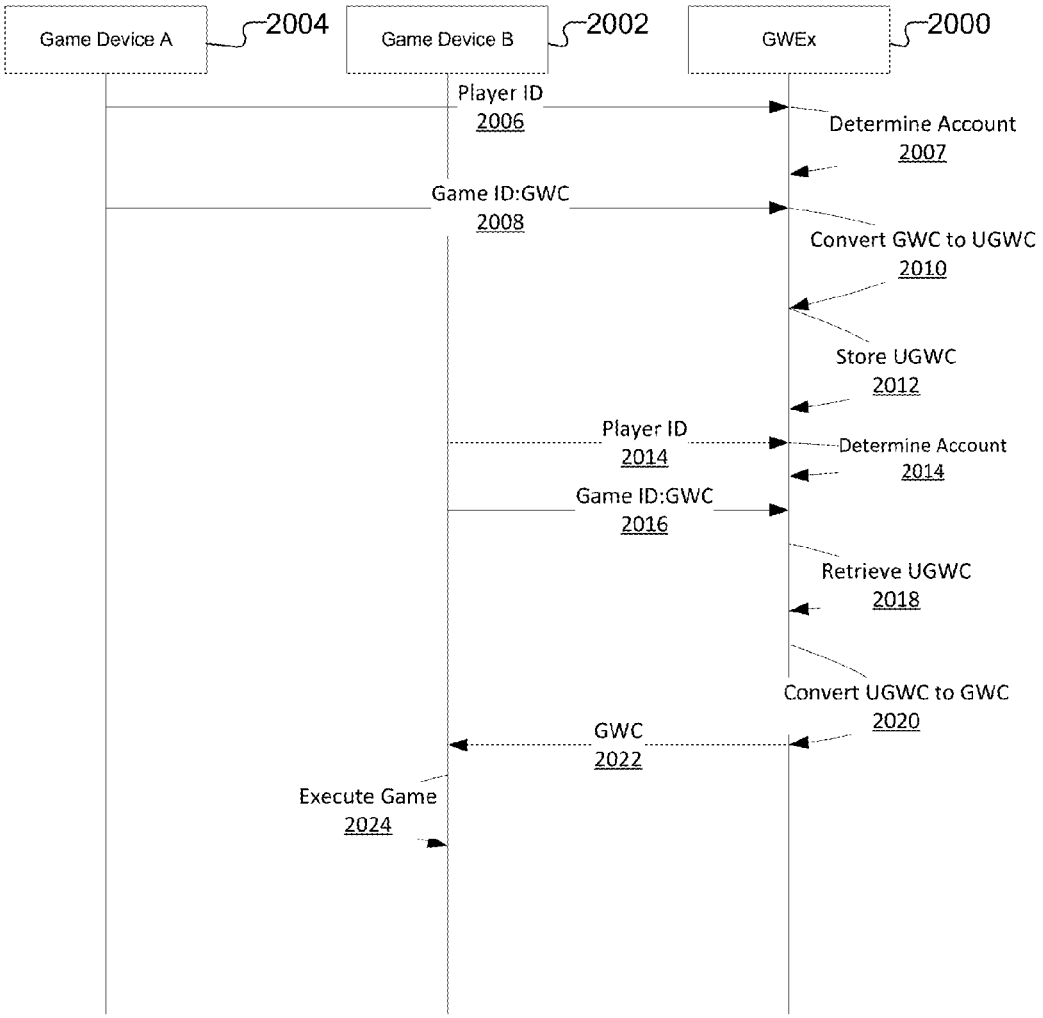
FIG. 20 is a sequence diagram illustrating interactions between game devices and a game exchange in accordance with some embodiments of the invention.

FIG. 20 is a sequence diagram illustrating the interactions between game devices and a game exchange in accordance with some embodiments of the invention. A game device A 2004 transmits a player ID 2006 to a GWEx 2000 indicating a player playing an interactive game hosted by the game device A. The GWEx receives the player ID and either creates or finds an account of GWC associated with the player ID. The game device A transmits to the GWEx a game ID and an amount of GWC 2008 to be converted into GWC for another game. The GWC are GWCs acquired by the player while playing the interactive game hosted by game device A. The GWEx receives the GWC transmitted by the game device A and converts (2010) the GWC into UGWC that the GWEx then stores (2012) the UGWC.

Subsequently, the player, using another game device B 2002, transmits the player's ID 2014 to the GWEx. The GWEx receives the player ID and determines an account of GWC associated with the player ID. The game device B transmits a request for GWC 2016 for another interactive game hosted by the game device B. The request includes an identifier for the another interactive game and optionally and identifier of the type of GWC that the game device is requesting. When the GWEx receives the request for the GWC from the game device B, the GWEx retrieves (2018) UGWC stored in the GWEx and associated with the player in a player account. The GWEx then converts (2020) the UGWC into GWC and transmits the GWC 2022 to the game device B. The game device B then uses the GWC when executing (2024) the another interactive game hosted by the game device B.

In one embodiment, the game device A and the game device B may be the same game device. That is, a player using the same game device may wish to play a first interactive game on the game device, store acquired GWC on the GWEx and then player another interactive game on the same game device using GWC retrieved from the GWEx.

In another embodiment, an interactive game hosted by either game device A or game device B is a component of a hybrid game having an interactive game and a game of chance as described herein.

In addition, it should be understood that either game device A or game device B can be any of the game devices described herein, such as a gaming machine, a mobile device, a general purpose computer, a game console, etc.

In another embodiment, instead of, or in addition to, exchanging GWC, the game device A, game device B, and the GWEx exchange GWOs.

In another embodiment, the GWEx may not use UGWCs or UGWOs. Instead, the GWEx may store GWC and GWOs in their native format and then convert the GWC and GWOs when retrieved as previously described herein.

Figure 21:
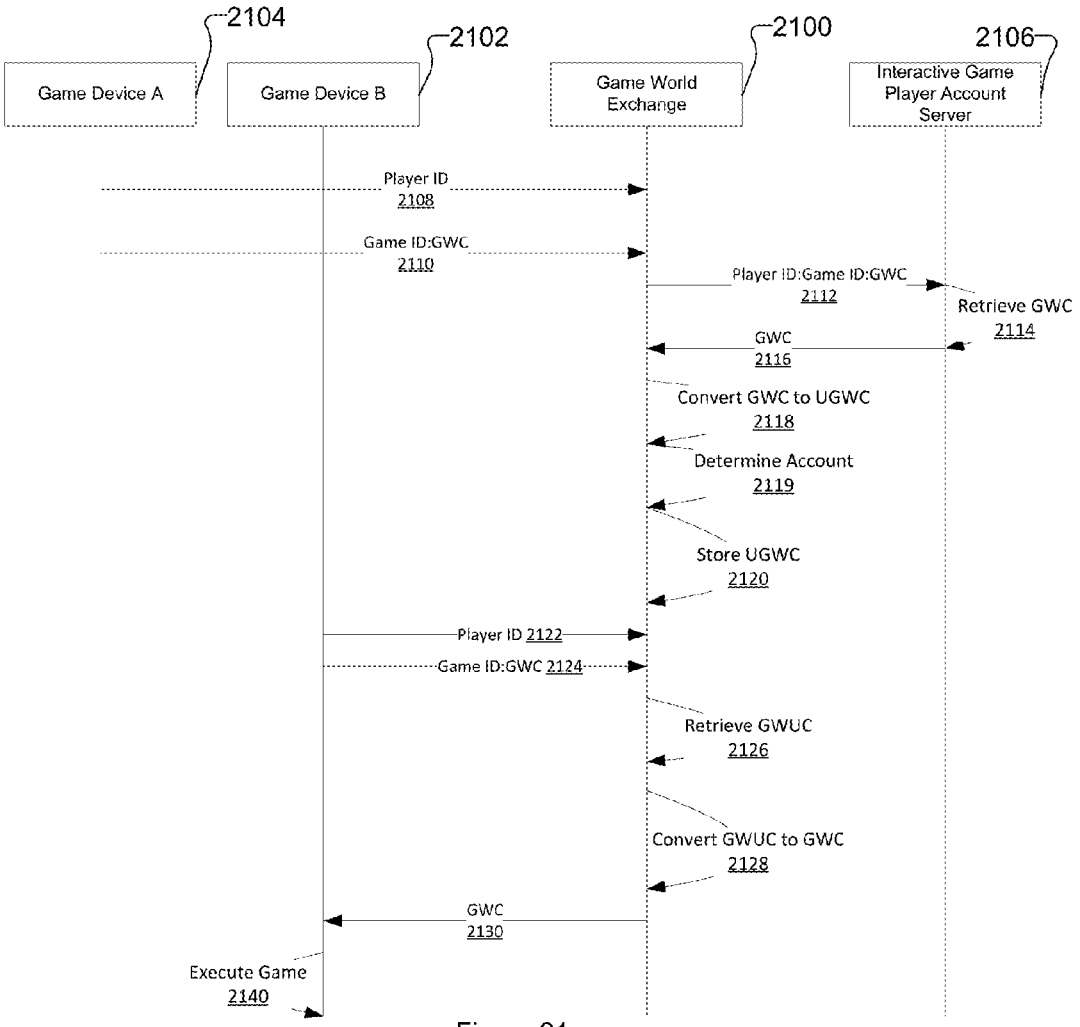
FIG. 21 is a sequence diagram illustrating a sequence of interactions between game devices and an interactive game player account server in accordance with some embodiments of the invention.

FIG. 21 is a sequence diagram illustrating a sequence of interactions between game devices and an interactive game player account server in accordance with some embodiments of the invention. A game device A 2104 transmits a player ID 2108 to a GWEx 2100 indicating a player playing an interactive game hosted by the game device A. The game device A also transmits a game ID and an amount of GWC 2110 to be converted into GWC for another game to the GWEx. The GWEx receives the player ID, the game ID and the GWC request and accesses 2112 an interactive game player account server 2106 storing GWC for the player playing the interactive game of game device A. The interactive game player account server retrieves (2114) the GWC 2116 and transmits the GWC to the GWEx. The GWEx receives the transmitted GWC 2116 from the interactive game player account server and converts (2118) the GWC into UGWC that the GWEx then stores (2120).

Subsequently, the player, using another game device B 2102, transmits the player's ID 2122 to the GWEx. The GWEx receives the player ID and determines an account of GWC associated with the player ID. The game device B transmits a request for GWC 2124 for another interactive game hosted by the game device B. The request includes an identifier for the another interactive game and optionally an identifier of the type of GWC that the game device is requesting. When the GWEx receives the request for the GWC from the game device B, the GWEx retrieves (2126) UGWC stored in the GWEx and associated with the player in a player account. The GWEx then converts (2128) the UGWC into GWC and transmits the GWC 2130 to the game device B. The game device B receives the GWC 2130 and then uses the GWC when executing (2140) the another interactive game hosted by the game device B.

In one embodiment, the game device A and the game device B may be the same game device. That is, a player using the same game device may wish to play a first interactive game on the game device, store acquired GWC on the GWEx and then player another interactive game on the same game device using GWC retrieved from the GWEx.

In another embodiment, an interactive game hosted by either game device A or game device B is a component of a hybrid game having an interactive game and a game of chance as described herein.

In addition, it should be understood that either game device A or game device B can be any of the game devices described herein, such as a gaming machine, a mobile device, a general purpose computer, a game console, etc.

In another embodiment, instead of, or in addition to, exchanging GWC, the game device A, game device B, and the GWEx exchange GWOs.

In another embodiment, the GWEx may not use UGWCs or UGWOs. Instead, the GWEx may store GWC and GWOs in their native format and then convert the GWC and GWOs when retrieved as previously described herein.

Figure 22:
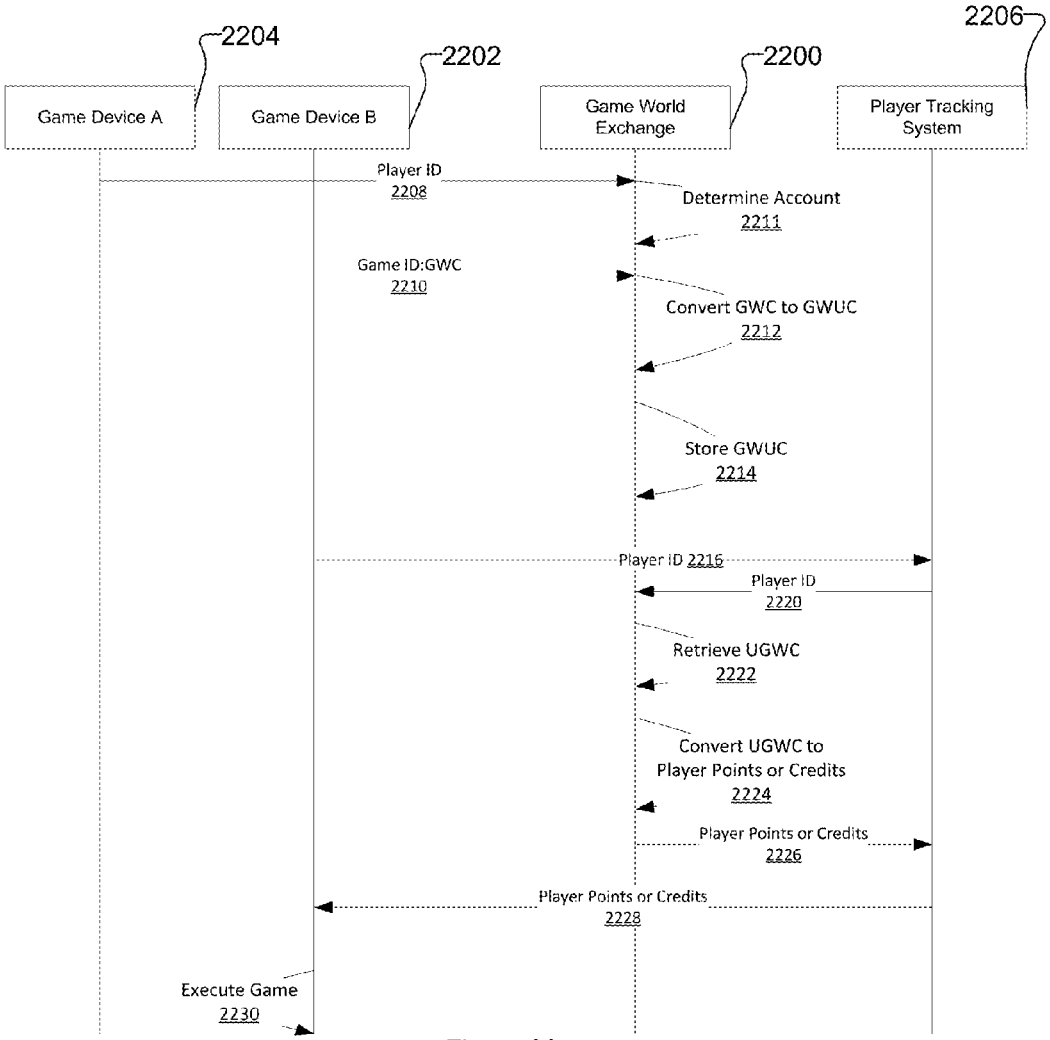
FIG. 22 is a sequence diagram illustrating a sequence of transactions between game devices, a game world exchange and a player tracking system in accordance with some embodiments of the invention.

FIG. 22 is a sequence diagram illustrating a sequence of transactions between game devices, a game world exchange and a player tracking system in accordance with some embodiments of the invention. A game device A 2204 transmits a player ID 2208 to a GWEx 2200 indicating a player playing an interactive game hosted by the game device A. The game device A also transmits a game ID and an amount of GWC 2210 to be converted into GWC for another game to the GWEx. The GWCs are GWCs acquired by the player while playing the interactive game hosted by game device A. The GWEx receives the GWC transmitted by the game device A and converts (2212) the GWC into UGWC that the GWEx then stores (2214).

Subsequently, the player, using another game device B 802 that is a gaming device, transmits the player's ID 2216 to a player tracking system 2206. The player tracking system 2206 receives the player ID and forwards the player ID to GWEx 2200. GWEx 2200 receives the player ID and determines an account of GWC associated with the player ID. The player tracking system transmits a request for player points for the gambling game hosted by the gaming device B. When the GWEx receives the request for the player points from the game player tracking system, the GWEx retrieves (2222) UGWC stored in the GWEx and associated with the player in a player account. The GWEx then converts (2224) the UGWC into player points and transmits the player points 2226 to the player tracking system. The player tracking system receives the player points 2226 and transmits them as player points 2228 to the game device B. The game device B then uses the player points when executing (2230) the gambling game hosted by the game device B.

In another embodiment, an interactive game hosted by device A or the gambling game hosted by device B may be components of hybrid games having interactive games and games of chance as described herein.

In addition, it should be understood that either game device A or game device B can be any of the game devices described herein, such as a gaming machine, a mobile device, a general purpose computer, a game console, etc.

In another embodiment, instead of, or in addition to, exchanging GWCs for player credits or points, the game device A, game device B, and the GWEx exchange GWOs for player credits or points.

In another embodiment, the GWEx may not use UGWCs or UGWOs. Instead, the GWEx may store GWC and GWOs in their native format and then convert the GWC and GWOs when retrieved as previously described herein.

The concept of trading currencies (e.g. dollars, yen, francs, euros, etc.) one to the other is well understood. The exchange rate between various currencies is set by market forces, and ostensibly includes a representation of the underlying dynamics of the constituent economies, a sense of the future performance of said economies, etc., etc. The exchange rate in any given trade is set by the two parties involved, or in the case of an individual exchanging currency with a bank, by one party and accepted by the second.

While GWExes can certainly operate in this mode, whereby parties (casino-player, player-player, casino-casino, merchant-player, merchant-casino, etc.) set the exchange rate on a trade-by-trade basis as a function of a bid-ask process, the GWCE concept also embodies the idea of a structural mechanism for setting pricing between each type of element that can be traded therein (e.g. GWC types, virtual goods, virtual currency, RC, in-game objects, etc.) using game play metrics. Note too that these trades may ostensibly be for the same item (e.g. $GWC_{Call\ of\ Duty}$) but across multiple domains (e.g. an on-line provider of hybrid game play on the one hand and Caesar's Las Vegas gaming floor on the other).

Consider a game for the purposes of this discussion, namely Call of Duty. During game play the player accumulates $GWC_1$. A game play metric such as the rate at which $GWC_1$ is accumulated can be advanced by the weapons used, the player's skill (in an absolute sense and/or relative to other players), and indirectly as a result of gambling wins associated with hybrid game play, etc. Conversely, the rate at which GWC is accumulated can be retarded rather than advanced by such factors. In other games a game play metric such as the amount of GWC, not just the rate at which it is accumulated, can be increased or reduced by a variety of hybrid game-play related variables. For example, a hybrid game of monopoly may increase the rate at which GWC is awarded when a player obtains all of the railroads within x moves, when a player passes "Go" y number of times, or other factors that may not directly influence GWC accumulation.

Consider a second game, Scrabble. As with Call of Duty, players accumulate (or in some cases lose) $GWC_2$ over the course of the game. In both contexts, the amount of GWC accumulated, and the rate at which it is accumulated, can affect a player's skill rating, ranking, eligibility for tournament play, access to prizes, bonus rounds and/or rewards, etc.

The system within this disclosure allows the exchange $GWC_1$ for $GWC_2$ without the use of a floating exchange rate. As described subsequently, a non-floating exchange rate is valuable because (i) it allows, and encourages, players to cross-over from one hybrid game to another and (ii) it allows casinos/operators to manage the transfer of GWC from one domain to another in a controlled manner so as to ensure fairness to the player while managing profitability for the casino at the same.

To exchange $GWC_1$ and $GWC_2$ a common element must be introduced to normalize value across the two game platforms. Each game has its own unique scoring system related to underlying game play, and in this example, the similarities between playing Call of Duty and Scrabble are de minimis.

For each game therefore the system can establish the quantity $$NGWC1 = \frac{GWC1}{DEN}$$

$$NGWC2 = \frac{GWC2}{DEN}$$

Where DEN is a common denominator shared across both hybrid games. DEN can be any one of the following or a combination of the following game play metrics, including one or more formulae utilizing one or more of these variables, {game time elapsed, real time elapsed during game play, elapsed real time, skill level, machine settings, RC spent, RC committed, RC won, RC lost, casino revenue, casino profit}, etc. Ultimately, DEN is itself related to a specific period of elapsed real time in affecting an exchange between varying GWCs.

Referring back to Call of Duty, generally speaking, and over a long enough sample period, a very good player will have a higher level of GWC1/DEN than a player of lesser skill. Likewise, a more capable Scrabble player will have a higher level of GWC2/DEN than a less able player.

To make the example more concrete, consider the case where

DEN=Hours of Game Play

A skilled Call of Duty Player (A) might earn 10,000 points in one hour of play, giving him $NGWC1_A$=10,000

While a player of less ability might (B) typically need five hours to accumulate 10,000 points $NGWC1_B$=2,000

In the case of Scrabble, a highly skilled player (C) may earn 350 points (i.e. GWC) in an hour of play $NGWC2_C$=350 while the less skilled player (D) may only obtain 75 points over the same period of time.

$NGWC2_D$=75

Unfortunately, at this point, the system has created a measure of the rate at which each player accumulates GWC in the context of a specific hybrid game. However, this measure alone (i.e. specific individual performance) is not able to affect a consistent or logical transaction between a Call of Duty and Scrabble player. To highlight the point, if player C were to trade with player A on the ratio $$\frac{NGWC1_A}{NGWC2_c}$$

she would receive ≈28.6 GWC1 for each GWC2 she had earned. If, however, she were to trade with player A on the ratio $$\frac{NGWC1_B}{NGWC2_c}$$

she would receive ≈5.7 GWC1 for each GWC2 she traded. The problem therefore is that if player C (a high skill Scrabble player) were to trade with a low skill Call of Duty player (B) she is disadvantage relative to trading with a high skill Call of Duty player. Clearly, some manner of further normalization is required.

In short, the systems need to produce an absolute value for a given hybrid game within a given domain that can be compared directly against an equivalently calculated value for a second hybrid game in the same or a different domain.

Figure 23A:
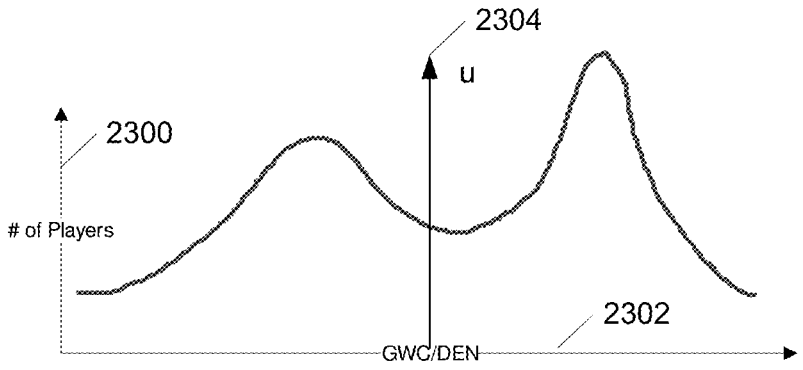
FIGS. 23A and 23B are illustrations of game metric information in accordance with some embodiments of the invention.
Figure 23B:
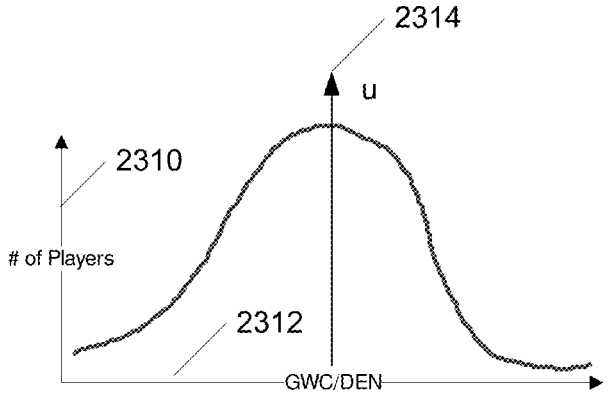

To do this, the system first recognize that relative to a given DEN (e.g. hours of game play), players will have a distribution of scores, which may or may not be normal, as seen in FIGS. 23A and 23B.

In FIGS. 23A and 23B, the two graphs illustrate the distribution of players 2300 and 2310 respectively, across the GWC/DEN spectrum, 2302 and 2312 respectively, and the mean ($_{\mu}$), 2304 and 2314 respectively, for GWC/DEN in each case.

In one embodiment of the system, one can establish the quantity $$EP_X^y = \text{Exchange Parameter} = \frac{\sum_{m=1}^{Q}\sum_{p=1}^{n}\sum_{t=y}^{z} GWC}{n}$$

Where EP is the exchange parameter for hybrid game of type X in domain Y, where t is the time period of interest, with range {y,z}, and where p is the player with range {1, n} where n is the number of players that have played the hybrid game in question, and where m is the number of machines of game type X in domain Y with range {1, Q}.

This embodiment of the invention establishes an exchange parameter that represents, in effect, the mean value for GWC/DEN as achieved by the players that participate on hybrid game of type X in domain Y.

The aforementioned implementation of EP does not weight the data on a per player basis as a function of the amount of DEN over which each player accumulated GWC. In this regard, it is a fairly simplistic, and in some ways less accurate, way of establishing the exchange parameter for a given hybrid game. In another embodiment of the invention, one can calculate as follows, $$EP_X^Y = \text{Exchange Parameter} = \frac{\sum_{m=1}^{Q}\sum_{p=1}^{n}\sum_{t=y}^{z} GWC}{\sum_{m=1}^{Q}\sum_{p=1}^{n}\sum_{t=y}^{z} DEN}$$

Where $EP_X$ is the exchange parameter for GWC for hybrid game of type X in domain Y, where t is the time period of interest, with range {y,z}, where p is the player with range {1, n} where n is the number of players that have played the hybrid game in question, and where m is the number of machines of game type X in domain Y with range {1, Q}. Note that the summation across machine units {1,Q} may not be used in the case where all player information (anonymous or known players) is stored centrally and/or abstracted from individual machines. Additionally, the parameters of m may be limited in a variety of ways, including by location, player skill level, length of gameplay, etc.

Consider the below example data for a particular hybrid game, "Maze" at Harrah's Vegas, consisting of four game units within the domain, and for which DEN is "hours spent playing the game". In this example, player data is not captured in a player club, and all players are anonymous. There are a total of sixteen players over four machines.

| Machine | Player | GWC | DEN |
|---|---|---|---|
| 1 | 1 | 10000 | 2.0 |
| 1 | 2 | 4000 | 1.6 |
| 1 | 3 | 7800 | 4.0 |
| 1 | 4 | 14000 | 3.0 |
| 1 | 5 | 6500 | 5.0 |
| 2 | 1 | 19745 | 6.0 |
| 2 | 2 | 34000 | 9.0 |
| 2 | 3 | 17200 | 7.0 |
| 2 | 4 | 324 | 0.2 |
| 2 | 5 | 750 | 0.2 |
| 2 | 6 | 8880 | 3.0 |
| 3 | 1 | 38234 | 7.0 |
| 3 | 2 | 2500 | 1.0 |
| 3 | 3 | 2451 | 2.0 |
| 4 | 1 | 6100 | 9.0 |
| 4 | 2 | 18000 | 7.0 |
| | sum: | 190484 | 67 |

In this example:

y=0 z=1 week n={5,6,3,2} for each of the four machines.

Q=4

Calculating, the system determines that $$EP_{Maze}^{Harrahs\,LV} = \frac{190{,}484}{67} \approx 2843$$

A similar exercise can be undertaken with a different hybrid game, "Go!", also, for the purposes of this example situated at Harrah's Vegas. Here, as with the EP for GWC for Maze at Harrah's Vegas, DEN is also "hours spent playing the game". Without presenting the math, for the purposes of this example:

$EP_{Go!}^{Harrahs\,LV}=159$

Once the value for EP is established relative to a particular domain for the item of interest (in this example, GWC), an exchange rate can be established in the context of the particular DEN.

So, in this case, the exchange rate is as follows.

$$\frac{f(GWC_{Maze}^{Harrahs\,LV})}{f(GWC_{Go!}^{Harrahs\,LV})} = \frac{EP_{Maze}^{HarrahsLV}}{EP_{Go!}^{HarrahsLV}} = \frac{2843}{159} = 17.9$$

$$\frac{f(GWC_{Maze}^{Harrahs\,LV})}{f(GWC_{Go!}^{Harrahs\,LV})} = 17.9 = \text{exchange rate}$$

So, for every GWC a player has in her account from playing Go! At the Harrah's in Las Vegas, she can, so long as the above holds true (which may be for a deterministic or indeterminate period of time) exchange it for 17.9 GWC relative to the Maze game at Harrah's LV.

It is important to note a few things about EP and the resulting exchange rates it creates.

The values for EP, and by extension the exchange rates, can be periodically updated by casinos. They can consider time from a fixed reference (t=0) or they can look back continuously or periodically over a prescribed amount of time.

Each EP is specific not only to a type of hybrid game and a domain, but also to a specific numerator type (i.e. GWC or virtual currency or in-game object).

Different EPs for a given form of GWC (or other exchangeable entity) can be established for various types of DEN.

To be more specific, EP can be further specified as follows ${}_G^F EP_X^Y$

Where F is the variable being considered for exchange (i.e. GWC, in-game object, virtual currency, prizes, goods, services, currency), G is the DEN across which the exchange rate is to be established, Y is the domain in which the F resides, and X is the hybrid game type relevant to F in this context.

Note that to establish an exchange rate between two different "F", the value of "G" for each EP must be the same.

In addition to establishing the aforementioned mechanism to facilitate the exchange of one element (e.g. GWC) for another, embodiments of the invention subsumes the idea of a global medium for facilitating exchanges and/or redemptions, UGWC. To facilitate the use of UGWC for this purpose, we need to establish UEP for the UGWC in question. Because UGWC is meant to apply across all games and all game types in a domain (i.e. a floor or a property group, or a consortium of property groups, or an on-line gaming community, etc.) one can represent UEP as follows.

$$UEP^Y = \text{Exchange Parameter} = \frac{\sum_{s=1}^{L}\sum_{m=1}^{Q}\sum_{p=1}^{n}\sum_{t=y}^{z} GWC}{\sum_{s=1}^{L}\sum_{m=1}^{Q}\sum_{p=1}^{n}\sum_{t=y}^{z} DEN}$$

Where $EP^Y$ is the universal exchange parameter for domain Y. The additional summation here over the range s=1 to s=L represents the L different types of hybrid games within the domain Y. So, whereas EP relates to a single hybrid game type, UEP is summed across all hybrid game types (and all game play by all players across all the individual games within those types) within the domain Y. Again, as with EP, DEN must be the same across all of the L different hybrid games under consideration in the calculation of UEP.

Continuing our example from above, in a given domain (e.g. Harrah's LV), UEP might be calculated to be $UEP^{Harrahs\ LV}=450$ Recalling that $EP_{Maze}^{Harrahs\ LV}=2843$ and $EP_{Go!}^{Harrahs\ LV}=159$ the system can now represent the conversion of the GWC for Go! And that for Maze into UGWC in the Harrahs LV domain as follows.

$$\frac{f(UGWC^{HarrahsLV})}{f(GWC_{Go!}^{HarrahsLV})} = 2.83 = \text{exchange rate}$$

$$\frac{f(UGWC^{HarrahsLV})}{f(GWC_{Maze}^{HarrahsLV})} = 0.16 = \text{exchange rate}$$

Again, in these examples the system has used GWC, but the above applies to any and all in-game objects, virtual currencies, currencies, redemptions, prizes, offers, etc., which in each case can take the place of GWC in the above constructs.

In the same way that EP and exchange rates are constructed between different GWCs (or virtual goods, virtual currencies, in-game objects, etc.) the same mechanism can be applied between UGWCs, so that exchanges can be made across domains. As in all prior cases, the requirement for an equivalent DEN holds.

In the same way that EP and exchange rates are constructed between different GWCs (or virtual goods, virtual currencies, in-game objects, etc.) the same mechanism can be applied between UGWCs, so that exchanges can be made across domains. As in all prior cases, the requirement for an equivalent DEN holds.

This system also covers the mechanisms by which exchange rates are established in the case where DEN is not the same across two elements for which it is desired to establish an exchange rate and affect exchanges. For example, in one hybrid game, the casino operator may establish DEN as "hours of game play", whereas in another hybrid game, the same casino operator may establish DEN as "RC bet by the player". In another example, one casino operator uses "RC bet by the player" across all their hybrid games for the purposes of affecting exchanges, while a different casino operator uses "RC earned by the casino".

To address the situation where an exchange is desired but different DEN are used, the EP or UEP previously discussed must be normalized across a common DEN, which can be one of the two DEN related to the EP and/or UEP in question, or a third DEN. This common DEN is defined as a "Super Denominator" or SDEN, and must represent a quantity that is equivalently measured and available (from a data perspective) in each domain that the EP and/or UEP is in play. Put another way, the SDEN must be relevant—and calculable—in the context of the domain in which each item to be traded (e.g. GWC, virtual currency, virtual goods, in-game objects, etc.) is used.

For example, consider the case where $EP_{Maze}^{Harrahs\ LV}$ and $EP_{Pac\text{-}Man}^{MGM\ LV}$ can be calculated as relates to the underlying GWC for the game Maze as played at Harrah's Las Vegas and Pac Man as played at MGM Grand in Las Vegas, respectively. Consider also that in the case of the Harrahs LV domain, DEN is the amount of RC lost over the time frame in question (t=y→t=z), while in the case of the MGM LV domain, DEN is defined as hours of game play. We need to standardize across these two DEN. In this example, we decide to also define SDEN as hours of game play, though it could have been defined as RC lost over the time frame of interest, money gambled over the time frame of interest, or another defined quantity that could be established in both contexts (i.e. Maze in Harrah's LV and Pac-Man in MGM LV).

Continuing on with the example, over the period of interest we determine that $DEN^{Harrahs\ LV}=500$ $DEN^{MGM\ LV}=1000$ And because in this case, SDEN is equivalent to $DEN^{MGM\ LV}$ we determine

SDEN=1000 and that $DEN^{Harrahs\ LV}/SDEN=0.5$ and further that $DEN^{MGM\ LV}/SDEN=1$

From this we can take the step of replacing $EP_{Maze}^{Harrahs\ LV}$ and $EP_{Pac\text{-}Man}^{MGM\ LV}$ everywhere in the aforementioned formulae as follows.

$$EP_{Maze}^{Harrahs\ LV}=EP_{Maze}^{Harrahs\ LV}\times((DEN^{Harrahs\ LV}/SDEN)$$

$$EP_{Maze}^{Harrahs\ LV}=EP_{Maze}^{Harrahs\ LV}\times(0.5)$$

$$EP_{Pac\text{-}Man}^{MGM\ LV}=EP_{Pac\text{-}Man}^{MGM\ LV}\times(DEN^{MGM\ LV}/SDEN)$$

$$EP_{Pac\text{-}Man}^{MGM\ LV}=EP_{Pac\text{-}Man}^{MGM\ LV}\times(1)$$

This can be done as described here, whereby EP (or UEP) are modified at a macro-level post having been calculated using the summations across relevant players, time, domains, machines, etc. Or, alternately, one can replace DEN everywhere with SDEN, and undertake new calculations. The former method is less computationally intensive, but depending upon the elapsed time scale under consideration relative to the original calculations, may be less accurate than the latter method, which in effect, rebuilds all of the EP, UEP parameters from the ground up on a common SDEN basis (i.e. it essentially undertakes the process as previously described using a common denominator from the beginning).

In the former approach, the parameters under which the DEN:SDEN ratios are calculated may match those of the summation equations for EPs and/or UEPs in the first place. In other words, the same range of values for {m,p,t,s} or {m,p,t} as appropriate should be applied to establish DEN and SDEN as used to establish EP or UEP. This may not always be possible, in so far as EP and/or UEP within different domains may or may not utilize the same range of values for {m,p,t,s} pr {m,p,t}. The preferred approach is for the same range of values to be used across each DEN that is to be normalized in the context of a SDEN, and that the same range of values apply to the SDEN in this case as well (the space is defined by the set of values {m,p,t,s} or {m,p,t}).

In cases where the range of values over which the DENs and/or SDEN are calculated are dissimilar, or the range of data is considered particularly sparse (as a result of casino-set parameters), normalization functions (as well as trades between GWC or other with the same DEN) may be precluded due to the expected volatility in the exchange rate as a result of the sparse data set. In such cases, trading can be shut off until a sufficient mass of data is achieved (e.g. there are enough game play sessions undertaken in a given period of elapsed time, or enough unique players utilize the game over a certain period of elapsed time, etc.) or the amount of GWC (or other) that can be traded is limited. Alternately, a trading penalty or tax can be assessed on such trades (this can also be done on any trade regardless of the data scarcity issue), said tax being collected by the casino or casinos involved in the trade, as a means by which to discourage trading until such time as greater stability in the exchange rates (as a function of data mass and stability) is achieved.

Volatility in the exchange rate can also be tested by establishing the EPs and/or UEPs over varying elapsed time windows, and tracking changes in EPs and/or UEPs over that time frame. Control limits can be established by casinos and implemented to clamp the maximum rate of change of EPs and/or UEPs over a given time frame, and/or to trigger trading halts and/or manual or algorithmic reviews. In addition to using control limits for these purposes, algorithmic assessments that, for example, test the rate of change of EPs over time (or compare changes against statistical models, for example), can trigger these same functions (i.e. trading halts, reviews).

Figure 24:
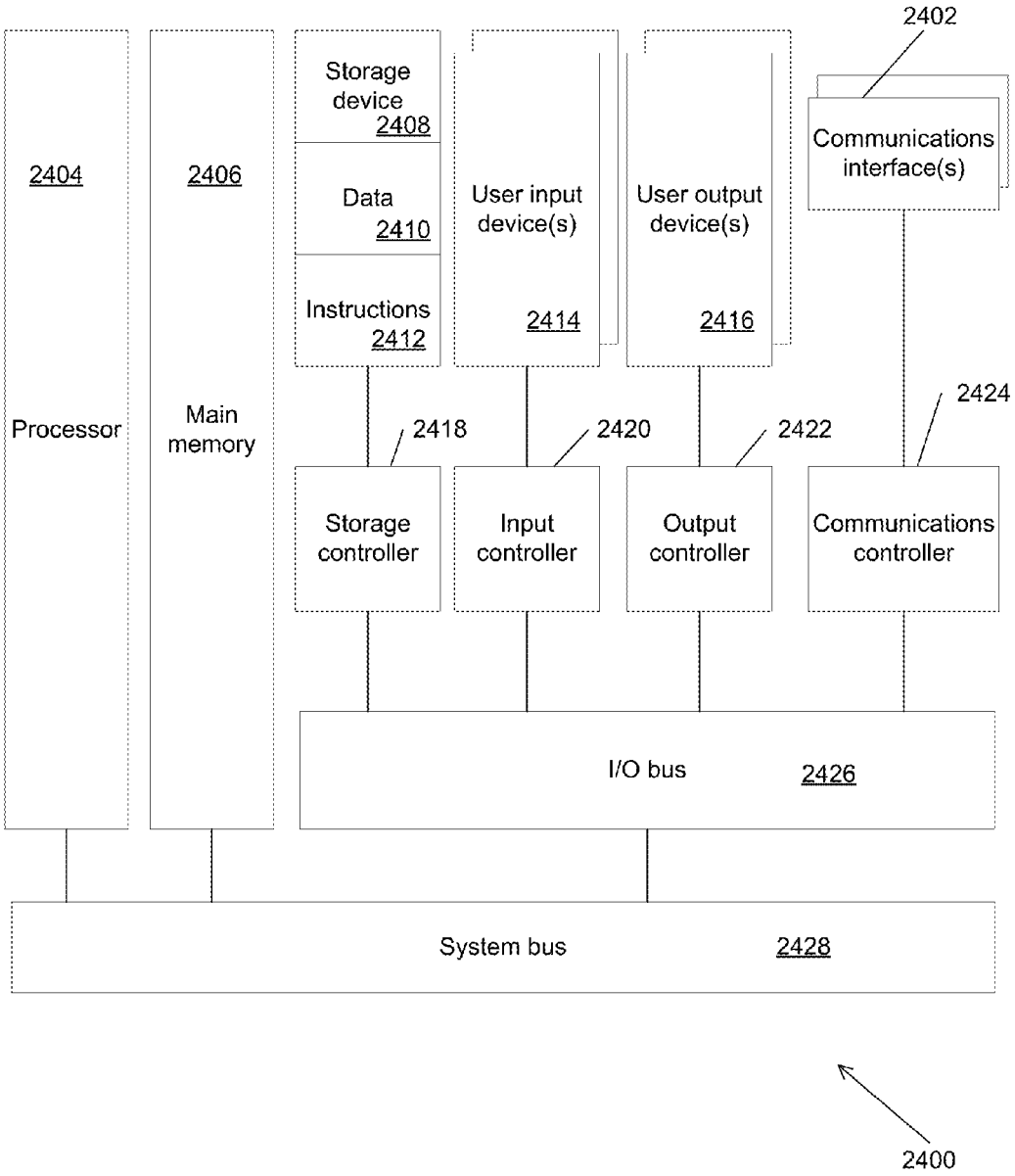
FIG. 24 is an architecture diagram of a game exchange in accordance with some embodiments of the invention

Any of a variety of processing apparatuses can host various components of a hybrid game in accordance with embodiments of the invention. In accordance with embodiments of the invention, these processing apparatuses can include, but are not limited to, a gaming machine, a general purpose computer, a computing device and/or a controller. A processing apparatus that is constructed to implement a hybrid game in accordance with embodiments of the invention is illustrated in FIG. 24. In the processing apparatus 2400, a processor 2404 is coupled to a memory 2406 by a bus 2428. The processor 2404 is also coupled to non-transitory processor-readable storage media, such as a storage device 2408 that stores processor-executable instructions 2412 and data 2410 through the system bus 2428 to an I/O bus 2426 through a storage controller 2418. The processor 2404 is also coupled to one or more interfaces that can be used to connect the processor to other processing apparatuses as well as networks as described herein. The processor 2404 is also coupled via the bus to user input devices 2414, such as tactile devices including, but not limited to, keyboards, keypads, foot pads, touch screens, and/or trackballs; as well as non-contact devices such as audio input devices, motion sensors and motion capture devices that the processing apparatus can use to receive inputs from a user when the user interacts with the processing apparatus. The processor 2404 is connected to these user input devices 2414 through the system bus 2428, to the I/O bus 2426 and through the input controller 2420. The processor 2404 is also coupled via the bus to user output devices 2416 such as (but not limited to) visual output devices, audio output devices, and/or tactile output devices that the processing apparatus uses to generate outputs perceivable by the user when the user interacts with the processing apparatus. In accordance with some embodiments, the processor is coupled to visual output devices such as (but not limited to) display screens, light panels, and/or lighted displays. In accordance with particular embodiments, the processor is coupled to audio output devices such as (but not limited to) speakers, and/or sound amplifiers. In accordance with many of these embodiments, the processor 2404 is coupled to tactile output devices like vibrators, and/or manipulators. The processor 2404 is connected to output devices from the system bus 2428 to the I/O bus 2426 and through the output controller 2422. The processor 2404 can also be connected to a communications interface 2402 from the system bus 2428 to the I/O bus 2426 through a communications controller 2424.

In accordance with various embodiments, a processor 2404 can load instructions and data from the storage device into the memory 2406. The processor 2404 can also execute instructions that operate on the data to implement various aspects and features of the components of a hybrid game as described herein. The processor 2404 can utilize various input and output devices in accordance with the instructions and the data in order to create and operate user interfaces for players or operators of a hybrid game(such as but not limited to a casino that hosts the hybrid game).

Although the processing apparatus 2400 is described herein as being constructed from a processor and instructions stored and executed by hardware components, the processing apparatus can be composed of only hardware components in accordance with other embodiments. In addition, although the storage device is described as being coupled to the processor through a bus, those skilled in the art of processing apparatuses will understand that the storage device can include removable media such as, but not limited to, a USB memory device, an optical CD ROM, magnetic media such as tape and disks. Also, the storage device can be accessed by processor 2404 through one of the interfaces or over a network. Furthermore, any of the user input devices or user output devices can be coupled to the processor 2404 via one of the interfaces or over a network. In addition, although a single processor 2404 is described, those skilled in the art will understand that the processor 2404 can be a controller or other computing device or a separate computer as well as be composed of multiple processors or computing devices.

Figure 25:
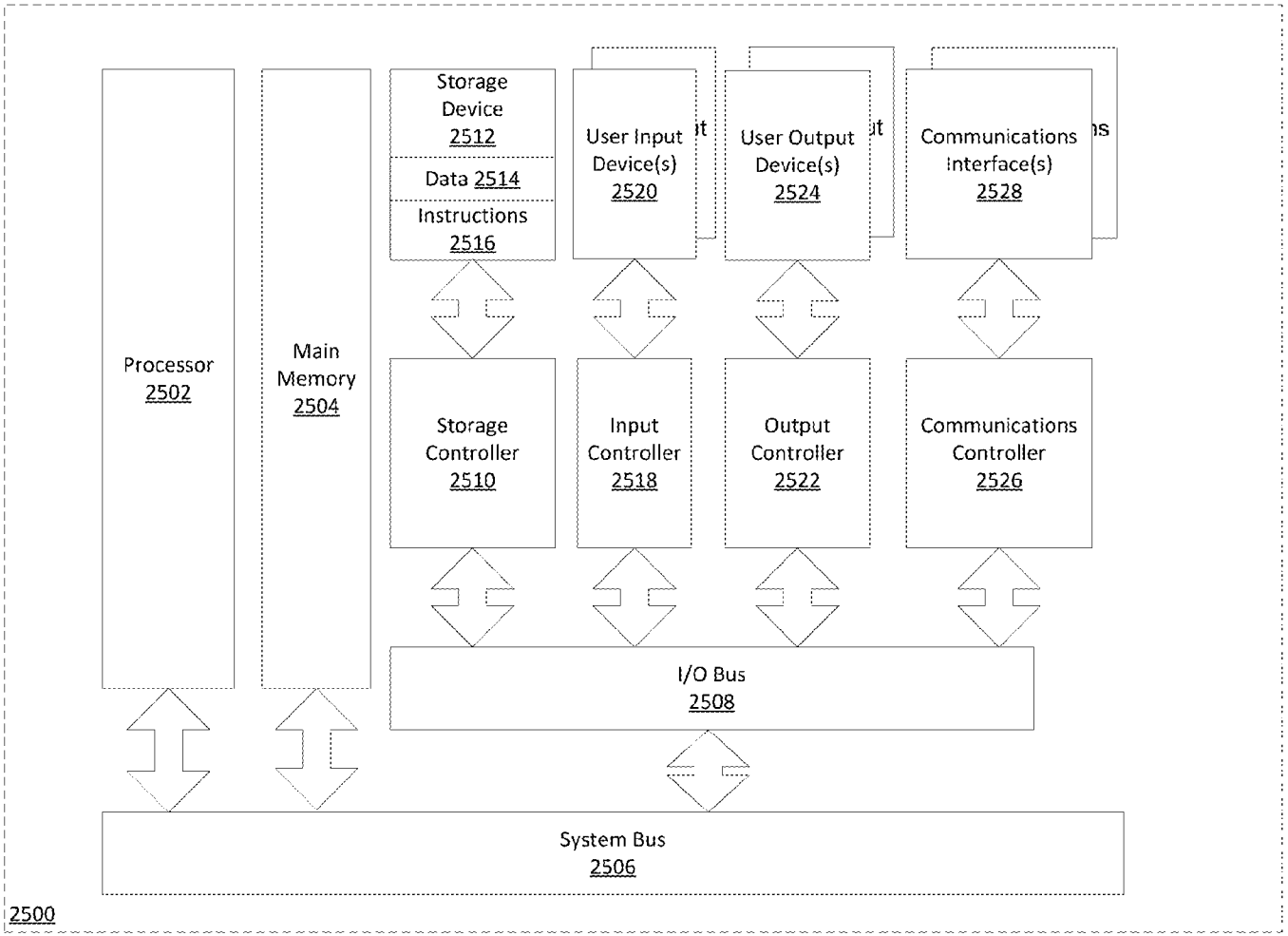
FIG. 25 is an architecture diagram of a game device in accordance with some embodiments of the invention.

Any of a variety of processing apparatuses can host various components of a game world exchange in accordance with various embodiments of the invention. In accordance with embodiments of the invention, these processing apparatuses can include, but are not limited to, a gaming machine, a general purpose computer, a computing device and/or a controller. A processing apparatus that is constructed to implement a game world exchange in accordance with embodiments of the invention is illustrated in FIG. 25. In the processing apparatus 2500, a processor 2504 is coupled to a memory 2506 by a bus 2528. The processor 2504 is also coupled to non-transitory processor-readable storage media, such as a storage device 2508 that stores processor-executable instructions 2512 and data 2510 through the system bus 2528 to an I/O bus 2526 through a storage controller 2518. The processor 2504 is also coupled to one or more interfaces that can be used to connect the processor to other processing apparatuses as well as networks as described herein. The processor 2504 is also coupled via the bus to user input devices 2514, such as tactile devices including, but not limited to, keyboards, keypads, foot pads, touch screens, and/or trackballs; as well as non-contact devices such as audio input devices, motion sensors and motion capture devices that the processing apparatus can use to receive inputs from a user when the user interacts with the processing apparatus. The processor 2504 is connected to these user input devices 2514 through the system bus 2528, to the I/O bus 2526 and through the input controller 2520. The processor 2504 is also coupled via the bus to user output devices 2516 such as (but not limited to) visual output devices, audio output devices, and/or tactile output devices that the processing apparatus uses to generate outputs perceivable by the user when the user interacts with the processing apparatus. In accordance with some embodiments, the processor is coupled to visual output devices such as (but not limited to) display screens, light panels, and/or lighted displays. In accordance with particular embodiments, the processor is coupled to audio output devices such as (but not limited to) speakers, and/or sound amplifiers. In accordance with many of these embodiments, the processor 2504 is coupled to tactile output devices like vibrators, and/or manipulators. The processor 2504 is connected to output devices from the system bus 2528 to the I/O bus 2526 and through the output controller 2522. The processor 2504 can also be connected to a communications interface 2502 from the system bus 2528 to the I/O bus 2526 through a communications controller 2524.

In accordance with various embodiments, a processor 2504 can load instructions and data from the storage device into the memory 2506. The processor 2504 can also execute instructions that operate on the data to implement various aspects and features of the components of a game world exchange as described herein. The processor 2504 can utilize various input and output devices in accordance with the instructions and the data in order to create and operate user interfaces for players or operators of a hybrid game (such as but not limited to a casino that hosts the hybrid game).

Although the processing apparatus 2500 is described herein as being constructed from a processor and instructions stored and executed by hardware components, the processing apparatus can be composed of only hardware components in accordance with other embodiments. In addition, although the storage device is described as being coupled to the processor through a bus, those skilled in the art of processing apparatuses will understand that the storage device can include removable media such as, but not limited to, a USB memory device, an optical CD ROM, magnetic media such as tape and disks. Also, the storage device can be accessed by processor 2504 through one of the interfaces or over a network. Furthermore, any of the user input devices or user output devices can be coupled to the processor 2504 via one of the interfaces or over a network. In addition, although a single processor 2504 is described, those skilled in the art will understand that the processor 2504 can be a controller or other computing device or a separate computer as well as be composed of multiple processors or computing devices.

It should also be understood that a GWEx or hybrid gaming device as described herein can be implemented on multiple processing apparatuses, whether dedicated, shared or distributed in any combination thereof, or may be implemented on a single processing apparatus.

To the extent that the GWEx or hybrid gaming device utilizes networks, connections and interfaces as herein described, it would be apparent to those skilled in the art that such networks, connections and interfaces could be any combination of the internet, a LAN, optical or wireless networks or any other method for connecting computer devices, and any applicable protocols and data interchange methods routinely practiced for such purposes.

Although certain specific features and embodiments of a gaming system have been described herein, many additional modifications and variations would be apparent to those skilled in the art. For example, the features and embodiments described herein may be implemented independently, cooperatively or alternatively without deviating from the spirit of the disclosure. It is therefore to be understood that gaming system may be practiced otherwise than as specifically described. Thus, the foregoing description of the gaming system should be considered in all respects as illustrative and not restrictive, the scope of the claims to be determined as supported by this disclosure and the claims' equivalents, rather than the foregoing description.

What is claimed is:

1. A distributed gaming system, comprising:

an electromechanical gaming machine constructed to receive real credits from a user connected to a real world server by a communication link;

the real world server connected to a game world exchange server by a communication link, wherein the real world server is constructed to:

receive from the game world exchange server via the communication link, a trigger of a first wager;

execute the first wager to determine a first payout of real credits using a random number generator; and distribute to the game world exchange server via the communication link, the first payout of real credits;

receive from the game world exchange server via the communication link, a trigger of a second wager;

execute the second wager to determine a second payout of real credits using a random number generator; and distribute to the game world exchange server via the communication link, the second payout of real credits a first entertainment software server connected to the game world exchange server by a network, wherein the first entertainment software server is constructed to:

execute a first entertainment game;

receive from the game world exchange server via the network a first entertainment game element amount;

make available to the player the first entertainment game element amount during the player's skillful play of the first entertainment game; and generate a visual display of the first entertainment game; and a second entertainment software server connected to the game world exchange server by a network, wherein the second entertainment software server is constructed to:

execute a second entertainment game;

receive from the game world exchange server via the network of a second entertainment game element amount;

make available to the player the second entertainment game element amount during the player's skillful play of the second entertainment game; and generate a visual display of the second entertainment game; and the game world exchange server connected by the communication link to the real world server and connected to first and second entertainment software servers by the network, wherein the game world exchange server is constructed to:

interface the first entertainment software server to the real world server over the network by:

distributing to the real world server via the communication link, the trigger of the first wager;

receiving from the real world server via the communication link, the first payout;

interface the second entertainment software server to the real world server over the network by:

distributing to the real world server via the communication link, the trigger of the second wager;

receiving from the real world server via the communication link, the second payout; and controlling the first entertainment software server by:

determining, based on the first payout, the first entertainment game element amount available to the player while playing the first entertainment game;

distributing to the first entertainment software server via the network, the first entertainment game element amount; and controlling the second entertainment software server by:

determining an exchange rate for the first entertainment game element and the second entertainment game element using the first wager and the player's use of the first entertainment game element amount;

determining, based on the second payout and the exchange rate, the second entertainment game element amount available to the player while playing the second entertainment game; and distributing to the second entertainment software server via the network, the second entertainment game element amount.

2. The distributed gaming system of claim 1, wherein triggering the first wager in the further includes determining the amount of real credit committed to the first wager.

3. The distributed gaming system of claim 1, wherein the game world exchange server and the real world server are implemented on a same processing apparatus.

4. The distributed gaming system of claim 1, wherein the communication link connecting the game world exchange server and the real world server utilizes the network.

5. The distributed gaming system of claim 1, wherein the game world exchange server is further constructed to:

receive from the real world server via the network, a player identifier identifying the player; and store the first entertainment game element amount in an account determined by the player identifier.

6. The distributed gaming system of claim 1, wherein the game world exchange server is further constructed to:

convert the first entertainment game element amount into a universal game world currency; and convert the universal game world currency into the second entertainment game element amount.

7. The distributed gaming system of claim 6, wherein the game world exchange server is further constructed to:

receive from the real world server via the network, a player identifier identifying the player; and store the universal game world currency in an account determined by the player identifier.

* * * * *